US010920469B2

(12) United States Patent
Liang

(10) Patent No.: US 10,920,469 B2
(45) Date of Patent: Feb. 16, 2021

(54) DOUBLE-ACTION, ADJUSTABLE, AFTER-MARKET SASH STOP

(71) Applicant: Vision Industries Group, Inc., So. Plainfield, NJ (US)

(72) Inventor: Luke Liang, So. Plainfield, NJ (US)

(73) Assignee: Vision Industries Group, Inc, Secaucus, NJ (US)

( * ) Notice: Subject to any disclaimer, the term of this patent is extended or adjusted under 35 U.S.C. 154(b) by 544 days.

(21) Appl. No.: 15/812,065

(22) Filed: Nov. 14, 2017

(65) Prior Publication Data

US 2018/0119463 A1 May 3, 2018

Related U.S. Application Data

(63) Continuation of application No. 13/065,169, filed on Mar. 15, 2011, now Pat. No. 9,840,860, which is a (Continued)

(51) Int. Cl.
*E05C 17/60* (2006.01)
*E05C 3/14* (2006.01)
(Continued)

(52) U.S. Cl.
CPC ..... *E05C 17/60* (2013.01); *E05B 63/0056* (2013.01); *E05B 63/18* (2013.01); *E05B 65/0847* (2013.01); *E05C 3/14* (2013.01); *E05C 2007/007* (2013.01); *Y10T 29/49778* (2015.01); *Y10T 292/1052* (2015.04); *Y10T 292/1075* (2015.04); *Y10T 292/42* (2015.04)

(58) Field of Classification Search
CPC ..... E05B 63/0056
USPC ..... 49/181, 183–185
See application file for complete search history.

(56) References Cited

U.S. PATENT DOCUMENTS 16,228 A 12/1856 Copeland
30,408 A 10/1860 Judd
(Continued)

FOREIGN PATENT DOCUMENTS

GB 2 286 627 8/1995
GB 2 461 079 12/2009
(Continued)

*Primary Examiner* — Alyson M Merlino
(74) *Attorney, Agent, or Firm* — Thomas A. O'Rourke; Bodner & O'Rourke, LLP

(57) ABSTRACT

An adjustable stop limits sliding sash window/door travel between a closed position and a safe position, where the safe position is a position less than a full-open position. The stop can be installed upon window/door master frames during initial manufacturing, or as an after-market option while the sash windows/doors are in service in a building. The safety stop may be comprised of a housing and a tumbler being pivotally mounted within a cavity in the housing, with a spring to bias the tumbler out of an opening in the housing. Mounting is by a flange extending from the housing, with spacers of varying thickness that are capable of removably attaching thereon to accommodate sash to master frame height differences. A safety member may be added to either the tumbler or housing to create a double action stop, requiring disengagement of the safety member, prior to toggling of the stop.

12 Claims, 46 Drawing Sheets

Related U.S. Application Data continuation-in-part of application No. 12/802,640, filed on Jun. 10, 2010, now Pat. No. 8,789,862, which is a continuation-in-part of application No. 12/456,347, filed on Jun. 15, 2009, now abandoned.

(60) Provisional application No. 61/404,891, filed on Oct. 8, 2010, provisional application No. 61/217,365, filed on May 29, 2009.

(51) Int. Cl.

| | |
|---|---|
| ***E05B 63/00*** | (2006.01) |
| ***E05B 65/08*** | (2006.01) |
| ***E05B 63/18*** | (2006.01) |
| *E05C 7/00* | (2006.01) |

(56) References Cited

U.S. PATENT DOCUMENTS 36,524 A 9/1862 Minor
51,222 A 11/1865 Ridell
108,778 A 11/1870 Gorman
115,781 A 6/1871 Steele
126,872 A 5/1872 Buckman
148,857 A 3/1874 Smith
163,008 A 5/1875 Gillespie
166,842 A 8/1875 Berryman
178,360 A 6/1876 Cooper
190,074 A 4/1877 Penfield
192,614 A 7/1877 Andrews
192,919 A 7/1877 Hoyt
201,146 A 3/1878 Adler
215,125 A 5/1879 Hunter
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
368,595 A 8/1887 King
369,885 A 9/1887 Shaw
375,656 A 12/1887 Shaw
376,252 A 1/1888 McIntyre
379,910 A 3/1888 Rosentreter
410,728 A 9/1889 Brown
417,868 A 12/1889 Janes
423,761 A 3/1890 Hasenpflug
426,303 A 4/1890 McGovern
447,068 A 2/1891 Dixon
452,723 A 5/1891 Schmalhausen
480,148 A 8/1892 Theby
493,159 A 3/1893 Gibson
509,941 A 12/1893 Perry
512,593 A 1/1894 Webster
520,754 A 5/1894 Burmeister
526,118 A 9/1894 Sharp
528,656 A 11/1894 Burmeister
530,078 A 12/1894 Ammerman
534,185 A 2/1895 Winchester
537,258 A 4/1895 Wilcox
539,030 A 5/1895 Bitner
551,181 A 12/1895 Dillon
551,242 A 12/1895 Wallace
554,448 A 2/1896 Keil
564,426 A 7/1896 Hubbard
572,591 A 12/1896 Woodard
587,424 A 8/1897 Bonine
590,225 A 9/1897 Hill
653,458 A 7/1900 Paquette
666,596 A 1/1901 Breen
683,928 A 10/1901 Geraghty
688,491 A 12/1901 Sigler
695,736 A 3/1902 Kendrick
698,742 A 4/1902 Scharnweber
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenpflug
745,888 A 12/1903 McElwee
749,469 A 1/1904 Assorati
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Heamshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A 1/1909 Petrie
926,899 A 7/1909 Roy
928,408 A 7/1909 Taube
948,628 A 2/1910 Jefferis
959,150 A 5/1910 Morris
966,063 A 8/1910 Toothaker
970,507 A * 9/1910 Jones ..... E05B 65/0007 292/DIG. 20
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilbum
1,051,918 A 2/1913 Rowley
1,059,999 A 4/1913 James
1,069,079 A 7/1913 Voight
1,077,487 A 11/1913 Miller
1,080,172 A 12/1913 Rusk
1,100,820 A 6/1914 Edwards
1,121,228 A 12/1914 Burkhart
1,122,026 A 12/1914 O'Rourke
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Hoillis
1,243,115 A 10/1917 Shur
1,244,745 A 10/1917 Gadke
1,247,182 A 11/1917 Tuekmantel
1,253,810 A 1/1918 Gianninoto
1,261,274 A 4/1918 Newsam
1,269,467 A 6/1918 Winters
1,270,740 A 6/1918 Keyes

(56) References Cited

U.S. PATENT DOCUMENTS 1,272,900 A 7/1918 Berman
1,279,353 A 9/1918 Keiley
1,311,052 A 7/1919 Danforth
1,322,677 A 11/1919 Ditlefsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,470,858 A 10/1923 Maxwell
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilbert
1,605,717 A 11/1926 Gregg
1,619,031 A 3/1927 Ostrosky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,677,177 A 9/1932 Hinderer
1,891,940 A 12/1932 McAllister
1,900,936 A 3/1933 Huttger
1,901,974 A 3/1933 Macy
1,922,062 A 8/1933 Sullivan
1,940,084 A 12/1933 Grasso
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stillman
2,202,561 A 5/1940 Lahiere
2,272,145 A 2/1942 Anderson
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,581,816 A 1/1952 Schlueter
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostadal
2,645,515 A 7/1953 Thomas
2,648,967 A 8/1953 Holmsten
2,670,982 A 3/1954 Banham
2,692,789 A 10/1954 Rivard
2,735,707 A 2/1956 Sylvan
2,758,862 A 8/1956 Endter
2,766,492 A 10/1956 Day
2,789,851 A 4/1957 Lickteig
2,818,919 A 1/1958 Sylvan
2,846,258 A 8/1958 Granberg
2,855,772 A 10/1958 Hillgren
2,884,276 A 4/1959 Baptist
2,920,914 A 1/1960 Jenkins
2,941,832 A 6/1960 Grossman
3,027,188 A 3/1962 Eichstadt
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,438,153 A 4/1969 Lemme
3,535,823 A * 10/1970 Mason ..... E05F 7/04
49/449
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
3,930,678 A 1/1976 Alexander
4,054,308 A 10/1977 Prohaska
4,059,298 A 11/1977 Van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,233,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,736,972 A 4/1988 Mosch
4,801,164 A 1/1989 Mosch
4,813,725 A 3/1989 Mosch
4,824,154 A 4/1989 Simpson
4,826,222 A 5/1989 Davis
4,827,685 A 5/1989 Schmidt
4,893,849 A 1/1990 Schlack
4,922,658 A 5/1990 Coddens
4,923,230 A 5/1990 Simpson
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim

(56) References Cited

U.S. PATENT DOCUMENTS

| | | | |
|---|---|---|---|
| 5,076,015 | A | 12/1991 | Manzalini |
| 5,087,087 | A | 2/1992 | Vetter |
| 5,087,088 | A | 2/1992 | Milam |
| 5,090,750 | A | 2/1992 | Lindqvist |
| 5,090,754 | A | 2/1992 | Thompson |
| 5,110,165 | A | 5/1992 | Piltingsrud |
| 5,127,685 | A | 7/1992 | Dallaire |
| 5,139,291 | A | 8/1992 | Schultz |
| 5,143,412 | A | 9/1992 | Lindqvist |
| 5,161,839 | A | 11/1992 | Piltingsrud |
| 5,165,737 | A | 11/1992 | Riegelman |
| 5,183,310 | A | 2/1993 | Shaughnessy |
| 5,219,193 | A | 6/1993 | Piltingsrud |
| 5,244,238 | A | 9/1993 | Lindqvist |
| 5,248,174 | A | 9/1993 | Matz |
| 5,274,955 | A | 1/1994 | Dallaire |
| 5,341,752 | A | 8/1994 | Hambleton |
| 5,398,447 | A | 3/1995 | Morse |
| 5,437,484 | A | 8/1995 | Yamada |
| 5,448,857 | A | 9/1995 | Stormo |
| 5,452,925 | A | 9/1995 | Huang |
| 5,454,609 | A | 10/1995 | Slocomb |
| 5,536,052 | A | 7/1996 | Maier |
| 5,560,149 | A | 10/1996 | Lafevre |
| 5,575,116 | A | 11/1996 | Carlson |
| 5,582,445 | A | 12/1996 | Olsen |
| RE35,463 | E | 2/1997 | Vetter |
| 5,636,475 | A | 6/1997 | Nidelkoff |
| 5,688,000 | A | 11/1997 | Dolman |
| 5,715,631 | A | 2/1998 | Kailian |
| 5,741,032 | A | 4/1998 | Chaput |
| 5,778,602 | A | 7/1998 | Johnson |
| 5,791,700 | A | 8/1998 | Biro |
| 5,806,900 | A | 9/1998 | Bratcher |
| 5,839,767 | A | 11/1998 | Piltingsrud |
| 5,901,499 | A | 5/1999 | Delaske |
| 5,901,501 | A | 5/1999 | Fountaine |
| 5,911,763 | A | 6/1999 | Quesada |
| 5,927,768 | A | 7/1999 | Dallmann |
| 5,970,656 | A | 10/1999 | Maier |
| 5,992,907 | A | 11/1999 | Sheldon |
| 6,000,735 | A | 12/1999 | Jourdenais |
| 6,086,121 | A | 7/2000 | Buckland |
| 6,116,665 | A | 9/2000 | Subliskey |
| 6,135,510 | A | 10/2000 | Diginosa |
| 6,139,071 | A | 10/2000 | Hopper |
| 6,142,541 | A | 11/2000 | Rotondi |
| 6,155,615 | A | 12/2000 | Schulz |
| 6,176,041 | B1 | 1/2001 | Roberts |
| 6,178,696 | B1 | 1/2001 | Liang |
| 6,183,024 | B1 | 2/2001 | Schultz |
| 6,209,931 | B1 | 4/2001 | Von Stoutenborough |
| 6,217,087 | B1 | 4/2001 | Fuller |
| 6,230,443 | B1 | 5/2001 | Schultz |
| 6,279,266 | B1 | 8/2001 | Searcy |
| 6,349,576 | B2 | 2/2002 | Subliskey |
| 6,364,375 | B1 | 4/2002 | Szapuckl |
| 6,546,671 | B2 | 4/2003 | Mitchell |
| 6,565,133 | B1 | 5/2003 | Timothy |
| 6,568,723 | B2 | 5/2003 | Murphy |
| 6,588,150 | B1 | 7/2003 | Wong |
| 6,592,155 | B1 | 7/2003 | Lemley |
| 6,607,221 | B1 | 8/2003 | Elliott |
| 6,631,931 | B2 | 10/2003 | Magnusson |
| 6,634,683 | B1 | 10/2003 | Brannan |
| 6,817,142 | B2 | 11/2004 | Marshik |
| 6,848,728 | B2 | 2/2005 | Rotondi |
| 6,871,885 | B2 | 3/2005 | Goldenberg |
| 6,871,886 | B2 | 3/2005 | Coleman |
| 6,877,784 | B2 | 4/2005 | Kelley |
| 6,925,758 | B2 | 8/2005 | Petit |
| 6,957,513 | B2 | 10/2005 | Pettit |
| 6,983,963 | B2 | 1/2006 | Eslick |
| 7,000,957 | B2 | 2/2006 | Lawrence |
| 7,013,603 | B2 | 3/2006 | Eenigenburg |
| 7,063,361 | B1 | 6/2006 | Lawrence |
| 7,070,211 | B2 | 7/2006 | Polowinczak |
| 7,070,215 | B2 | 7/2006 | Kelley |
| 7,100,951 | B2 | 9/2006 | Jien |
| 7,147,255 | B2 | 12/2006 | Goldenberg |
| 7,159,908 | B2 | 1/2007 | Liang |
| 7,296,831 | B2 | 11/2007 | Generowicz |
| 7,322,619 | B2 | 1/2008 | Nolte |
| 7,322,620 | B1 | 1/2008 | Lawrence |
| 7,407,199 | B2 | 8/2008 | Richardson |
| 7,431,356 | B2 | 10/2008 | Liang |
| 7,481,470 | B2 | 1/2009 | Eenigenburg |
| 7,510,221 | B2 | 3/2009 | Eenigenburg |
| 7,530,611 | B2 | 5/2009 | Liang |
| 7,559,588 | B2 | 7/2009 | Liang |
| 7,607,262 | B2 | 10/2009 | Pettit |
| 7,637,544 | B2 | 12/2009 | Liang |
| 7,665,775 | B1 | 2/2010 | Miller |
| 7,699,365 | B2 | 4/2010 | Liang |
| 7,922,223 | B2 | 4/2011 | Lawrence |
| 7,976,077 | B2 | 7/2011 | Flory |
| 8,205,919 | B2 | 6/2012 | Flory |
| 8,205,920 | B2 | 6/2012 | Flory |
| 8,220,846 | B2 | 7/2012 | Liang |
| 8,235,430 | B2 | 8/2012 | Liang |
| 8,272,164 | B2 | 9/2012 | Albrecht |
| 8,336,930 | B2 | 12/2012 | Liang |
| 8,360,484 | B2 | 1/2013 | Liang |
| 8,414,039 | B2 | 4/2013 | Liang |
| 8,511,724 | B2 | 8/2013 | Liang |
| 8,550,507 | B2 | 10/2013 | Barton |
| 8,567,830 | B2 | 10/2013 | Liang |
| 8,657,347 | B2 | 2/2014 | Liang |
| 8,726,572 | B2 | 5/2014 | Derham |
| 8,789,857 | B2 | 7/2014 | Liang |
| 8,789,862 | B2 | 7/2014 | Liang |
| 8,833,809 | B2 | 9/2014 | Liang |
| 8,844,985 | B2 | 9/2014 | Liang |
| 8,870,244 | B2 | 10/2014 | Liang |
| 9,103,144 | B2 | 8/2015 | Liang |
| 9,140,033 | B2 | 9/2015 | Wolf |
| 9,376,834 | B2 | 6/2016 | Liang |
| 2006/0192391 | A1 | 8/2006 | Pettit |
| 2006/0244270 | A1 | 11/2006 | Rotondi |
| 2007/0205615 | A1 | 9/2007 | Eenigenburg |
| 2008/0169658 | A1 | 7/2008 | Wolf |
| 2010/0199726 | A1 | 8/2010 | Varney |
| 2010/0218425 | A1 | 9/2010 | Nolte |
| 2010/0263415 | A1 | 10/2010 | Rupsil |
| 2013/0214545 | A1 | 8/2013 | Wolf |
| 2013/0283695 | A1 | 10/2013 | Hollerman |
| 2016/0076282 | A1 | 3/2016 | Wolf |

FOREIGN PATENT DOCUMENTS

| | | |
|---|---|---|
| GB | 2 461 107 | 12/2009 |
| GB | 2 461 108 | 12/2009 |

* cited by examiner 21
34
34A
32
29
34
34A
32

28
21
25
30
31
36
24

33
31
37C
21
26
24

21
26
23
22
31A
31B
33
31C
23

31P
23
27
34
21
21o
35
25
26
35
21oA
34
27
38
24
22

20

DOUBLE-ACTION, ADJUSTABLE, AFTER-MARKET SASH STOP

CROSS REFERENCES TO RELATED APPLICATIONS

This application is a continuation of U.S. application Ser. No. 13/065,169, filed on Mar. 15, 2011, which claims priority on U.S. Provisional Application Ser. No. 61/404,891 filed on Oct. 8, 2010. U.S. application Ser. No. 13/065,169 is a continuation-in-part of U.S. patent application Ser. No. 12/802,640, titled Adjustable After-Market Sash Window Stop, filed Jun. 10, 2010, now issued as U.S. Pat. No. 8,789,862, which is a continuation-in-part of U.S. patent application Ser. No. 12/456,347, titled "Single Action Vent Stop," filed Jun. 15, 2009, which claims priority on U.S. Provisional Application Serial No. 61/217,365, filed May 29, 2009. All disclosures of these applications are incorporated herein by reference.

FIELD OF THE INVENTION

The present invention relates to improvements in safety latches for sliding sash windows and doors, and more particularly to a safety latch which permits after-market installation on a variety of different window configurations, and is capable of preventing accidental egress of a small child from a window.

BACKGROUND OF THE INVENTION

A sash window or sash door is comprised of a master frame that permits installation into a wall of a home or other building. The master frame is generally arranged to receive at least one sliding member, with the sliding member being in. the form of a window or door member that is encased within its own frame. The sliding door or window may contain multiple panes of glass that are separated and supported by muntin bars, or alternatively, a single glazing may be used to which may be added a decorative artificial muntin grid that simulates the look of the multi-paned window.

Sliding sash windows and doors may be designed to slide horizontally or vertically within the master frame. In addition, sash windows and doors may be provided in the form of a single-hung or a double-hung arrangement In the single hung arrangement, there may be one sash window member that is fixed within the master frame and a second sash window member that slides relative to the first sash window member. In the double hung arrangement, both sash window members may be permitted to slide relative to the master frame.

Historically, these sliding sash windows were provided with a single latching mechanism, which permitted a person to lock the window in a closed position, or to unlock the window and permit free movement of a sash from one end of the master frame to the other end of the master frame. Safety concerns, in terms of preventing the unauthorized entry of burglars through open windows or other intruders threatening the security of occupants, has led to the introduction of a secondary latching mechanism on many new windows that may be deployed to selectively limit the travel of the sash, once the primary latch has been toggled to unlock the window sashes. One example is shown by U.S. Pat. No. 6,854,214 to Polowinczak for "Stop for a Slidable Window." This sash window stop, and other similar stops, is designed to be disposed within a cavity in the manufactured sash window frame, whereby a portion of the stop may be toggled to protrude outward and limit the travel of a sash.

The drawback tor these window stops is that they are not conducive for after-market installation into a sash window. The window stop disclosed herein provides a unique means of installing such a travel limiting latch onto an existing sash window. The stop herein does not require creation of a cavity in the sash window frame, and may furthermore be easily modified to accommodate various different sash window configurations.

OBJECTS OF THE INVENTION

It is an object of the invention to provide a means of preventing accidental egress of a child out of a sliding sash window or sash door.

It is an object of the invention to provide a travel limiting stop for a sliding sash window or sash door.

It is another object of the invention to provide a sliding sash window stop that may be installed onto a window after manufacturing of the window is completed.

It is a further object of the invention to provide a sliding sash window stop that may be easily installed onto a window that is already in use in a building.

It is another object of the invention to provide a window stop that may be installed onto many different sash window configurations.

It is also an object of the invention to provide a means of quickly adjusting the stop to accommodate different depths of sash window insets within a master window frame.

Further objects and advantages of the invention will become apparent from the following description and claims, and from the accompanying drawings.

SUMMARY OF THE INVENTION

The after-market safety stop disclosed herein is intended for attachment to a master frame of a sliding sash window assembly or a sliding sash door assembly, to be capable of limiting sash travel between a closed position and a safe position, where the safe position is a sash position between the closed sash position and full-open sash position. The safe position may be established to permit sash movement sufficient for ventilation, but be small enough to prevent window sash travel of a magnitude that would allow a small child to accidentally fall out of the opened window. The safety stop may be attached to older windows already installed in a building, because they lack such a stop, or even where they have a safety stop, but it permits travel that is excessive or insufficient in comparison with the needs of the occupant.

The safety stop may be comprised of a multi-walled housing that has a cavity and several openings. A tumbler may be pivotally disposed into the housing cavity, with a portion of the first end of said tumbler protruding out from said one opening in the housing top end, and with the tumbler pivoting at a point between its first end and second end.

The tumbler may be biased by a biasing member, which may essentially be a torsion having arms that are adapted to be held within the housing and the tumbler. The biasing member may be set to bias the tumbler to pivot out from the housing cavity. The tumbler may also be capable of occupying four different positions, two of which may be considered to be transient positions. The tumbler may be placed in a first position, where a tumbler bearing surface may limit movement of a sash member between a closed position and a safe position, or in a second position, where the sash member be able to move past the tumbler, by deflecting the tumbler into an intermediate position, where it may be retained until the sash member is moved back towards the closed past enough to be clear of the safety stop. The tumbler may occupy a second transient position—a retracted position, when the tumbler is toggled between the first and second position.

A mounting flange may be integral to the housing, mid protruding outward therefrom, at a position between a top end and a bottom end of the housing, with the mounting flange being generally parallel to the housing bottom end, but offset therefrom by a certain amount. The mounting flange may comprise two or more orifices usable for mounting the safety stop to the sash window or door.

The bottom surface of the mounting flange may also contain two or more orifices for receiving two or more posts to attach a spacer block to the safety stop. The spacer block may be capable of nesting within the mounting flange bottom surface, and may remain therein because of a friction fit between the posts and orifice. Alternatively, the posts may snap into the orifices through the use of a detent. The spacer blocks may have a thickness to adjust for variations in a height difference between said sliding sash and said master frame. Using different thicknesses for the spacer and combinations of different spacers may permit accommodation of for various manufacturers of a sliding sash window assembly or a sliding sash door assembly.

BRIEF DESCRIPTION OF THE DRAWINGS

FIG. 59 is the cross-sectional view of FIG. 58, but with the tumbler having been actuated from the non-safe position to the safe position, and with the leaf spring biasing the button out from the tumbler.

FIG. 60 is the cross-sectional view of FIG. 59, but with the leaf spring engaging the housing to prevent movement of the tumbler from the safe to the unsafe position because the safety button has not been depressed.

FIG. 61 is a front view of the tumbler of the double action sash window stop of FIG. 50.

FIG. 62 is a bottom view of the tumbler of FIG. 61.

FIG. 63 is a side view of the tumbler of FIG. 61.

FIG. 64 is a front view of the safety button of the double action sash window stop of FIG. 50.

FIG. 65 is a bottom view of the safety button of FIG. 64.

FIG. 66 is a side view of the safety button of FIG. 64.

DETAILED DESCRIPTION OF THE INVENTION

Figure 3:
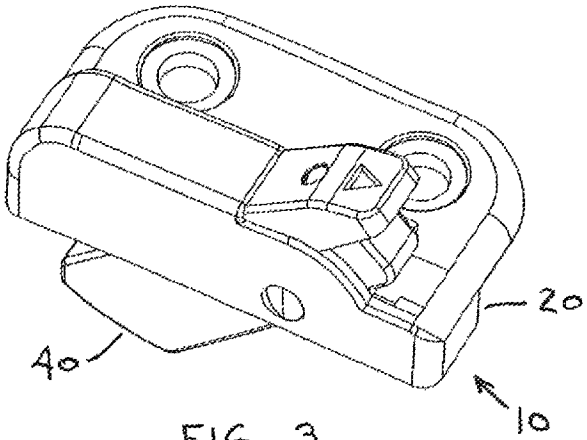
FIG. 3 is a perspective view of the adjustable window stop of the current invention.

FIG. 3 shows a first embodiment of the adjustable window stop assembly 10 of the present invention, which may be practiced using the adjustable window stop assembly 10 and one or more spacer blocks (80A, 80B, etc) of the same or of varying thickness.

Figure 20:
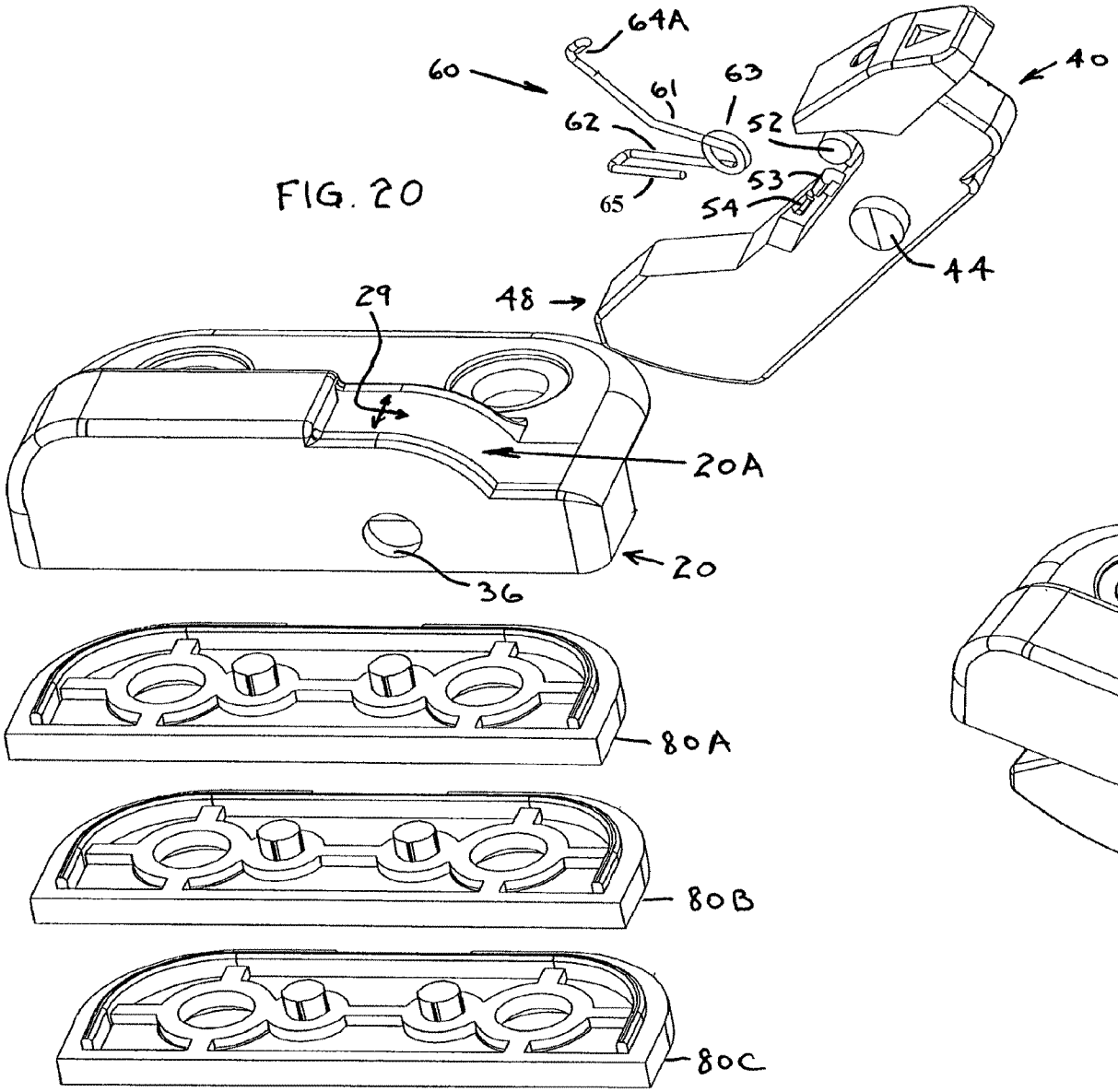
FIG. 20 is an exploded view of the parts comprising the safety stop assembly of the current invention and three spacer blocks.

The window stop assembly 10 may include a housing 20, a tumbler 40, and a biasing member 60, as seen in FIG. 20, the operation of which is disclosed by U.S. patent application Ser. No. 12/456,347, which claims priority on U.S. Provisional Application Serial No. 61/217,365, filed May 29, 2009, the disclosures of each being incorporated herein by reference. The housing 20 may be constructed to be of many different shapes, and need not resemble the box-like structure of the housing shown in FIGS. 12A through 12E. In fact, the housing could be formed of a single walled member and could resemble half of an egg-shape. It may be formed as one continuous piece, as with a casting or an injection molded plastic part, or it may be an assembly of several wall members that are assembled, using mechanical fasteners. Using a box-like formation for the housing results in simplification of several other aspects of the design of the safety stop herein, and is therefore described in one embodiment.

The housing 20 may comprise a top wall 21, a bottom wall 22, a first end wall 23, a second end wall 24, a first (uninterrupted) side wall 25, and a second (interrupted) side wall 26, to create a cavity 20A. The second side wall 25 may have extending therefrom a mounting fan go 31, which may be formed integral to the housing, or may be attached thereon using mechanical fasteners or a welding process. The mounting flange 31 may be comprised of a top surface 31 A, a bottom surface 31B, and a periphery 31C that may be of a generally rectangular shape, except for a pair of outside corner radii 32. The mounting flange may have two or more mounting holes 34 running completely through the flange, from the upper surface 31A to the lower surface 31B. The holes 34 may additionally have a countersink 34A or a countersink with a recess for accommodating flush-head or pan-head fasteners. Both the top surface 31A and the bottom surface 31B may be flat. However, in an alternate embodiment, the bottom surface 31B may be sculpted to leave behind a padded area 31P in the region around holes 34, as well as a ridge of thickness 38 along the edge. The mounting flange 31 may have one or more additional holes 35 which begin at the bottom surface 31B of the mounting flange 31. The holes 35 may be full depth, or may alternatively only penetrate to a depth being between the bottom surface 31B and the upper surface 31A, so as to improve the visual appearance of the safety stop. These additional holes 35 may be used to receive posts located on the spacer blocks 80A and 80B in a friction fit, which will be discussed hereinafter.

Figures 12A, 12B, 12C, 12D, 12E:
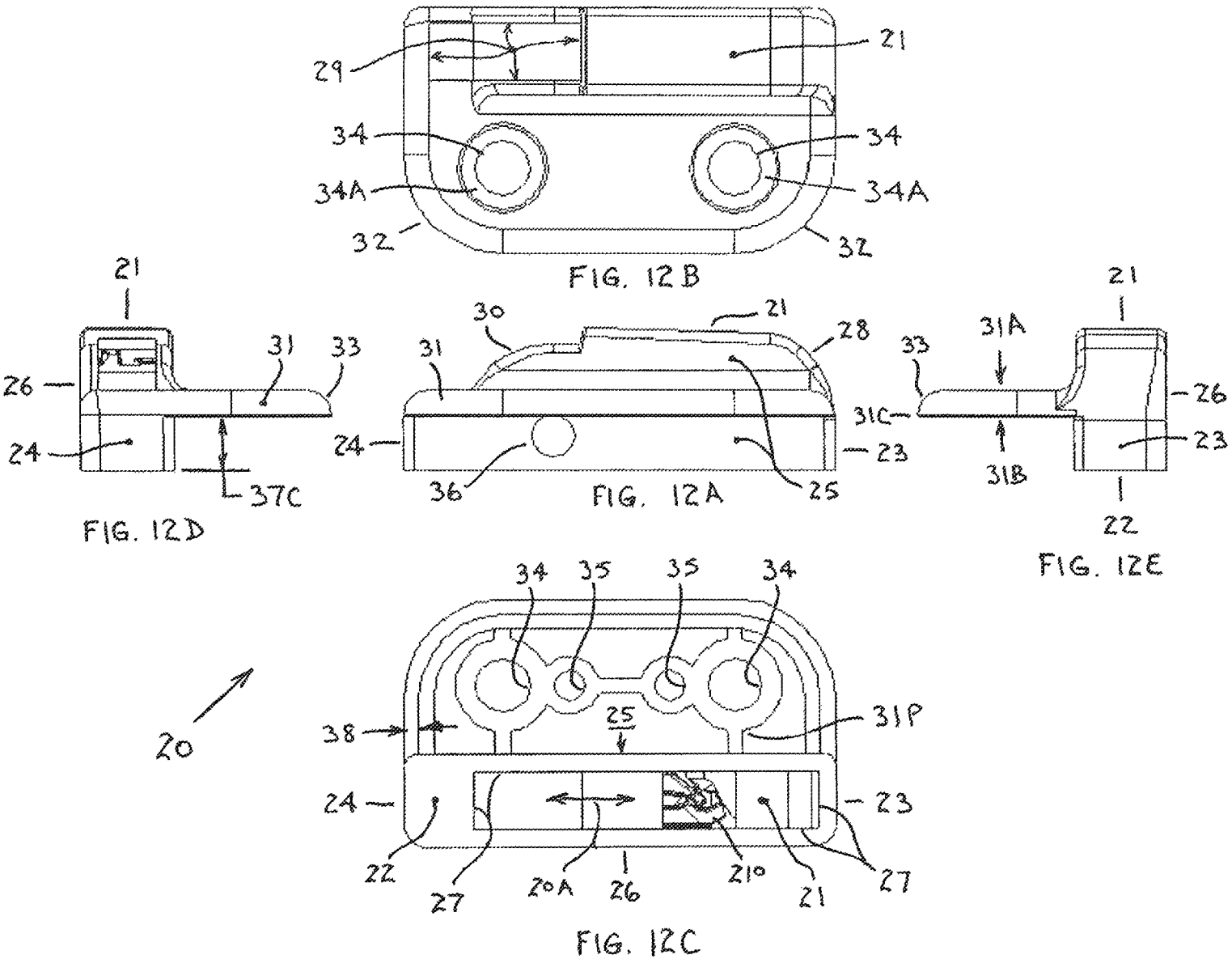
FIG. 12A is a front view of the window stop housing.
FIG. 12B is a top view of the window stop housing of FIG. 12A.
FIG. 12C is a bottom view of the window stop housing of FIG. 12A.
FIG. 12D is a left end view of the window stop housing of FIG. 12A.
FIG. 12E is a right end view of the window stop housing of FIG. 12A.
Figure 13:
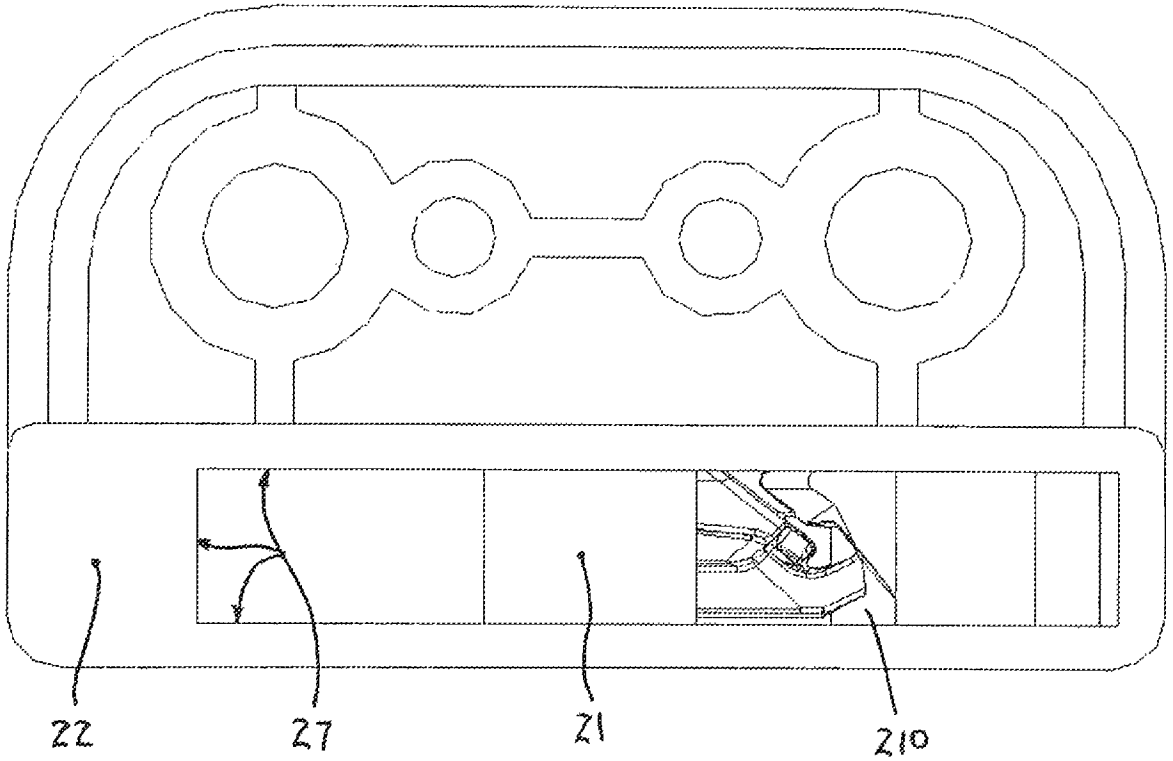
FIG. 13 is the bottom view of FIG. 12C, but enlarged to show the housing contour features that interact with the biasing member.

The thickness of the mounting flange 31, as well as the housing walls 21-26, may be sized to prevent impact loads, generated from a force exerted on the sliding sash by an intruder, from easily destroying the safety stop, as an intruder may seek to gain, unauthorized entry into a dwelling in that manner. The choice of material for constructing the stop may similarly serve to deter such a forced entry. The periphery 31C of the mounting flange 31 may have the upper edge broken with a radius 33, as seen in FIGS. 12D and 12E.

The mounting flange 31 may be positioned on the second side wall 25 so as to be located in between the top wall 21 and the bottom wall 22 of the housing 20. The mounting flange 31 may be offset from the bearing surface area 45 of the tumbler a distance 37A (FIG. 6) that may accommodate most windows. The amount of offset relates to the invention providing the capability of a functional installation on variations different configurations of windows and doors, as will be discussed hereinafter. It should be noted that the offset could be incrementally varied so as to produce a series of different stop assemblies to accommodate the different sash-to-frame depth differences discussed later (see FIGS. 27-30), but the invention may preferably be practiced according to the embodiment described herein where the spacers permit a user to install the stop on-various different windows without needing to purchase a specific stop having a particular offset.

Figure 6:
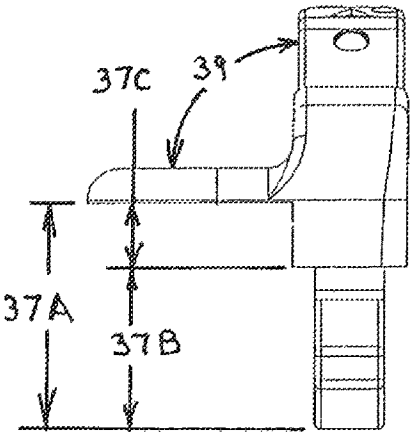
FIG. 6 is a side view of the adjustable window stop of the current invention.

The bottom wall 22 of the housing may also be generally flat and be offset from the bearing surface area 45 a distance 37B (FIG. 6), so that the flange 31 position on side wall 25 and the housing bottom wall 22 have a corresponding relationship. Therefore, the mounting flange may also be generally parallel to the bottom wall 22, but offset therefrom by an amount 37C (FIGS. 6 and 12E). The mounting flange 31 may also protrude out from the housing side wall 25 to be at an angle 39 relative to that wall The angle 39 may preferable be 90 degrees, but the flange may also protrude out at a non-orthogonal angle.

The housing 20 may further comprise an opening 27 in at least a portion of the bottom wall 22 to expose cavity 20A, to thereby accommodate pivotal installation therein, and subsequent pivotal motion therefrom, of the tumbler 40. The opening 27 may remove the bottom wall 22 completely between the first side wall 25 and the second side wall 26, as seen in FIG. 12C. Opening 27 may also remove the bottom wall up to the inside of wall 23, but may fall short of reaching wall 24.

Figure 4:
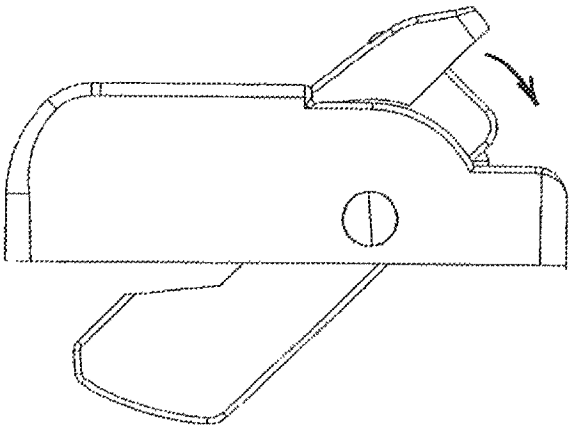
FIG. 4 is a side view of the adjustable window stop of the current invention.
Figure 7:
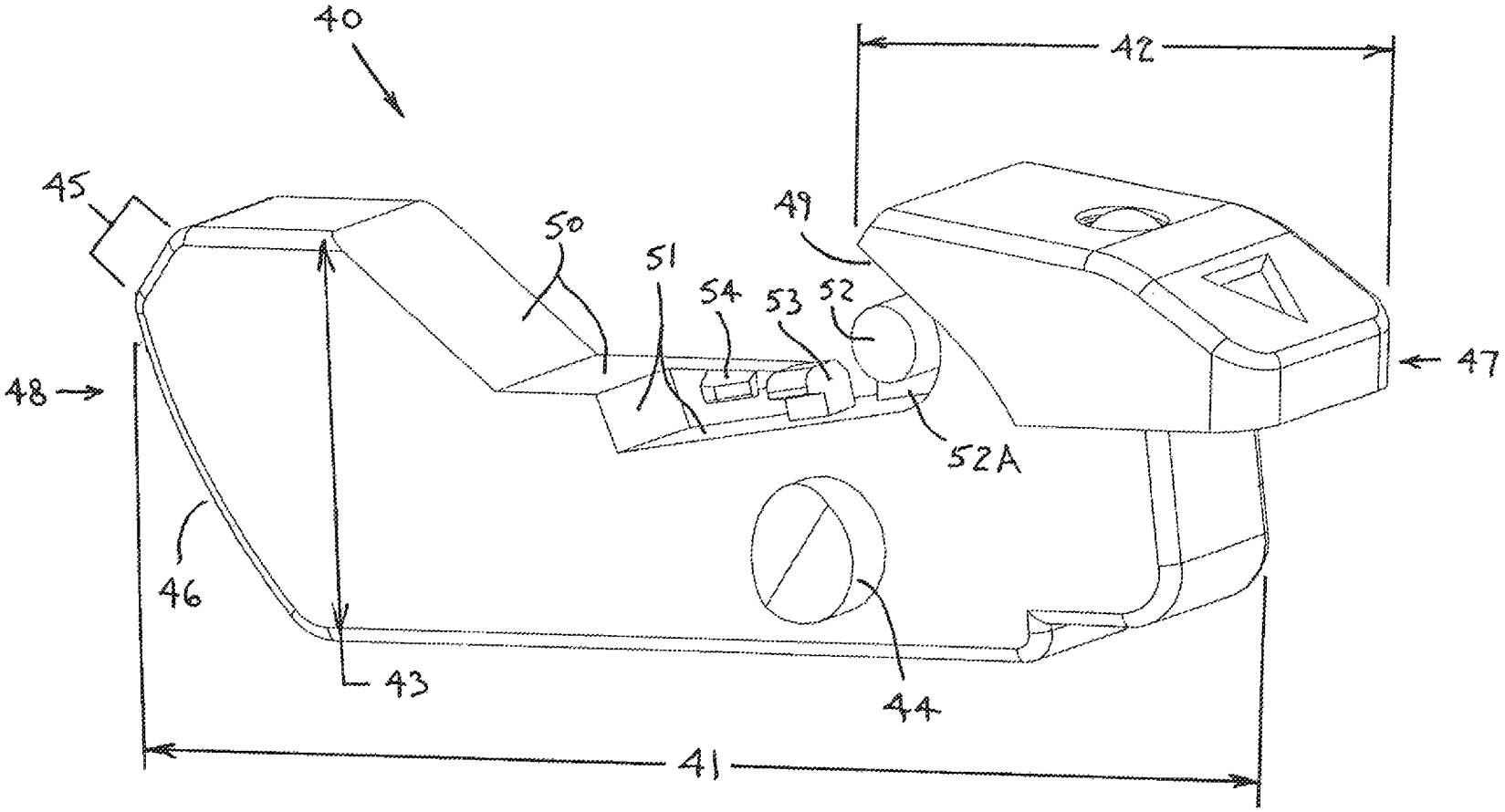
FIG. 7 is a perspective view of the tumbler of the safety stop of the current invention.

There may also be an opening 29 in the top wall 21 to expose cavity 20A, as seen in FIG. 12B. The top wall 21 and the first side wall 25 and second side wall 26 may be trimmed back to have a periphery 30. which may enable insertion of the tumbler 40 through the opening 29, for its pivotal mounting in the housing cavity 20A (FIG. 4). The pivotal mounting may be accommodated by a pair of in-line holes 36 in the first and second side walls 25 and 26, to receive a pair of integral pins on the tumbler 40. In an alternate embodiment, there may be pins on the housing 20 to be received by an orifice in the tumbler 40 (not shown), or there may be a separate pin that is received by holes in both the housing walls and the tumbler. In addition, the housing 20 may also have a curved transition wall 28 between top wall 21 and first end wall 23 (FIG. 12A), Tumbler 40, as seen in detail in FIG. 7, may be comprised of a body portion 41, and a button portion 42, and may be considered to have a first end 47, where the button may be located, and a second end 48. The body portion 41 may be comprised of an elongated, generally rectangular section 43 that is interrupted by several features. The elongated body portion 41 may be so shaped to fit within the cavity 20A of housing 20, that may be formed by the generally orthogonal housing walls 21-26. The body 41 may include a pair of cylindrical pins 44 protruding outward from each side of the body. The periphery of body 41 may also include a curved portion 46, which may be used to help deflect the tumbler, when it is not in the safe ( first) position, as will be discussed hereinafter in the description of the installation of the safety stop assembly 10. The body 41 may also include a bearing surface area 45, which may be used when the safety stop assembly is in the safe position, to inhibit travel of the sliding sash by having the top rail 103A of the sash member 103 contact the bearing area 45.

The periphery of the body 41 may also be interrupted by a first notch 50, and also by a secondary notch 51, which may not out completely across the entire width of the tumbler body from one side to the other. Both notches may nonetheless leave behind several protruding features. These protruding features include a cantilevered post 52, an L-shaped protrusion 53, and a straight protrusion 54, all of which may be used to secure the second end 65 of biasing member 60 to the tumbler 40.

Figure 25:
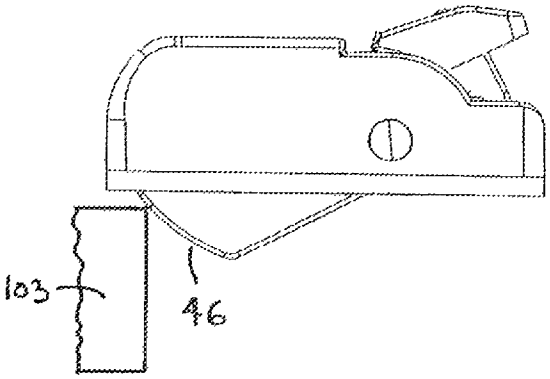
FIG. 25 is a side view of the adjustable after-market window stop of the current invention, shown with the tumbler in the second position, and with a sash contacting the curved tumbler surface ready to deflect the tumbler out of its path.
Figure 26:
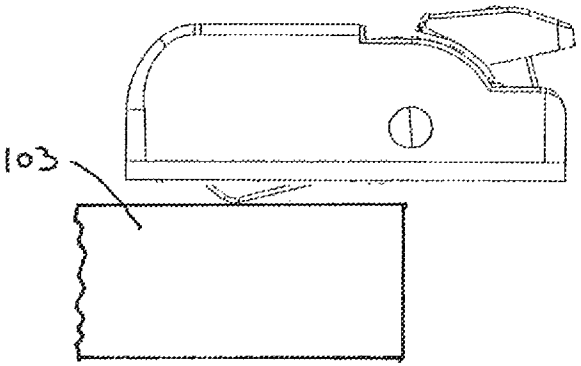
FIG. 26 is a side view of the adjustable after-market window stop of the current invention, shown with the tumbler in the intermediate position.
Figure 24:
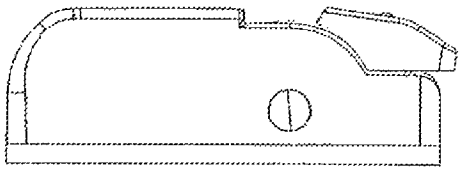
FIG. 24 is a side view of the adjustable after-market window stop of the current invention, shown with the tumbler in the retracted position.
Figure 23:
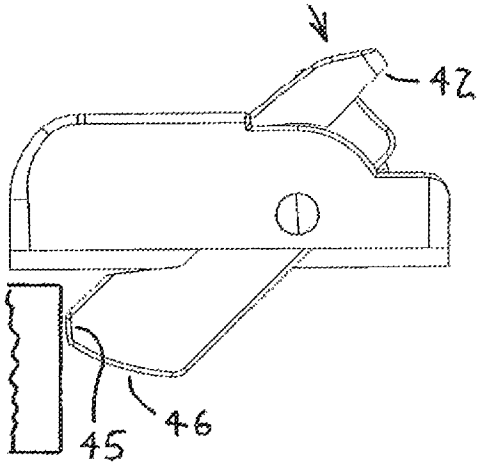
FIG. 23 is a side view of the adjustable after-market window stop of the current invention, shown with the tumbler in the first (fully extended, blocking) position.
Figure 29:
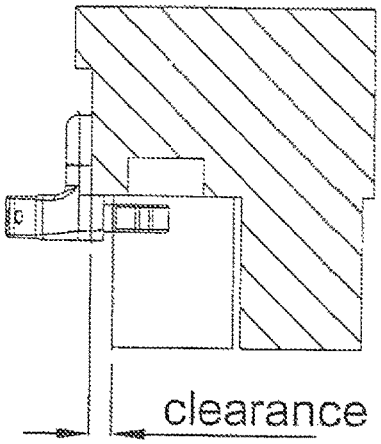
FIG. 29 is the section cut of FIG. 2, showing the same after-market stop, but with only one spacer being used for a window with a sash member having a larger offset from the master frame than the window of FIG. 28.
Figure 27:
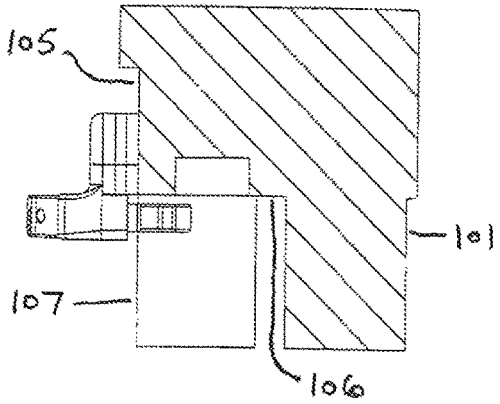
FIG. 27 is the section cut of FIG. 2, enlarged and showing need for an after-market stop with three spacer blocks for a window with a sash member co-planer with the master frame.

The integral button portion 42 may be of any shape and size that may conveniently receive pressure from a user's finger to toggle the tumbler from a safe (first) position to a non-safe (second) position, and for toggling the tumbler from the second position back to the first position. The tumbler positions achieved by the current invention are shown in succession in FIGS. 23-26. The safe (first) position is shown in FIG. 23. Thereafter, application of a generally downward force to the button portion 42, results in the tumbler being completely or nearly completely disposed within the cavity 20A of housing 20, in the retracted position as seen in FIG. 24. The tumbler will temporarily occupy the retracted position, until the force is removed from the button portion 42, after which the biasing member 60 will bias the tumbler to be in the non-safe (or second) position, as seen in FIG. 25. When in the non-safe position, the sliding sash member 103 of the door or window may strike the curved surface 46 of the tumbler, and thereby deflect it out of the way, with the tumbler then occupying an intermediate retracted position, as seen in FIG. 26. The intermediate retracted position could be any position between the full retracted position of FIG. 24 and the non-safe position of FIG. 25. However, in general, the intermediate retracted position may be a position in which the second end of the tumbler is only protruding out from the housing 20 a slight amount, which may be roughly equal to the clearance between the sliding member and the housing bottom wall 22

(see FIG. 26). In a preferred embodiment the integral button portion 42 may have a curved surface. 49 (FIG. 7) that mirrors the curved surface 30 of the housing 20 (see FIG. 12A), as the button portion may be proximate thereto throughout the various positions of the tumbler (FIGS. 23-26).

The biasing member 60 may comprise many different embodiments, and may alternatively be a compression spring, a tension spring, a leaf spring, or a torsion spring, etc. In a preferred embodiment, the biasing member 60 may comprise the torsion spring illustrated in the perspective view of FIG. 8. The biasing member 60 may be a helical torsion spring having a first arm 61 and a second arm 62, being connected by one or more helical turns 63 that may create a torsional restoring force, when the arms 61 and 62 are moved apart from a rest position into a deflected position. In general, the helical turns (or coil) may be subjected to twisting about the axis of the coil by sideways forces (bending moments) applied to its ends the arms, twisting the coil tighter. The biasing member, when constructed as a helical torsion spring, may be formed of metal rod or wire.

The second arm 62 may transition to a pair of bends that terminate in a second end 65. With the turns 63 being mounted upon the post 52 of tumbler 40 (FIG. 20), the second arm 62 and second end 65 may be fixed within the protruding features of tumbler 40. The second arm 62 may be constrained between the flat side of the L-shaped protrusion 53 and both the straight protrusion 54 and lower portion 52A of the post 52. The lower portion 52A may extend upward from notch 51, and may be wherefrom the post 52 is cantilevered. The second leg 65 may be deflected outward to then be released so as to be trapped within the "L" portion of the L-shaped protrusion 53.

Figure 8:
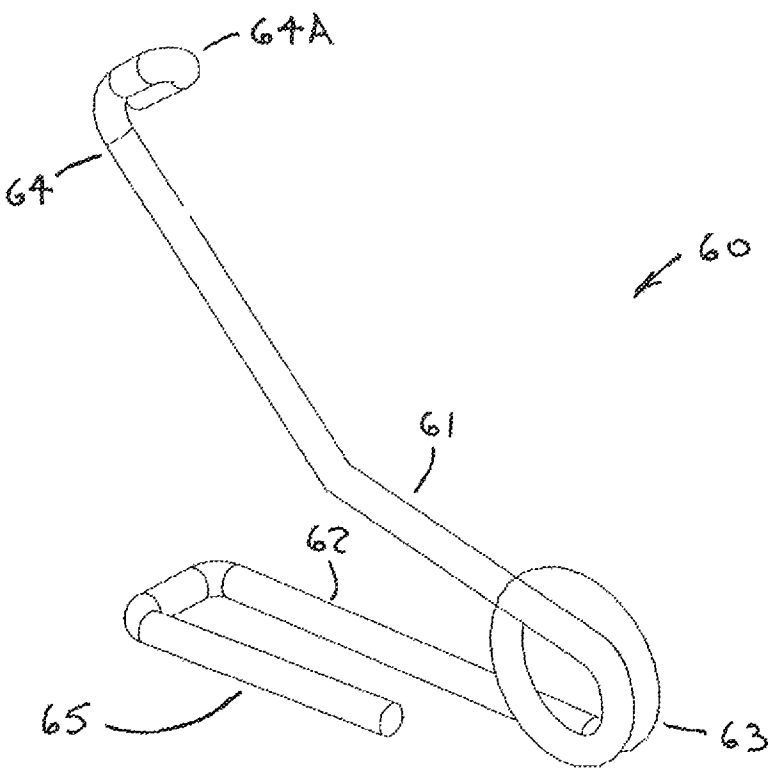
FIG. 8 is a perspective view of the biasing member of the safety stop of the current invention.

The first arm 61 may have a slight kink, as seen in FIG. 8, and then may transition into a first end 64, which may include a post 64A. The post 64A may be just the wire or rod of the torsion spring terminating to have a rounded (spherical) end, or it may alternatively have a 180 degree bend to produce a rounded edge, either of which will be referred to hereinafter as "the post." The post 64A may serve to interact with contoured features 210 on the underside of wall 21 of housing 20 (FIGS. 13-19), to maintain the tumbler in the non-safe position, once the tumbler has been installed into the cavity 20A.

Assemblage of the housing 20, tumbler 40, and biasing member 60 into the adjustable window stop assembly 10, may be seen through the exploded view of FIG. 20. The biasing member 60 may be installed onto the tumbler 40 features as previously described. By next depressing the first arm 61 relative to the tumbler, to counter the torsion force created by the coils 63, the second end 48 of the tumbler 40 may be inserted into the cavity 20A through the opening 29 of housing 20. The pins 44 on opposite sides of the tumbler body may received by the orifices 36 of the first and second side walls 25 and 26 of housing 20, to establish pivotal mounting of the tumbler within the housing, and also leaving a portion of the tumbler second end 48 to protrude out through opening 27 of bottom wall 22 of housing 20. Once the tumbler is pivotally mounted within the housing 20, the force used to depress the first arm 61 of the biasing member 60 relative to the tumbler 40 may then be released, and the post 64A of the biasing member 60 will contact the contoured features 210 of the housing 20. That contact is seen in FIGS. 14-19.

Figure 14:
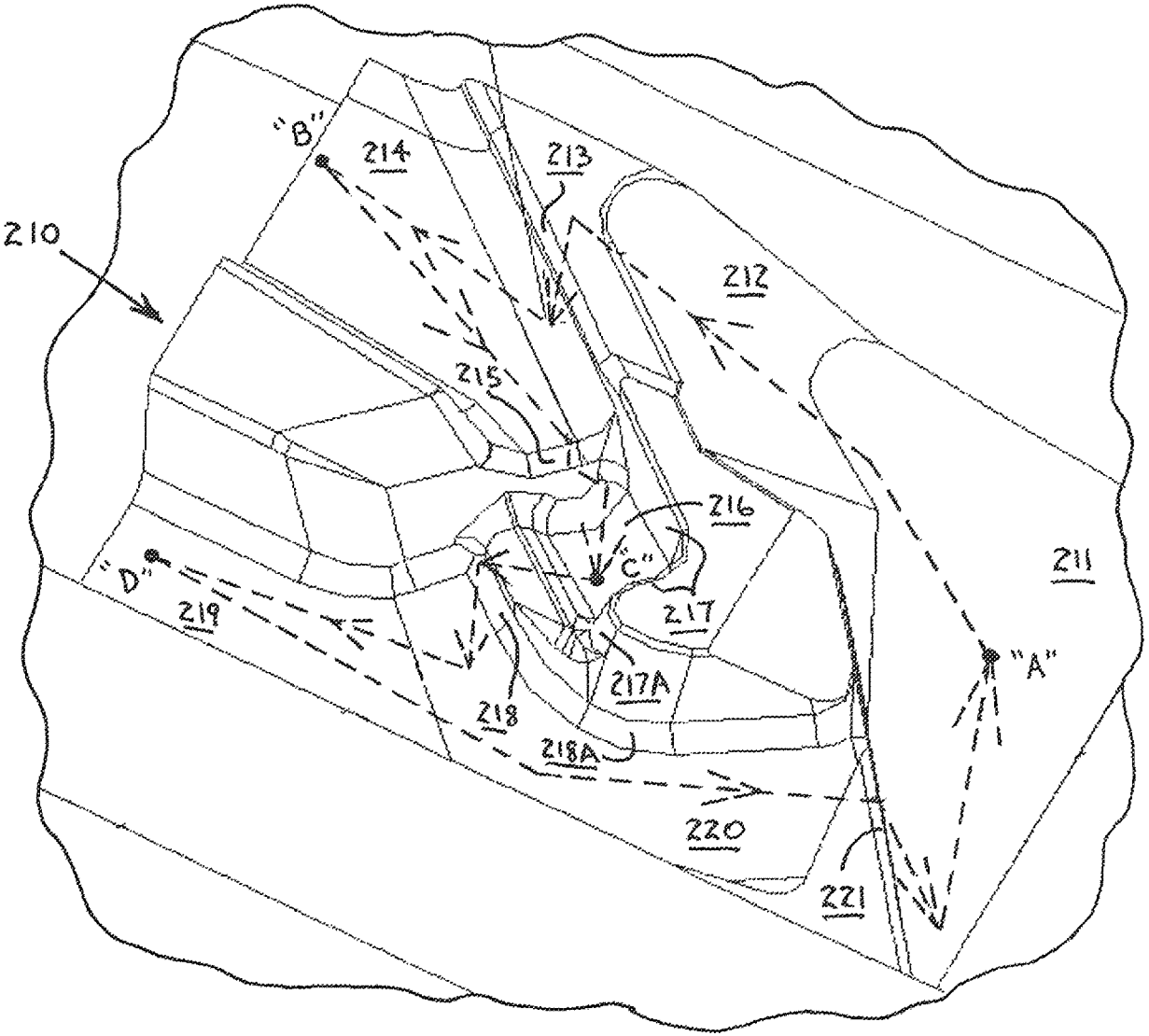
FIG. 14 an enlarged perspective view of the housing contour features of FIG. 13, with the two positions of the biasing member illustrated thereon—Safe (A) and Non-safe (B), as well as motion in between, including two temporary positions (B & D) in which, the tumbler is retracted.
Figure 15:
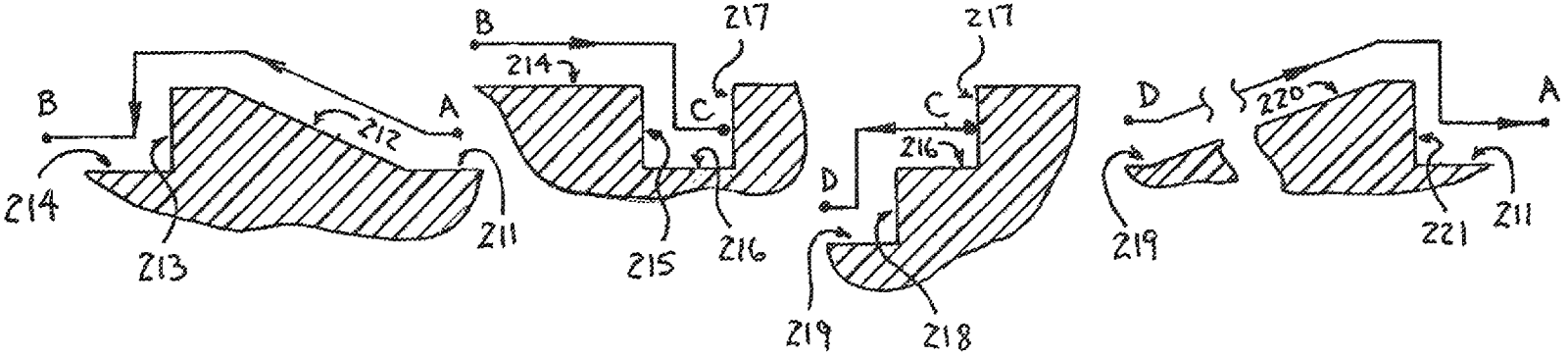
FIG. 15 is a series of schematic representations showing the positional changes (A, B, C, and D) of the post of the biasing member, relative to the housing contour of the underside of the top housing wall.
Figure 16:
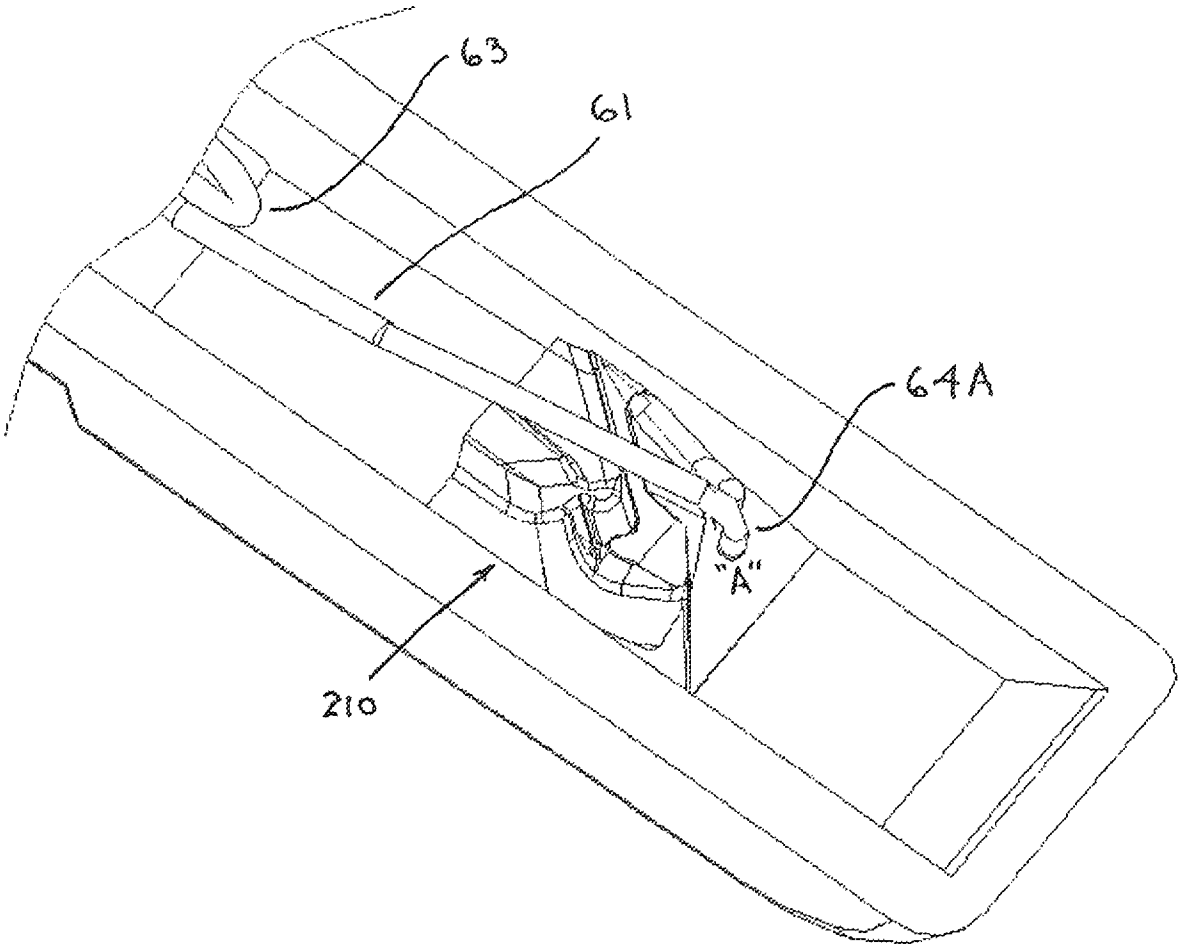
FIG. 16 is the view of FIG. 13, but enlarged to show the housing contour features, and with the post of the biasing member shown in a position ("A") relative to the contour that the post, occupies when the tumbler is in the safe position.
Figure 17:
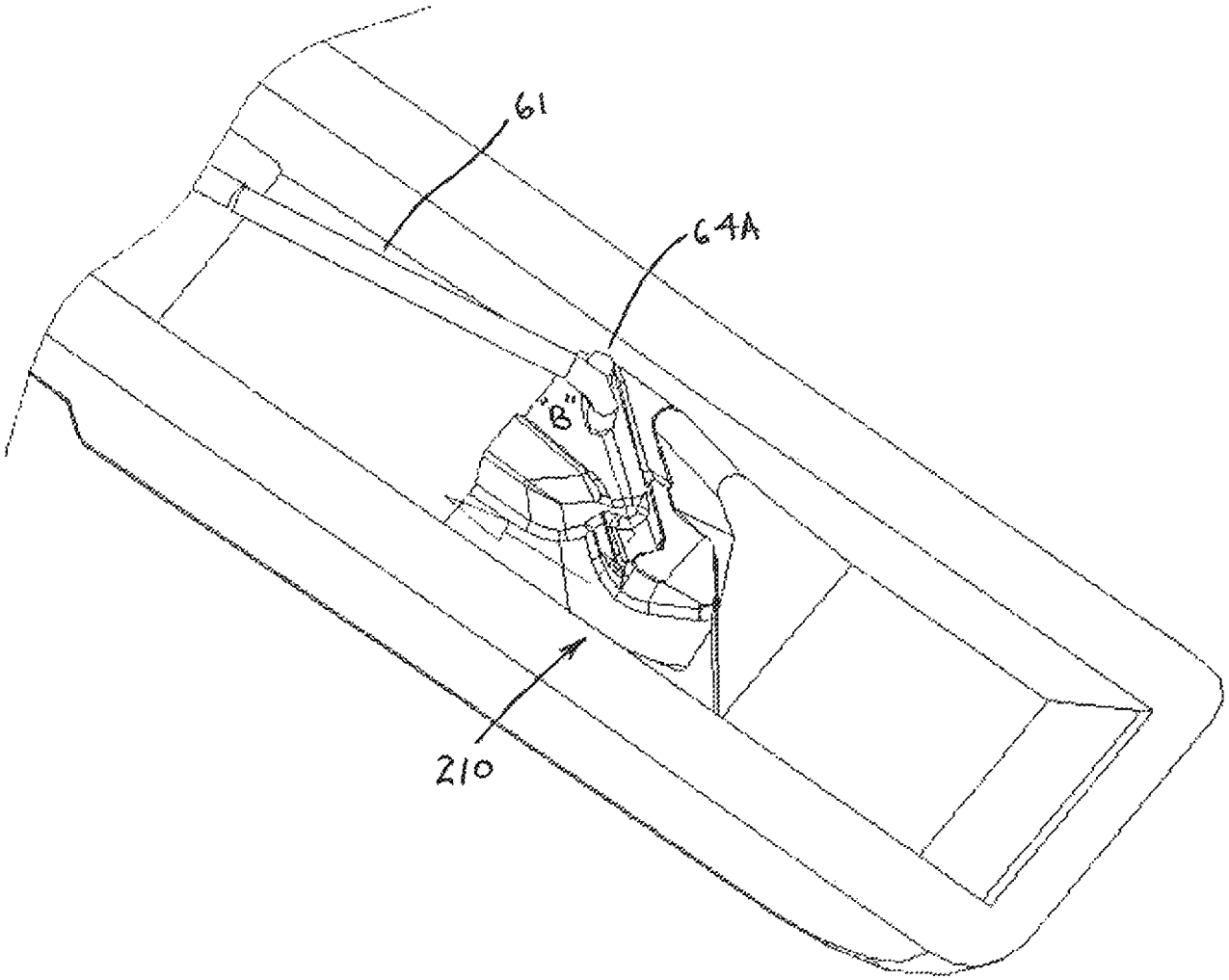
FIG. 17 is the view of FIG. 16, but with the post of the biasing member shown in a position ("B") relative to the contour that the post occupies when the tumbler is in the retracted position, as the tumbler is being toggled from the safe to the unsafe position.
Figure 18:
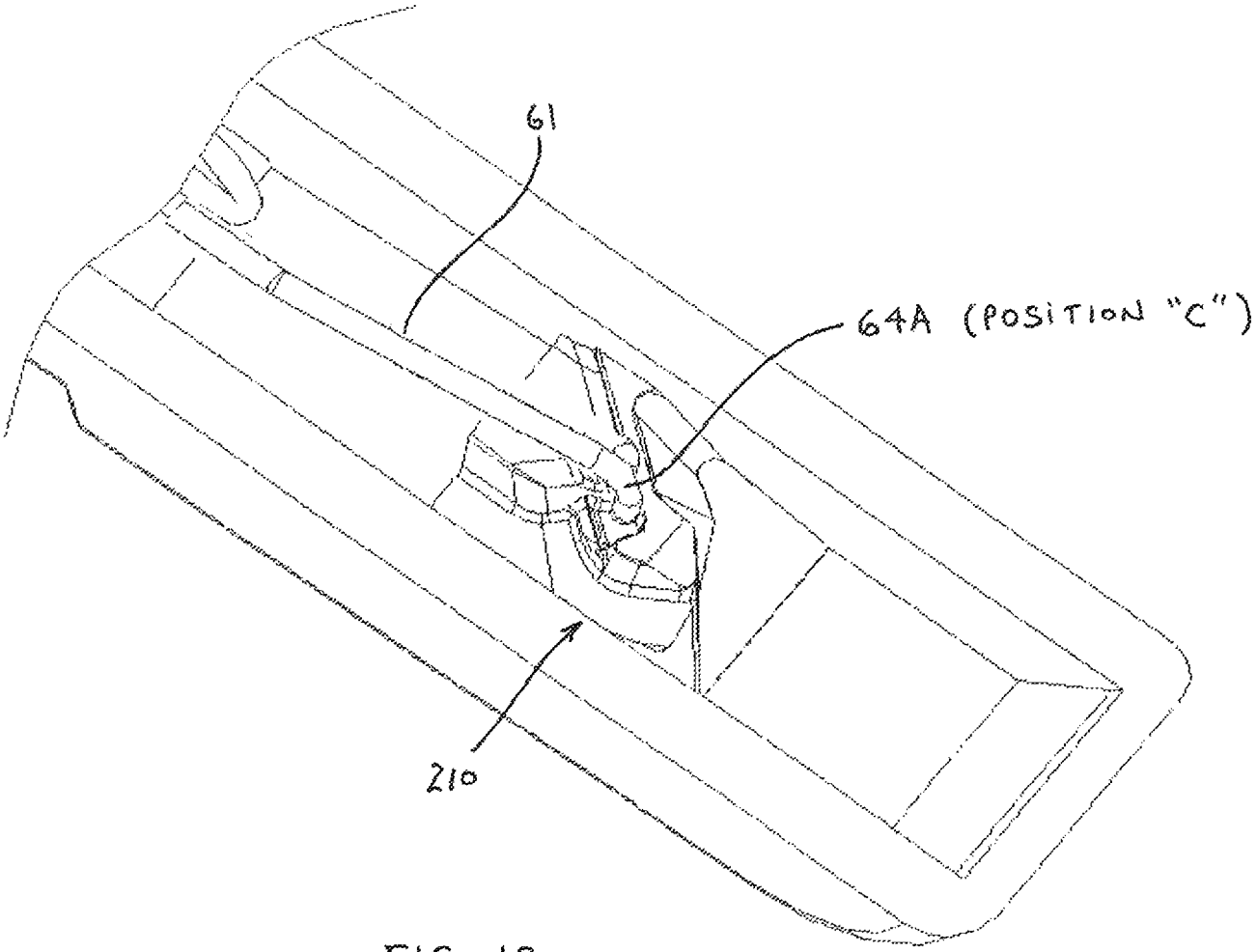
FIG. 18 is an enlarged view of FIG. 17, but with the post of the biasing member shown in a position ("C") relative to the contour that the post occupies when the tumbler is in the un-safe position.
Figure 19:
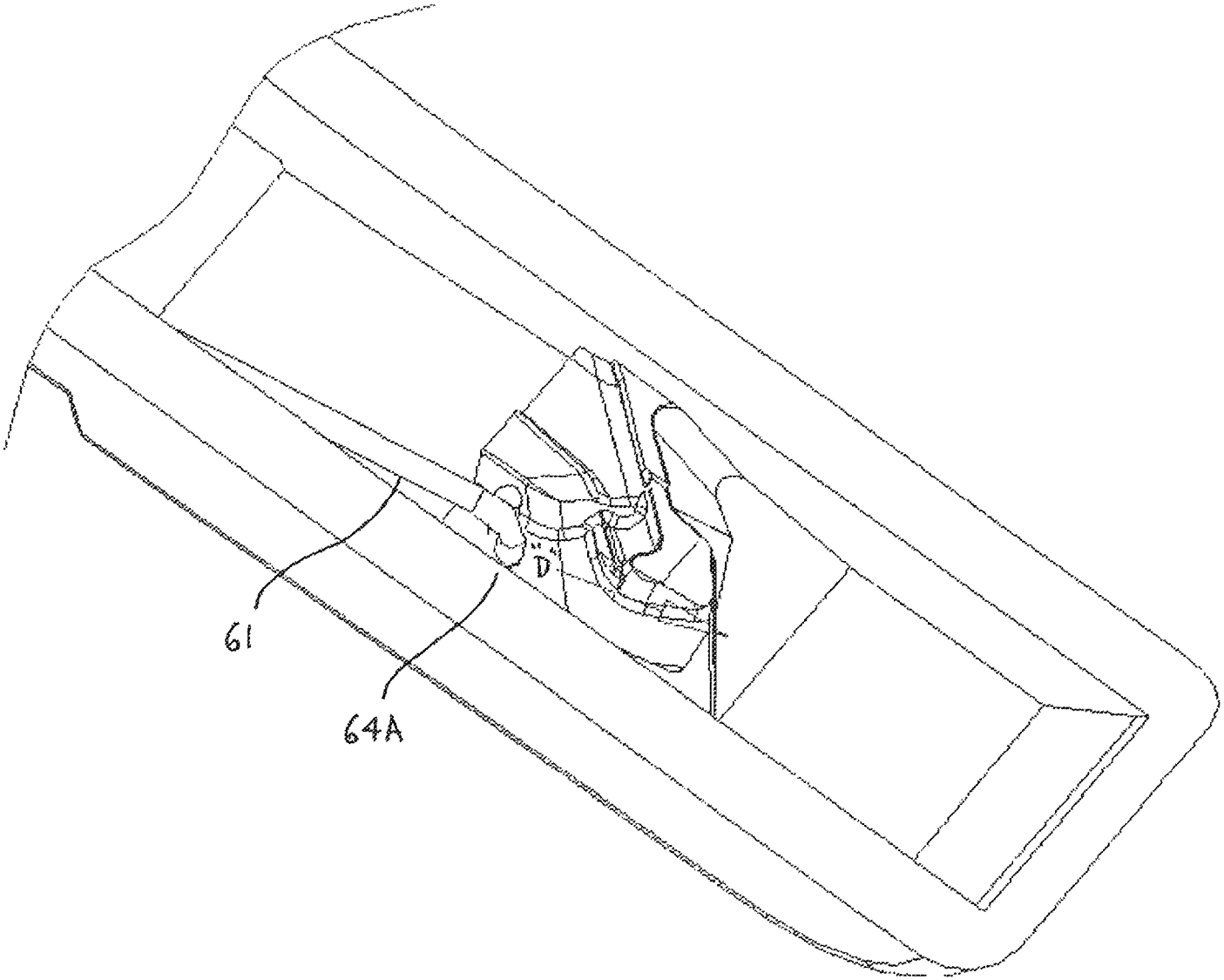
FIG. 19 is the view of FIG. 18, but with the post of the biasing member shown in a position ("D") relative to the contour that the post occupies when the tumbler is in the retracted position, as the tumbler is being toggled from the unsafe to the safe position.
Figure 21:
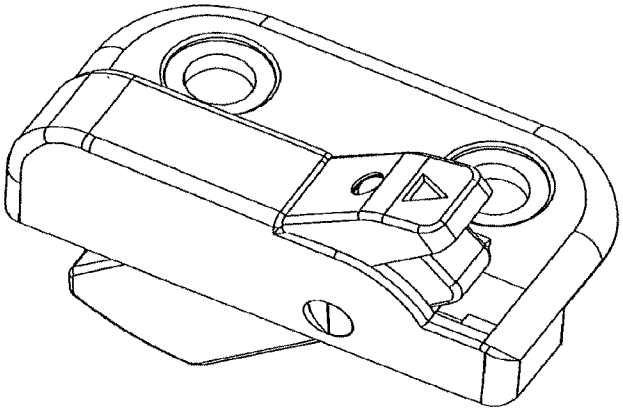
FIG. 21 is the perspective view of FIG. 3.

FIG. 14 illustrates, in detail, the contour features 210 of the underside of the wall 21 of housing 20, and shows thereon the positions that the post 64A of the biasing member 60 may occupy. There movement of the post 64A is shown upon the contour features 210 in FIG. 14, and also is shown schematically in FIG. 15 to aid the reader in understanding the operation of the tumbler. When the tumbler is in the sale position (FIG. 23), the post 64A of the tumbler occupies the position "A" of FIG. 14, and rests upon surface 211. As a user depresses the button 42 of the tumbler to move the tumbler from the safe position to the retracted position (FIG. 23 to FIG. 24), the post 64A in FIG. 14 will move from position "A" to position "B." In doing so, the post 64A may move from surface 211 to contact an inclined surface 212, and then drop along a vertical face 213, to then continue along a generally flat surface 214 until reaching position "B." Once the user releases the force from button 42 of the tumbler, the tumbler is biasing by biasing member 60 into the non-safe position (FIG. 25). Movement of the post 64A, after the user releases that force, is from position "B" to position "C." In moving from position "B" to position "C," the post 64A may move from the generally flat surface 214, to drop along a vertical face 215 and traverse along surface 216, where the post 64A may be nested against a curved vertical face 217. It should be pointed out that the use herein of the adjective "vertical" is to be loosely interpreted as it is being used to aid the reader in understanding the described contoured features 210 of the housing 20. Those faces, in fact, need not be "vertical" relative to the housing wall 21 or orthogonal thereto, and need only to protrude outward from either the flat or inclined surfaces to guide the travel of the post 64A. However, for simplicity in further describing the invention, the term vertical will still be used herein.

Biasing by the biasing member 60 will seek to deflect the tumbler 48 from the non-safe to the safe position, but is prevented from doing so by the vertical face 217 serving to restrain the movement of post 64A of the biasing member, which inhibits outward rotation of the tumbler. This rotationally restrictive relationship may be understood by looking at the positions of post 64A (A, B & D, and C) relative to the profile views of housing wall 21 in the FIGS. 23-25. Also, the post 64A is shown occupying positions A, B, C, and D, sequentially, in FIGS. 16-19.

Movement of the tumbler from the non-safe to the safe position may occur by the user again applying a force to button 42, which causes the tumbler to again move into a retracted position and with the post 64A respectively moving from position "C" to occupy position "D." In moving from position "B" to position "C," the post may move along surface 216, drop along a vertical face 218, then traverse from an inclined surface 220 to a generally flat surface 219. Once the user releases that force from button 42 of the tumbler 40, the tumbler is biased by biasing member 60 into the safe position (FIG. 23). Movement of the post 64A, after the user releases that force, is from position "D" to position "A." In moving from position "D" to position "A," the post may move along generally flat surface 219, then up the inclined surface 220 and down a vertical face 221, and then traverse along surface 211 until reaching position "A." It should be pointed out that the direction of movement of the post 64A is aided by those vertical faces, which serve to prevent erroneous movement. For example, for movement of the post 64A from position "D" to position "A." the post is prevented from inadvertently returning to "C" by the vertical face 218, which curves around at curved vertical face 218A, and thereby forces the post 64A to traverse along surface 220 and towards position "A." Movement between each of the other positions—A to B, B to C, and C to D—is similarly accomplished by vertical faces 221, 213, and 215.

The incline surfaces serve in combination with the vertical faces to facilitate construction of a continuous series of contours to permit the described motion of the post 64A.

It may now be seen by looking at FIGS. 14 and 25, that the movement from position C towards position D may be arranged so that the vertical face 217 has a rounded vertical end 2I7A and that vertical face 218 is very quickly encountered after the post 64A has moved from position "C." This would provide an arrangement where, in looking at FIG. 25, it may be seen that slight deflection by the sash 103 of the tumbler 40 will cause the post 64A to slip around the rounded vertical end 217A and down the vertical face 218. in proximity to curved vertical face 218A, to then be biased to position "A" without occupying position D. This may be advantageous in an embodiment where the safety stop will tend to always be in the safe position, because even where the user has toggled the tumbler to the un-safe position to open the window all the way, once the window strikes the tumbler, it will be released from position "C" as just described, and when the sash window has been return to the closed for near closed) position, the safety stop will then automatically biased to the tumbler to the safe position with the stop being in position "A." If vertical face 217 and vertical face 218 extend further in the direction, towards position "D," the ability to have the window automatically trip the tumbler to bias back to the safe position may be prevented, and would thus require the user to manually choose to do so. This arrangement may also be a desirable feature for an alternative safety stop.

Similarly, it may be seen that complete movement of the post 64A into position "B," wherein the tumbler is fully retracted within the housing, is not necessary, as the post need only move beyond the vertical face 213 to ensure that it will maneuver into position "C," once the force is removed front button 42. However, vertical face 213 may be moved so as to be proximate to position "B," which would necessitate that a fully retracted or near-fully retracted tumbler position would be reached before ensuring that the post would be forced to engage with vertical face 217 at position "C."

Figure 11:
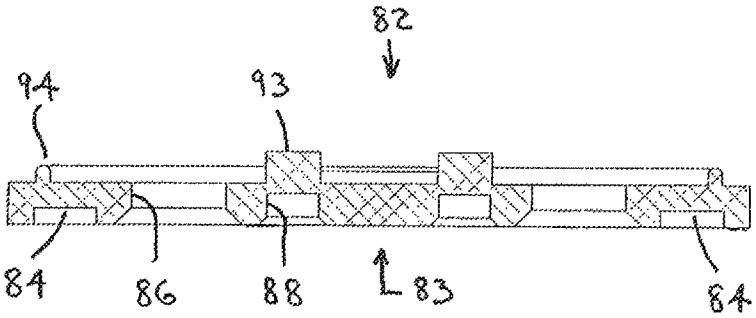
FIG. 11 is a section cut through the spacer block of FIG. 9.
Figure 9:
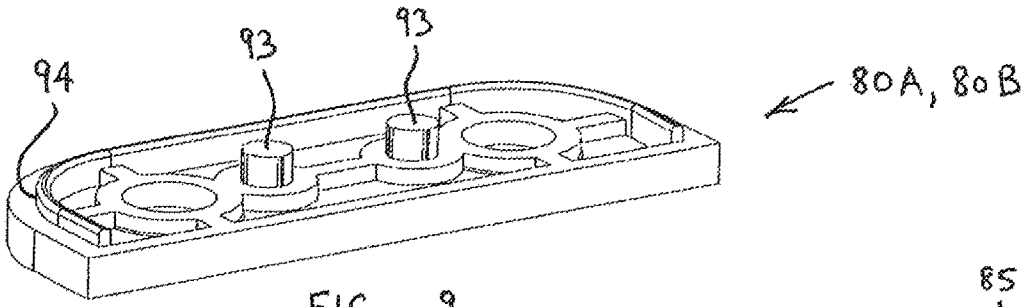
FIG. 9 is a top perspective view of one embodiment of a spacer block.
Figure 10:
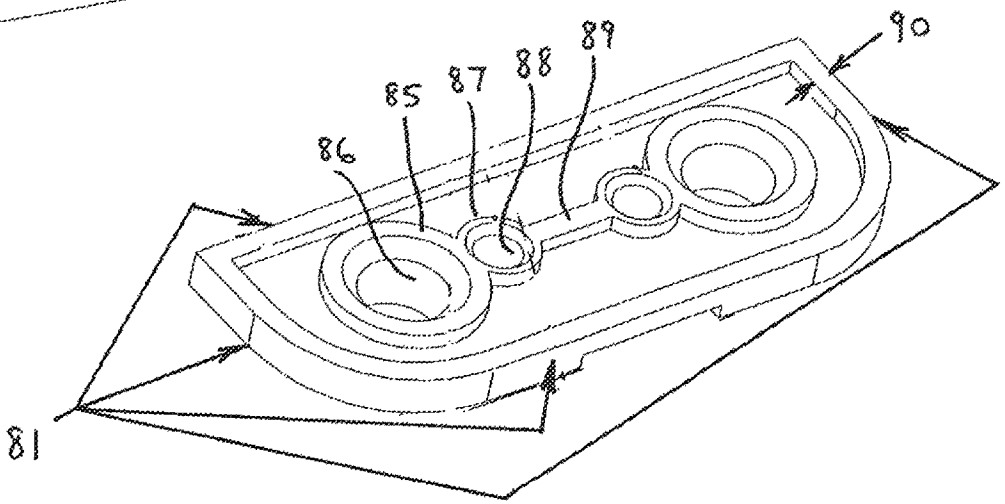
FIG. 10 is a bottom perspective view of the spacer block of FIG. 9.

One embodiment of the spacer blocks, 80A, 80B, etc, is shown in FIGS. 9-11. The spacer blocks 80A and 80B may be identical, except for possible differences in thickness of the spacers. For the sake of commonality, only one thickness of spacer might be used, and being a very small thickness, wherein multiple spacers could be used as needed, however, the varying thickness spacers may be more practical. The spacers will be discussed generically in terms of spacer 80A, but the discussion may apply to other spacers, 80B, 80C, etc. as well, except for the aforementioned thickness differences.

The spacer 80A may have a periphery 81 that matches the periphery of the mounting flange 31 of housing 20. Spacer 80A may also have a top 82 and a bottom 83. The bottom 83, as seen in FIGS. 10 and 11, may have a sculpted cavity 84, leaving behind a ridge of thickness 90, and a boss 85 surrounding a pair of orifices 86 that match the mounting orifices in the mounting flange 31 of the housing 20 (for receiving safety stop mounting fasteners), and a boss 87 around a second pair of smaller orifices 88. The smaller orifices 88 in the spacer, like the orifices 35 in the mounting flange 31 of housing 20, may be full depth, or may be depth limited as seen in FIG. 11. The boss 87 about each orifice 88 may be connected by a stiffener 89.

The smaller orifices 88 of the bottom 83 may be for receiving the posts 93 protruding up from the top surface, which would occur where multiple spacers (80A and 80B . . . ) are used. The posts 93 would be received, for the first spacer utilized with the stop assembly 10, by the orifices 35 in the bottom surface 31B of mounting flange 31. They may simply be nested therein, or they may be received therein using a friction fit or using a detent where the spacer would have to snap into place on the mounting flange for other spacers when more than one spacer is used). The top surface 82 may also have an upward protruding lip 94 that spans at least part of the periphery 81, and which may be received by the ridge of thickness 38 in the bottom surface 31B of the mounting flange 31 of the housing 20, or alternately received by the ridge of thickness 90 in the bottom of other spacers, if used.

The adjustable safety stop assembly 10 may be installed on a window while the window is being assembled by a window manufacturer, or alternatively, may be installed after the window has been assembly but prior to its installation in a building. Additionally, it is also possible to install the safety stop 10 on a sash window or door that is already in service in a building, where the assembly would be supplied as an after-market stop, for use on sash members of a window/door product that did not originally incorporate a safety lock into the design of the window or door. Furthermore, after-market safety stop herein may also be installed on a window or door already in service in a building, where the window/door already bad a safety stop integrally assembled into the window/door, but where the person using the window prefers to have the window stop at alternative or additional sash, travel-limited safety locations. Generally, such pre-installed stops provide generous travel for the sash, but not being travel that is great enough to allow entry through the window by a burglar or other intruder. A home owner may prefer to add safety stops to that window to limit the travel to only about one or two inches, possibly to prevent a small pet from escaping, and might feel that the window only being opened that small amount would provide sufficient ventilation into the room. Also, the home owner may wish to add another safety stop to permit the window to open a little further for increased ventilation, but still not be opened enough to allow a small child to accidentally egress out of the open window. There may be many reasons for adding one or more additional safety stops to a newer window that already has an integral stop.

Figure 22:
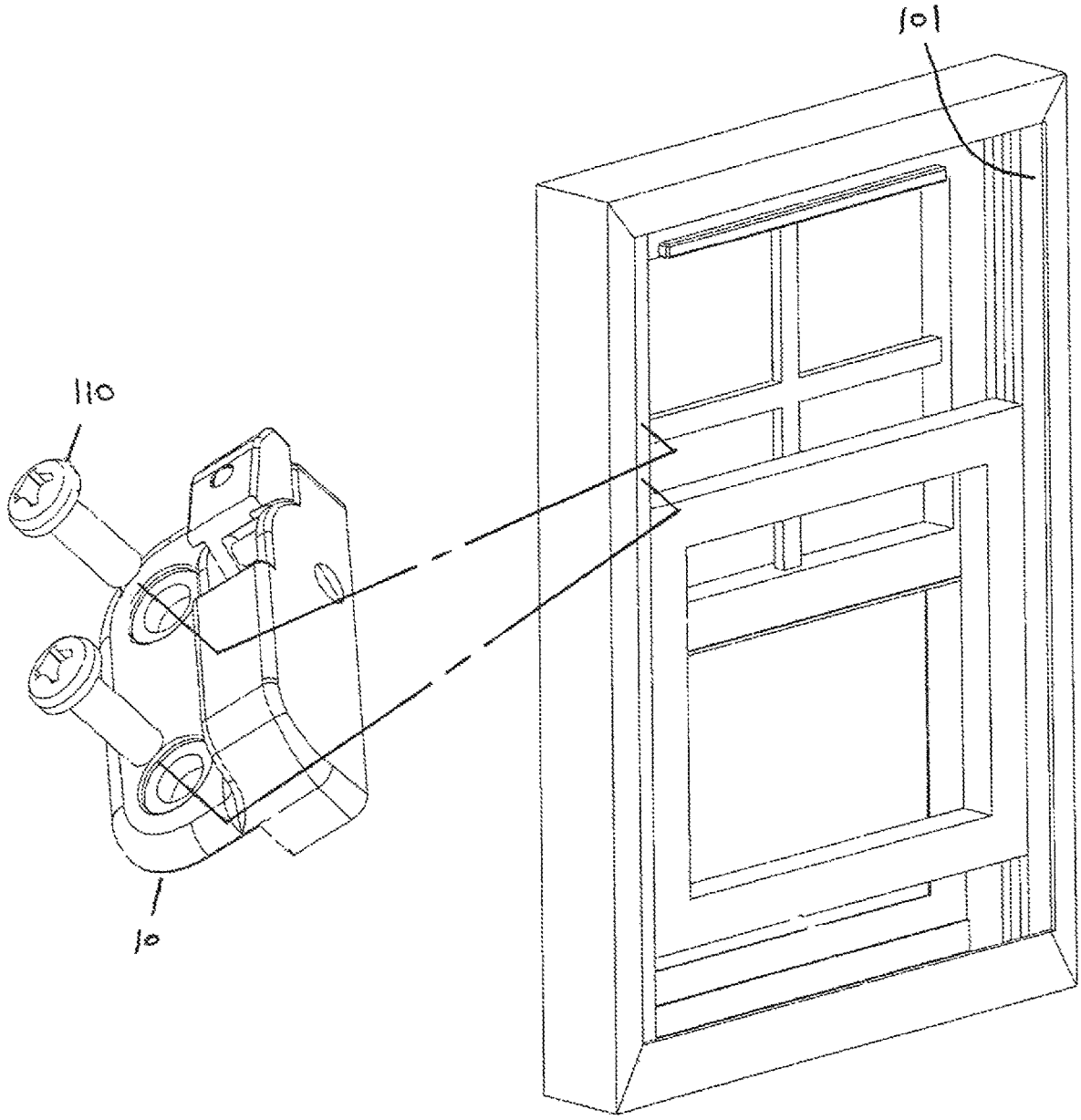
FIG. 22 is a perspective view of the safety stop assembly of the current invention and two screws, prior to installation, and being shown in relation to a perspective view of a sliding sash window and master frame to which the stop is to be secured.

FIG. 22 shows a pair of screws 110 that may be used to mount the alter market safety stop 10 to the master frame 101 of single hung or double hung sash window or door. FIGS. 27-30 illustrate the use of multiple spacers or no spacers, in cross-sectional views of different window configurations which have various differences in height between the sash 103 and master frame 101.

As seen throughout these views, installation of the safety stop assembly 10 may be with the bottom surface 318 of the mounting flange 31 contacting the inward facing side 105 of the master frame 101, with the tumbler second end 48 being adjacent to a side surface 106 of the master frame 101 (FIG. 27), and with the tumbler bearing surface at the second end being proximate to the top rail of the lower sliding sash member (FIG. 23). The top rail of the lower member may best be referred to herein for safety locking, as an inner rail 103A of the sliding sash member.

Figure 30:
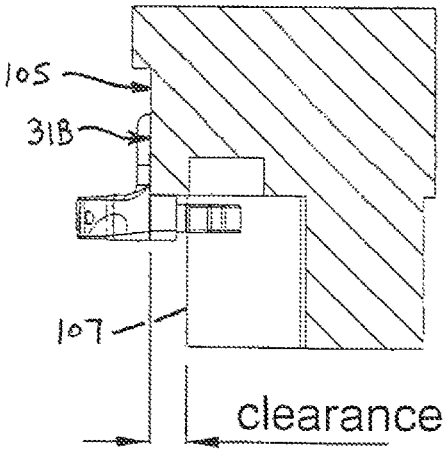
FIG. 30 is the section cut of FIG. 2, showing the same after-market stop, but with no spacers being needed for a window with a sash member having a larger offset from the master frame than the window of FIG. 29.
Figure 28:
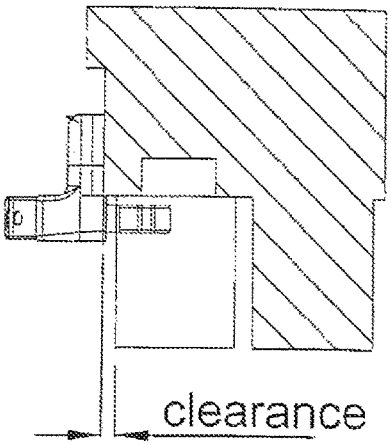
FIG. 28 is the section cut of FIG. 2, showing the same after-market stop, but with two spacers being used for a window with a sash member being slightly offset from the master frame.
Figure 31:
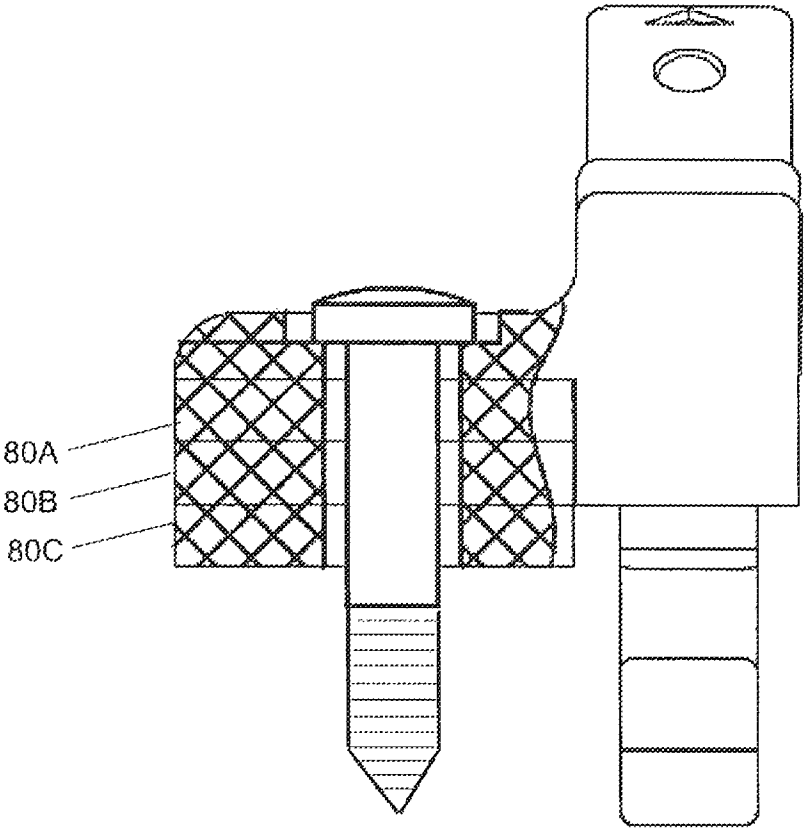
FIG. 31 is an enlarged section view of the stop and spacers, with a fastener through the mounting flange of the stop.

The offset amount in locating the mounting flange 31 on the side wall 25 of housing 20 relative to the bottom wall 22 may determine the thickness of the spacers used, along with the depth difference between the inward facing surface 165 of the master frame and the inward facing surface 107 of the sash 103, tor a given safety stop assembly 10. As may be seen from FIGS. 27-30, a formula for the thickness of the total stack of spacer blocks may be approximately equal to that mounting flange offset minus the measured depth (or height) difference between the window and master frame, plus a small amount for clearance. As seen in FIG. 30, where the depth difference between the inward facing side of the master frame 105 and inward feeing side 107 of the sash member 103 is equal to or slightly greater than the offset amount of the mounting flange, no spacer is required. As the depth difference is reduced in going from FIG. 27 through FIG. 30, the total thickness of the spacers 80A, 80B, . . . , that are used must increase. The maximum thickness would be required (FIG. 27) when the inward facing side of the master frame 105 and inward facing side 107 of the sash member 103 are flush (zero depth difference), and which would require a spacer total thickness approximately equal to the offset of the mounting flange from the bottom wall 22 of housing 20, plus a small added amount to provide clearance between the bottom wall 22 with the sash member 103, to thereby prevent its obstruction.

In a first alternate embodiment of the adjustable after market safety stop 10, the stop may be modified to produce a double-action safety stop 11, as seen in FIG. 34A-38D. The double-action safety stop 11 may be the same as safety stop 10, but instead of tumbler 40, safety stop 11 may include a tumbler 160S. (FIGS. 34B and 36A-C), and may additionally include a sliding safety member 170 (FIG. 37A-37C) and a safety member biasing spring 181 (FIG. 38A-38D), which may be a compression spring. The safety member 170 may be biased, to be capable of movement relative to said tumbler to engage the tumbler and the housing, to inhibit pivoting of said tumbler while the tumbler is in the first position, until safety member 170 has been disengaged from the housing. The safety member 170 may thereby block the pivotal path of the tumbler 160S.

Figure 36A:
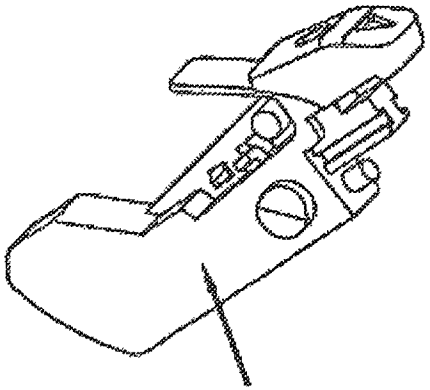
FIG. 36A is a perspective view of the modified tumbler used in the double-action stop of FIG. 34A.
Figure 36C:
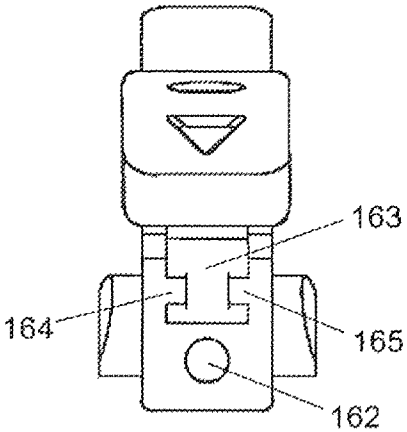
FIG. 36C is front view of the modified tumbler of FIG. 36A.
Figure 36B:
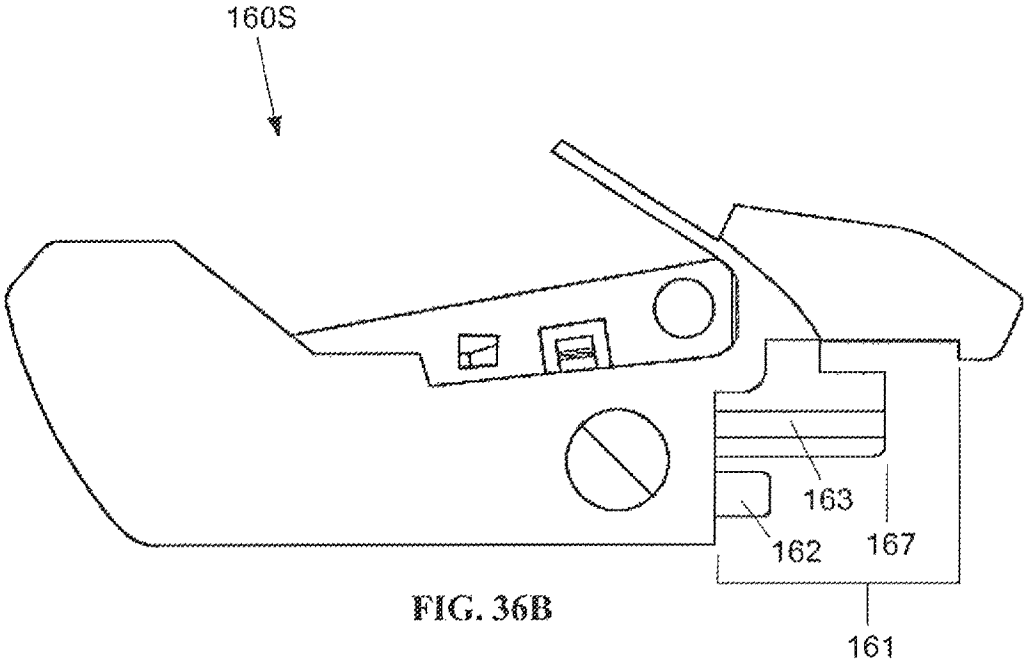
FIG. 36B is side view of the modified tumbler of FIG. 36A.
Figure 37A:
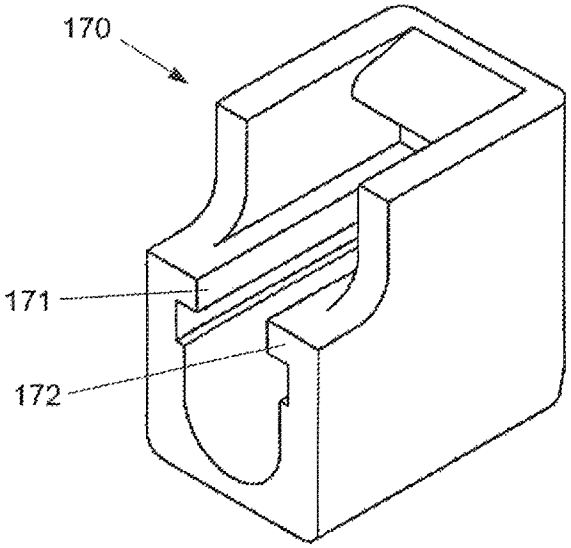
FIG. 37A is a perspective view of the safety button of the double action stop of FIG. 34A.
Figure 37C:
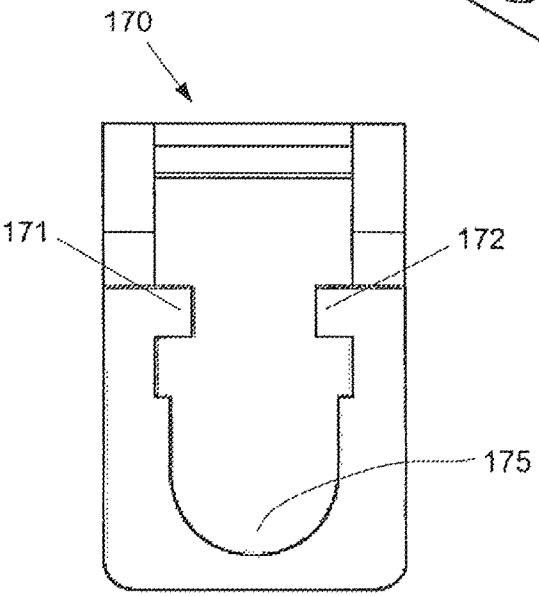
FIG. 37C is a front view of the safety button of FIG. 37A.
Figure 37B:
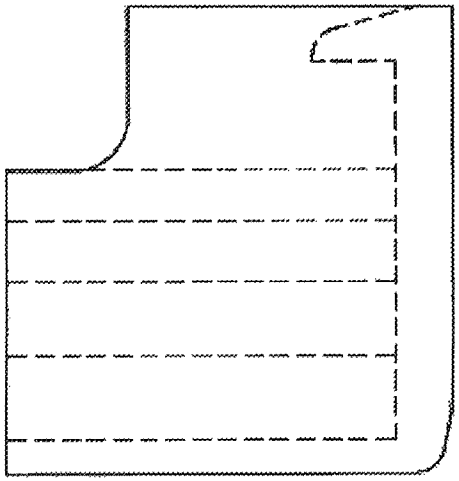
FIG. 37B is a side view of the safety button of FIG. 37A.

As seen in FIGS. 36A-36C, the tumbler 160S, as compared with tumbler 40, may have an open area 161, from which protrudes a cylindrical post 162, and an "I"-shaped beam 163. The cylindrical post 162 may be used to receive one end of safety member biasing spring 181. The other end of the safety member biasing spring 181 may be received in a recess 175 in the sliding safety member 170 (FIG. 37A-37C), which may be cylindrical for at least a portion of the recess therein to serve to retain the spring.

Figure 38A:
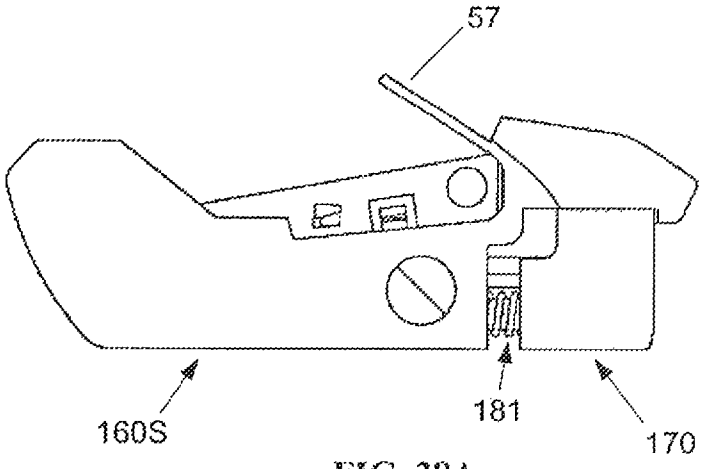
FIG. 38A is a side view of the modified tumbler of the double-action stop, shown with the safety button being assembled thereon along with the biasing spring.
Figure 38B:
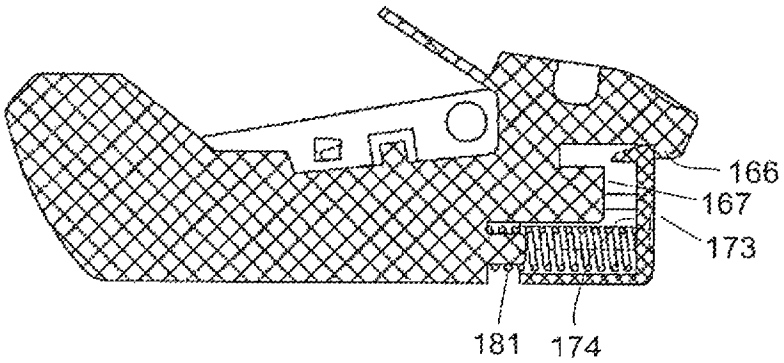
FIG. 38B is a section view through the modified tumbler of FIG. 38A.
Figure 38C:
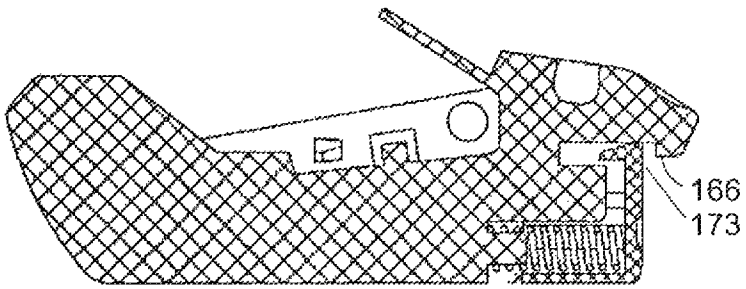
FIG. 38C is the section view through the modified tumbler of FIG. 38A, but with the safety button being moved against the biasing away from the blocking position.
Figure 38D:
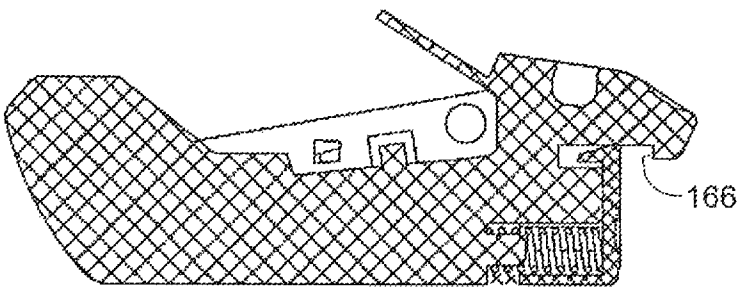
FIG. 38D is the section cut of FIG. 38C, but with the safety button having reached the full unblocked position.
Figure 39:
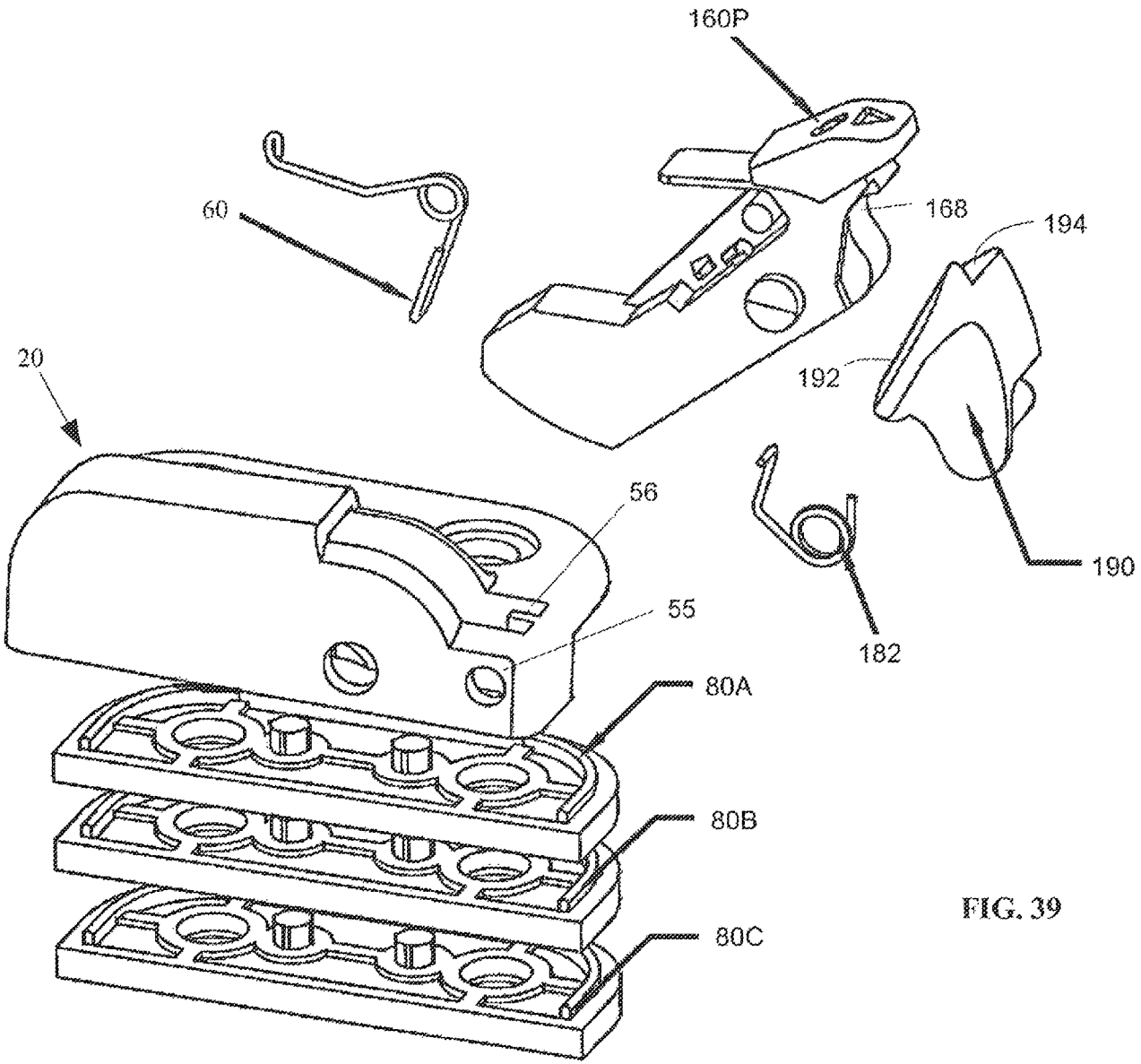
FIG. 39 is an exploded view of the parts comprising a second embodiment of a double action sash window stop, having a pivotable, spring-biased safety button.

The I-shaped beam 163 of tumbler 160S may serve to have the two interior grooved portions of the "I" acting as a track to slidably receive the safety member 170. The sliding safety member 170 may comprise first and second flanges 171 and 172, which may be received by the first track 164 and second track 165 of the I-shaped post 163, to be slidable thereon. As seen assembled in FIGS. 38A-38D, the sliding safety member 170 may be biased by the safety member biasing spring 181. The safety member 170 may be so biased until an outside surface 173 of an end wall of the safety member contacts a lip 166 of the tumbler 160S (FIG. 38B). Application of a force to the sliding safety member 170 may overcome the biasing of spring 181 to move the safety member relative to the tumbler 160S (FIG. 38C), until an inside surface 174 of the end wall contacts an end 167 of the I-shaped beam 163 of the tumbler 160S.

Figure 35A:
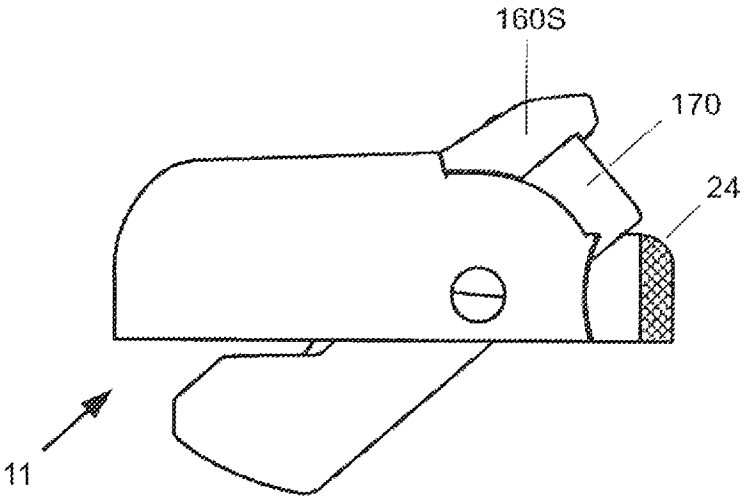
FIG. 35 A is a side view of the double-action stop of FIG. 34A, with a modified tumbler shown in the safe position.
FIG. 35B is the double-action stop of FIG. 35A, but with the spring-biased safety engaging the housing to prevent movement of the tumbler from the safe to the unsafe position.
FIG. 35C is the double-action stop of FIG. 35B, but with the slidable spring-biased safety being moved into the un-blocked position.
FIG. 35D is the double-action stop of FIG. 35C, with the tumbler being moved into the unsafe position.
FIG. 35E is the double-action stop of FIG. 35D, but with the tumbler being bottom out against the housing.
FIG. 35F is the double-action stop of FIG. 35E, but with the tumbler being released to be biased into the unsafe position.
FIG. 35G is the double-action stop of FIG. 35F, but with the tumbler having been actuated to return to the safe position.
FIG. 35H is the double-action stop of FIG. 35G, showing the slidable spring biased safety engaging the housing to prevent the tumbler from being actuated in a single action.
Figure 35B:
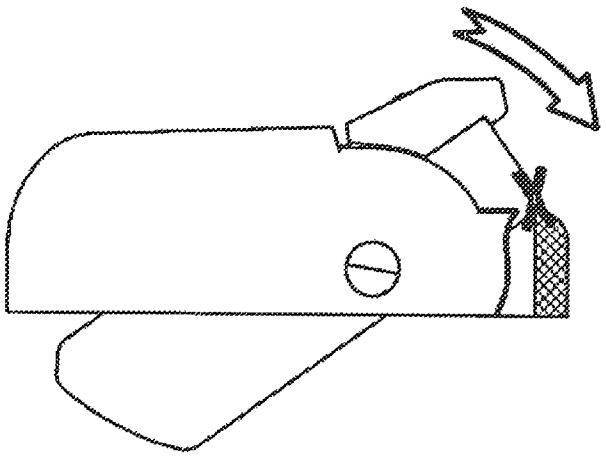
Figure 35C:
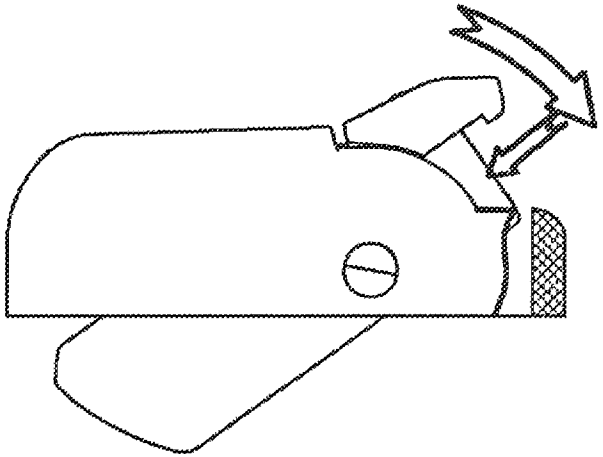
Figure 35D:
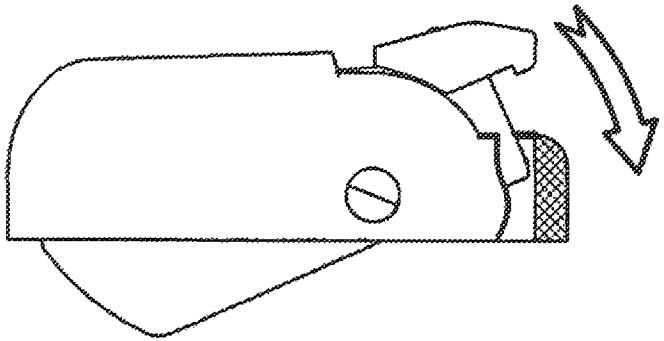
Figure 35F:
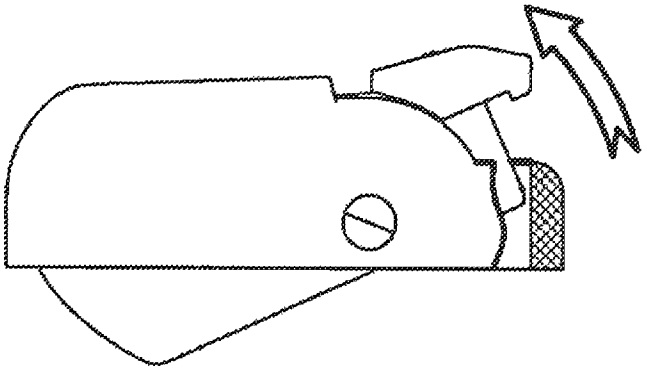

The functionality of the safety member 170 to create the double action stop 11 may be seen through FIGS. 35A-35H. The sliding safety member 170 may be biased by the safety member biasing spring 181 to occupy a blocking position, as seen in FIG. 35A, in which the safety member 170 may engage the housing wall 24. The blocking position may serve to prevent movement of the tumbler 160S from the "safe" position to the "unsafe" position, so the sliding safety member 170 serves as a secondary safety and inhibits pivotal movement of tumbler 160S unless the safety member 170 is first deliberately translated against the biasing of helical spring 181, by the user, from the blocking position (FIG. 35B) to the non-blocking position (FIG. 35C). Once the safety member 170 is moved to the non-blocking position, the user may toggle the first end of tumbler 160S to pivot the tumbler into the retracted position, and then by releasing the toggling force, the tumbler may be biased by biasing member 60 into the un-safe position of FIG. 35D, as previously described. It should be noted by looking at FIG. 35D, that the safety member 170 will be biased back towards the blocking position, but will be prevent from fully translating thereto, because of contact with the inside of housing wall 24.

Figure 35H:
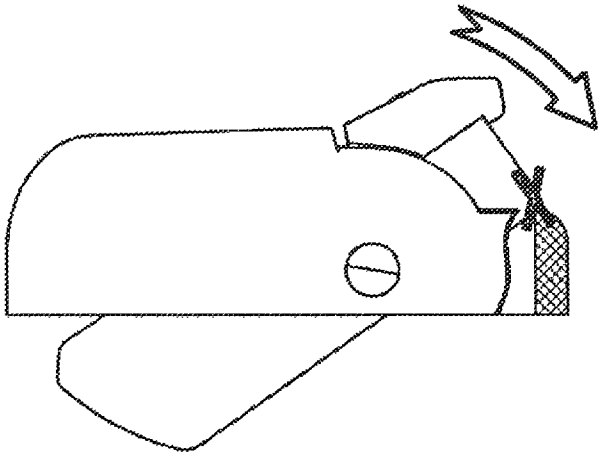
Figure 35E:
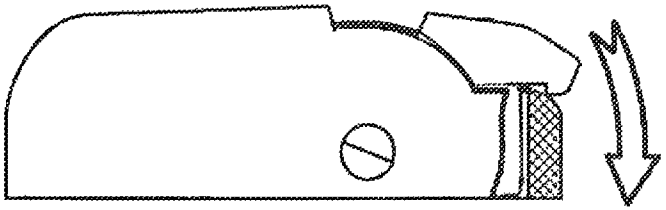
Figure 35G:
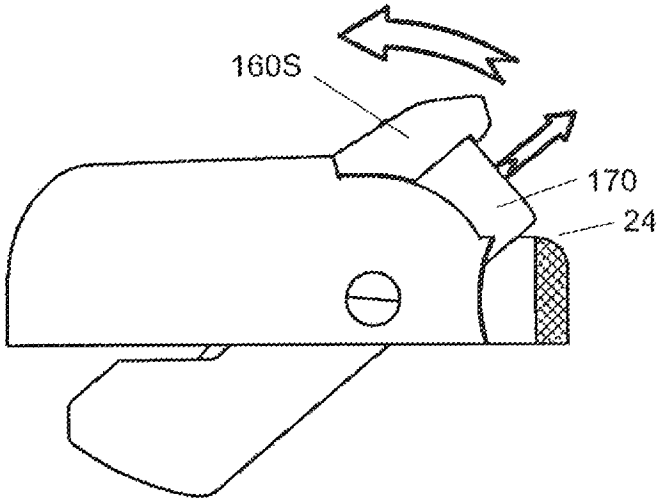

When the user again applies a force to toggle the first end of tumbler 160S, with it being in the "unsafe" position (FIG. 35D). the tumbler will first pivot to again be in the retracted position (FIG. 35E), and upon releasing of the toggling force, the tumbler will be biased to pivot out from the housing cavity by biasing member 60, until the tumbler occupies the safe position (FIG. 35G). As this pivotal movement of the tumbler 160S approaches the safe position, to be at or beyond a certain threshold rotation angle, the safety member 170 will become disengage from the housing wall 24, and the biasing spring 181 will automatically cause the safety member to slide back to the blocking position (FIG. 35H). Movement of the tumbler to the unsafe position will again first require movement of the safety member to the non-blocking position.

In a second alternate embodiment of the adjustable after market safety stop 10, the stop may be modified to produce a double-action safety stop 12, as seen in FIG. 39-42D. The double-action safety stop 12 may be the same as safety stop 10, but instead of tumbler 40, stop 12 may include a tumbler 160P, (FIGS. 39 and 41A-C), and may additionally include a pivotable safety member 190 (FIG. 39) and a safety member biasing spring 182, which may be a torsion spring.

The pivotable safety member 190 (FIG. 42A-42D) may comprise a multi-faceted block 191 that may include a generally flat surface 192, that may be ergonomically sized and positioned to be actuated by a persons finger. Extending from block 191 may be a protrusion 193, which may have a convex curved surface 194 that is shaped and positioned to be able to engage the concave curved surface 168 of tumbler 160P (FIG. 41B), as described hereinafter. Also protruding from block 191 may be a cylindrical shaft 195, having a small "key"-type protrusion 196 located thereon.

Figure 40B:
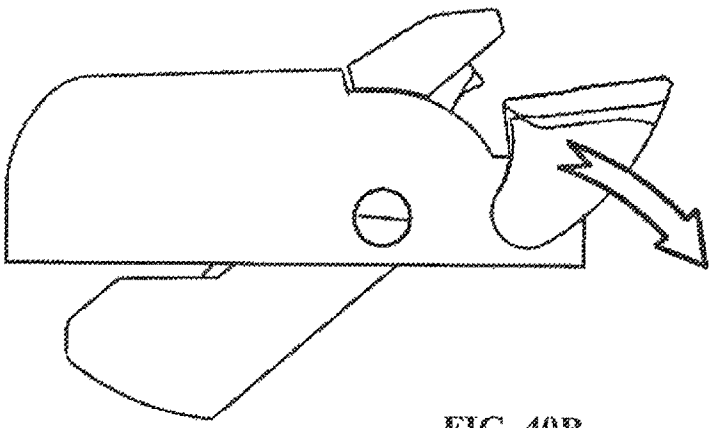
FIG. 40B is the double-action stop of FIG. 40A, but with the pivotable safety button having been pivoted out of the way of the tumbler to be in the unblocked position.
Figure 40D:
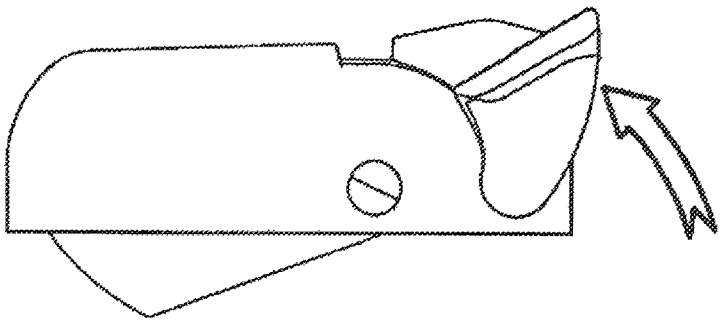
FIG. 40D shows the tumbler having been released into the unsafe position, and the pivotable safety button being released, and biased into non-engaging contact with the tumbler second end.
Figure 40A:
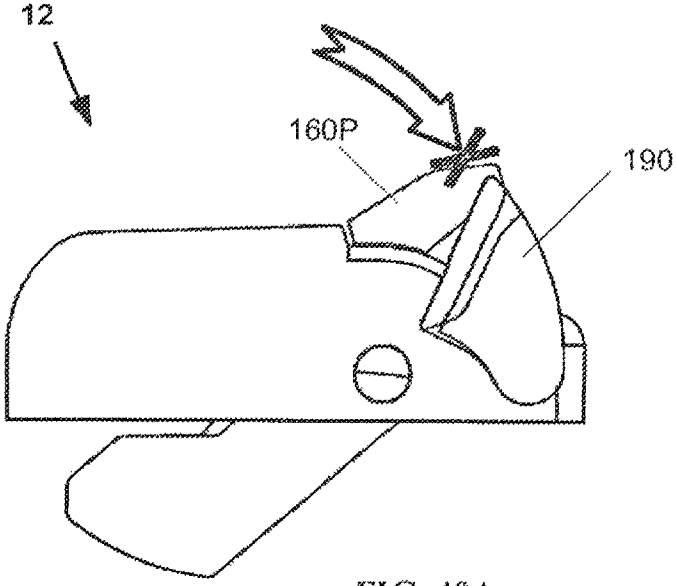
FIG. 40A is a side view of the double-action stop of FIG. 39, with a modified tumbler shown in the safe position, and with the housing mounted, pivotable safety button engaging the tumbler to prevent movement of the tumbler from the safe to the unsafe position.
Figure 40C:
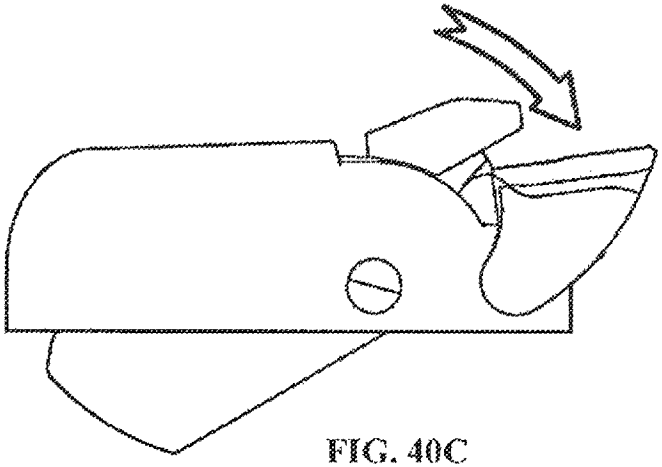
FIG. 40C shows the tumbler being pivoted from the safe position, by application of a force to the tumbler's first end, while the pivotable safety button is maintained in the unblocked condition.
Figure 40F:
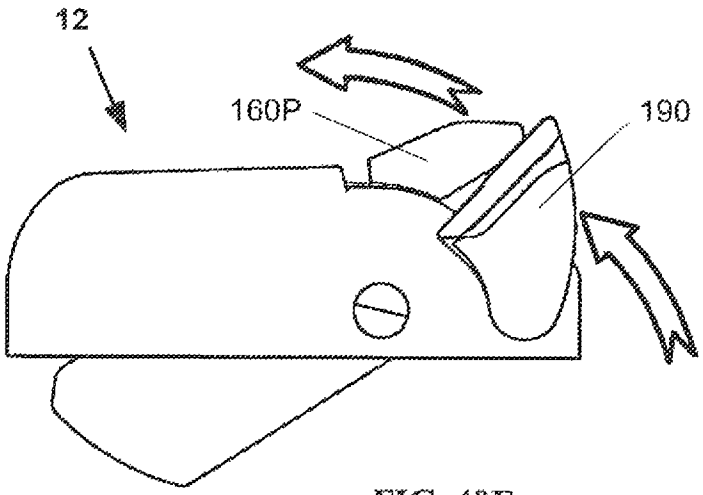
FIG. 40F shows that removal of the applied force from the tumbler first end permits biasing of the tumbler back into the safe position, and biasing of the pivotable safety button back towards the blocked position.
Figure 40H:
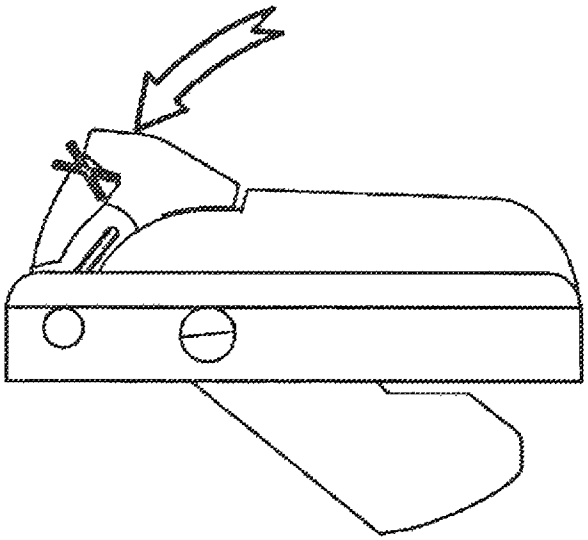
FIG. 40H is a second side view showing the pivotable safety cover blocking movement of the tumbler.
Figure 40E:
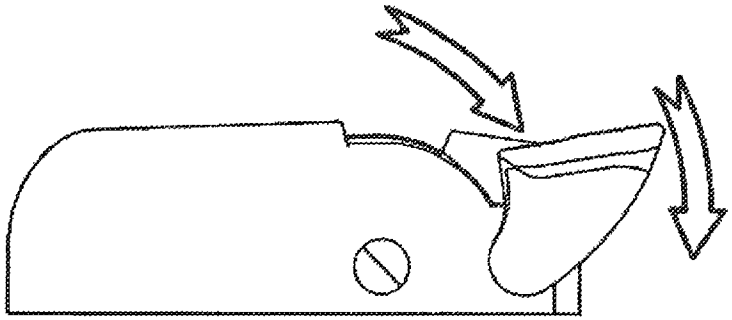
FIG. 40E shows the tumbler being actuated from the non-safe position to the retracted position, and simultaneously causing the pivotable safety button to rotate against its biasing.
Figure 40G:
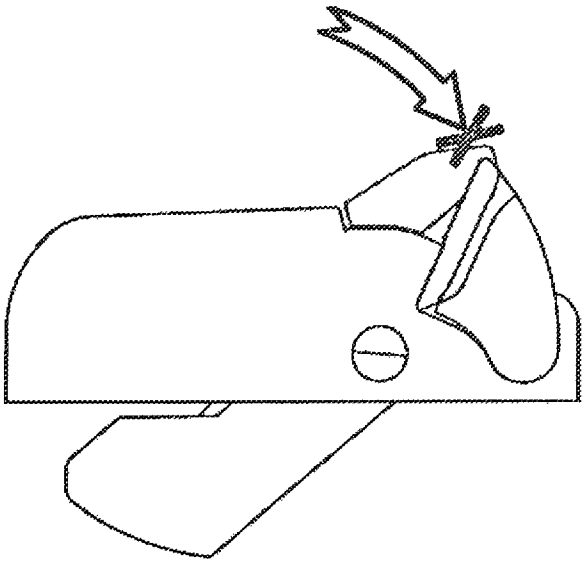
FIG. 40G is a first side view showing the pivotable safety cover blocking movement of the tumbler.
Figure 41A:
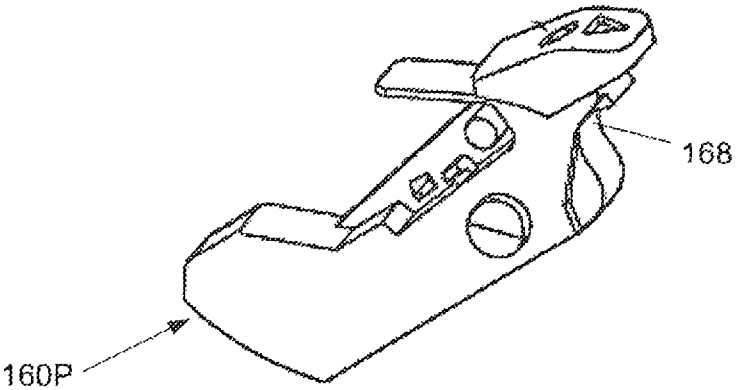
FIG. 41A is a perspective view of the modified tumbler for use with the pivotable safety button for the double action stop of FIG. 39.
Figure 41C:
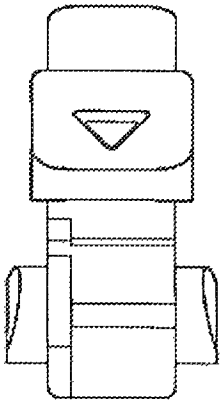
FIG. 41C is a front view of the modified tumbler of FIG. 41A.
Figure 41B:
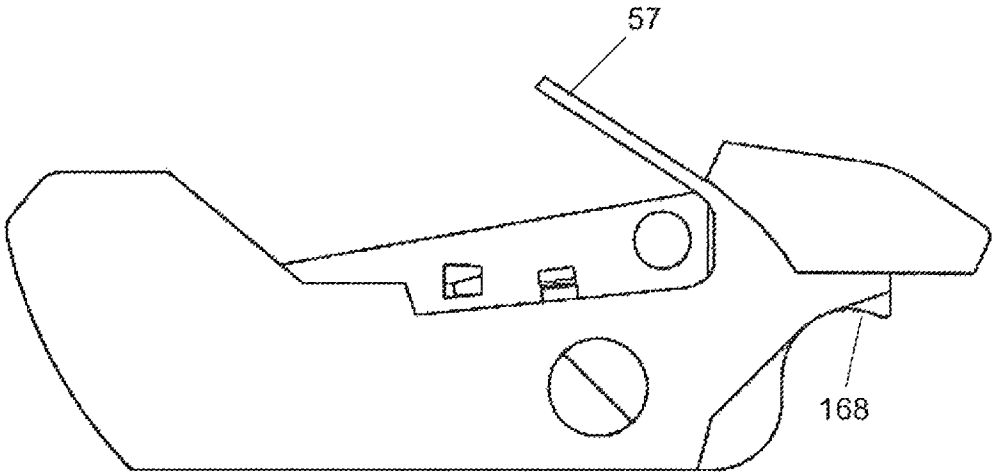
FIG. 41B is a side view of the modified tumbler of FIG. 41A.
Figure 42A:
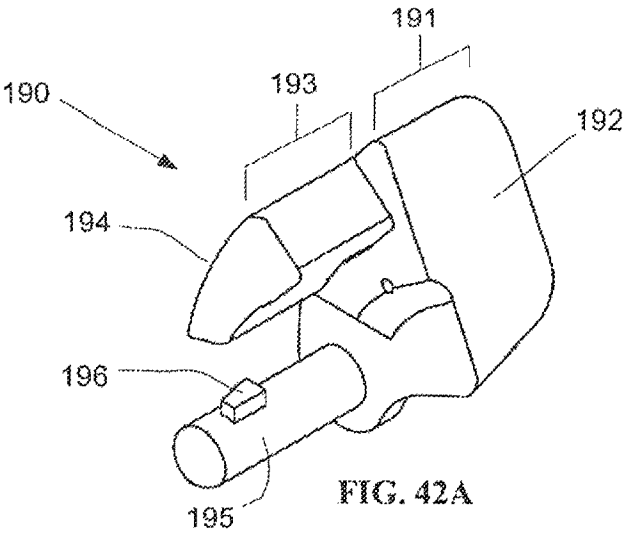
FIG. 42A is a perspective view of the pivotable safety button for the double action stop of FIG. 39.
Figure 42D:
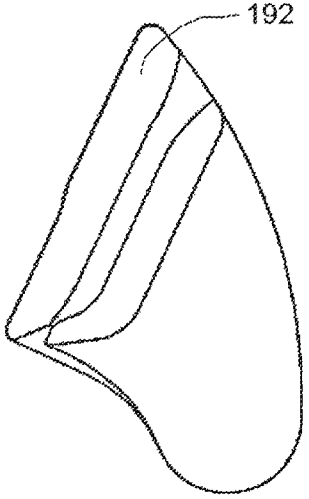
FIG. 42D is a second side view of the pivotable safety button of FIG. 42A.
Figure 42B:
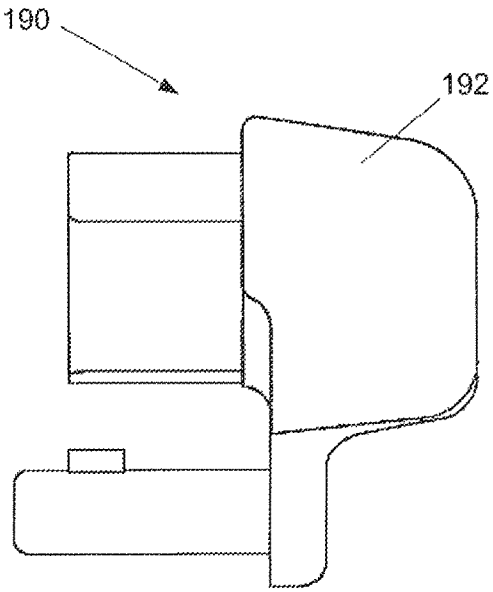
FIG. 42B is a front view of the pivotable safety button of FIG. 42A.
Figure 42C:
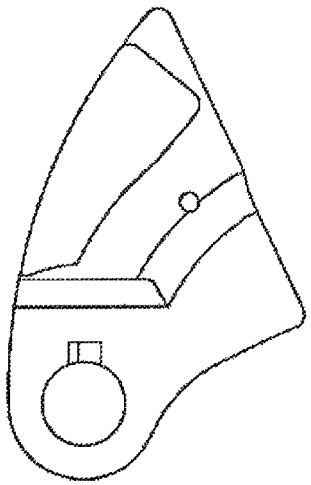
FIG. 42C is a first side view of the pivotable safety button of FIG. 42A.

The cylindrical shaft 195 of the pivotable safety member 190 may be pivotally received in the orifice 55 of housing 20 (FIG. 39), with the pivotable safety member being secured therein by key 196 engaging wall 56 of housing 20. The pivotable safety cover member 190 may be positioned in a blocking position (FIG. 40A) when the. tumbler is in the "safe" position, in which case simply depressing the tumbler 160P Will fail to cause it to pivot, because convex curved surface 194 of pivotable safety member 190 is engaging concave curved surface 168 of tumbler 160P. Thereafter, the pivotable safety cover member 190 may be manually pivoted by the user applying a forced to surface 192 against the biasing of spring 176, to move the safety member 190 to a non-blocking position (FIG. 40B), after which the user may apply a toggling force to the tumbler 160P to pivot the tumbler towards the retracted position (FIG. 40C), after which removal of the toggling force will permit the biasing member 60 to bias the tumbler 160P into the "unsafe" position. (FIG. 40D), and removal of the force from pivotable safety member 190 will allow it to be biased to be in contact with the first end of the tumbler 160P. When the user desires to return the tumbler to the safe position, the user may apply a toggling force to the tumbler first end, and cause the pivotable safety member to rotate against biasing of torsion spring 182. When the tumbler 160P has reached the retracted position (FIG. 40E), the user may remove the toggling force from the tumbler first end, and allow the biasing member 60 to bias the tumbler 160P toward the safe position (FIG. 40F). Once the tumbler 160P reaches the safe position (FIG. 40G), the convex curved surface 194 of pivotable safety member 190 re-engages concave curved surface 168 of tumbler 160P, to thereafter inhibit pivotal movement of the tumbler. Thereafter, movement of the tumbler 160P to the unsafe position will again first require movement of the pivotable safety member 190 to be in the non-blocking position.

Figure 43:
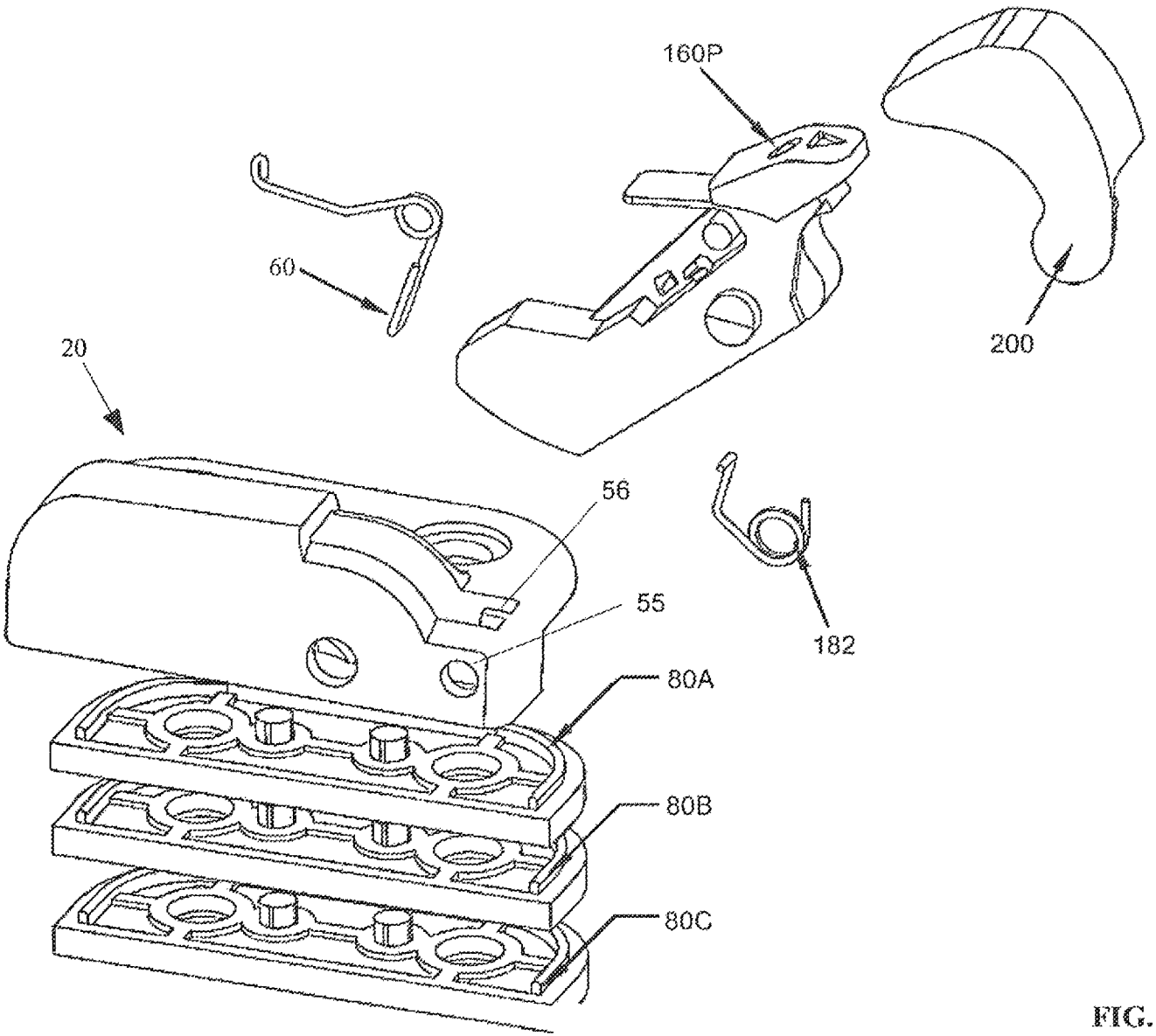
FIG. 43 is an exploded view of the parts comprising a third embodiment of a double action sash window stop, having a pivotable, spring-biased hood to prevent access to the tumbler first end.
Figure 44D:
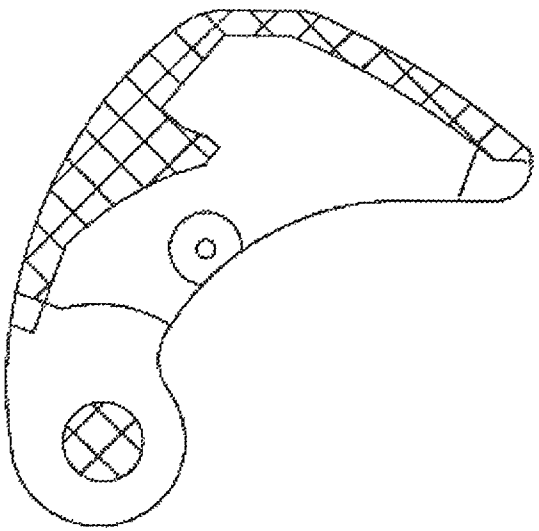
FIG. 44D is a second side view of the hood of FIG. 44A.
Figure 44B:
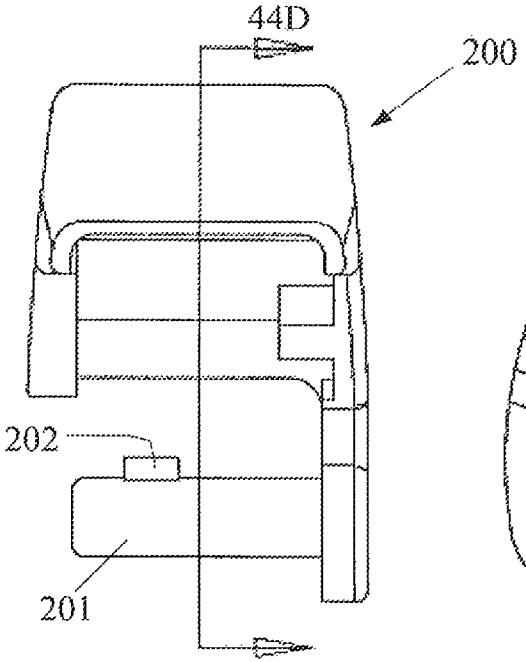
FIG. 44B is a front view of the hood of FIG. 44A.
Figure 44C:
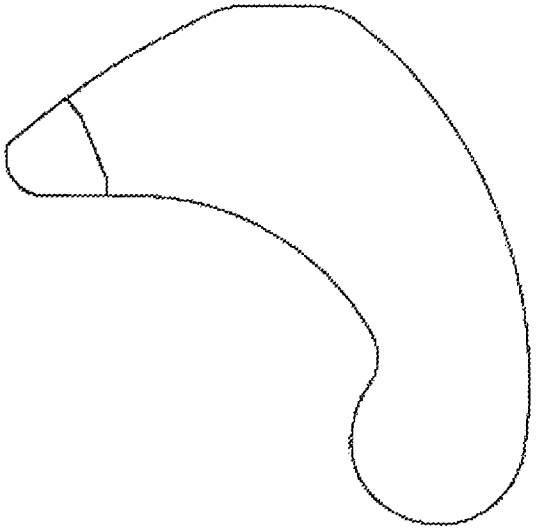
FIG. 44C is a first side view of the hood of FIG. 44A.
Figure 44A:
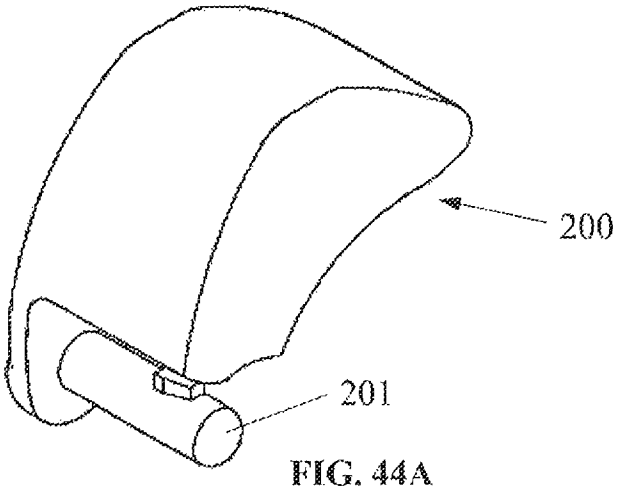
FIG. 44A is a perspective view of the hood of the third double-action stop of FIG. 43.
Figure 44E:
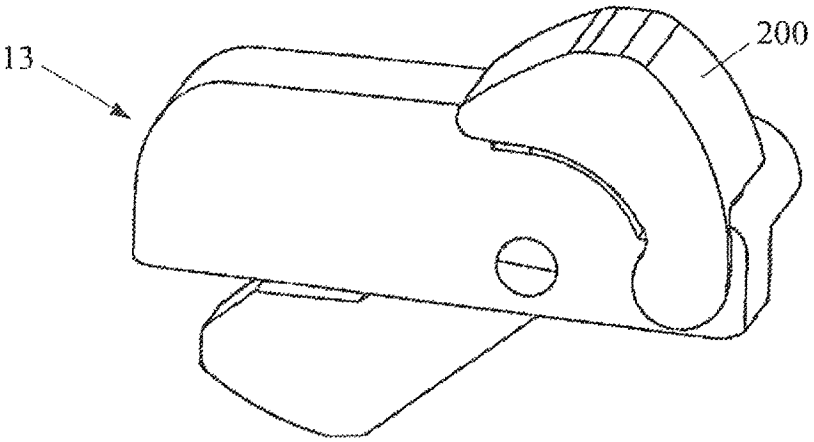
FIG. 44E is a perspective view of the third double action safety stop of FIG. 43.
Figure 44H:
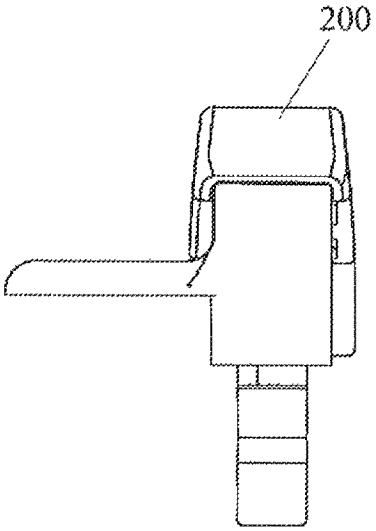
FIG. 44H is a side view of the double action safety stop of FIG. 44E.
Figure 44G:
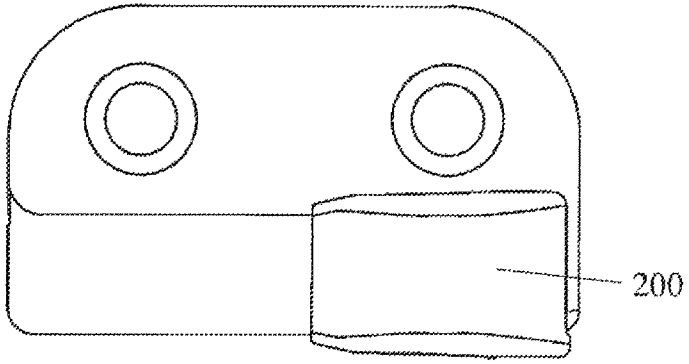
FIG. 44G is a top view of the double action safety stop of FIG. 44E.
Figure 44F:
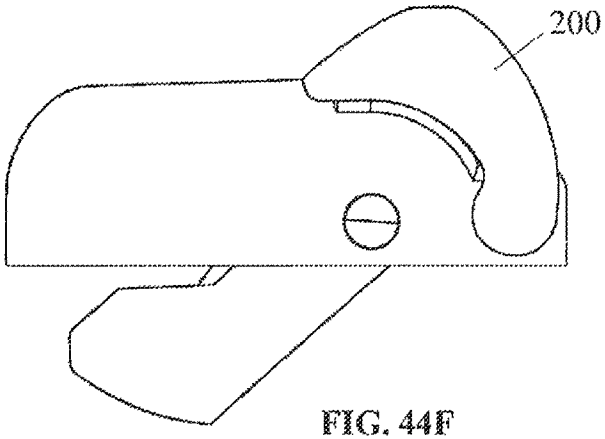
FIG. 44F is a front view of the double action safety stop of FIG. 44E.

In a third alternate embodiment of the adjustable after market safety stop 10, the stop may be modified to produce a double-action safety stop 13, as seen in FIG. 43-44H. The double-action safety stop 12 may be the same as safety stop 10, but may additionally include a hood 200, and a hood biasing spring, which may be torsion spring 182. The hood 280, as seen in detail in FIGS. 44A-44D, may generally be comprised of a hollowed-out arcuate member, from which protrudes a cylindrical shaft 201, which may have located thereon a small "key"-type protrusion 202.

The cylindrical shaft 201 of hood 200 may be pivotally received in the orifice 55 of housing 20 (FIG. 43), with the hood being secured therein by key 202 engaging wall 56 of housing 20, and being biased by spring 182. Biasing of the hood 200 by spring 182 may cause the hood to be positioned in a blocking position (FIG. 45A-45D) when the tumbler is in the "safe" position, in which case the hood 200 will obstruct access to the first end of the tumbler. To disengage the hood from blocking the user's access, the user may simply apply a force to counter the biasing of spring 182, and pivot the hood to a position where it no longer obstructs access to the first end of the tumbler.

Figure 1:
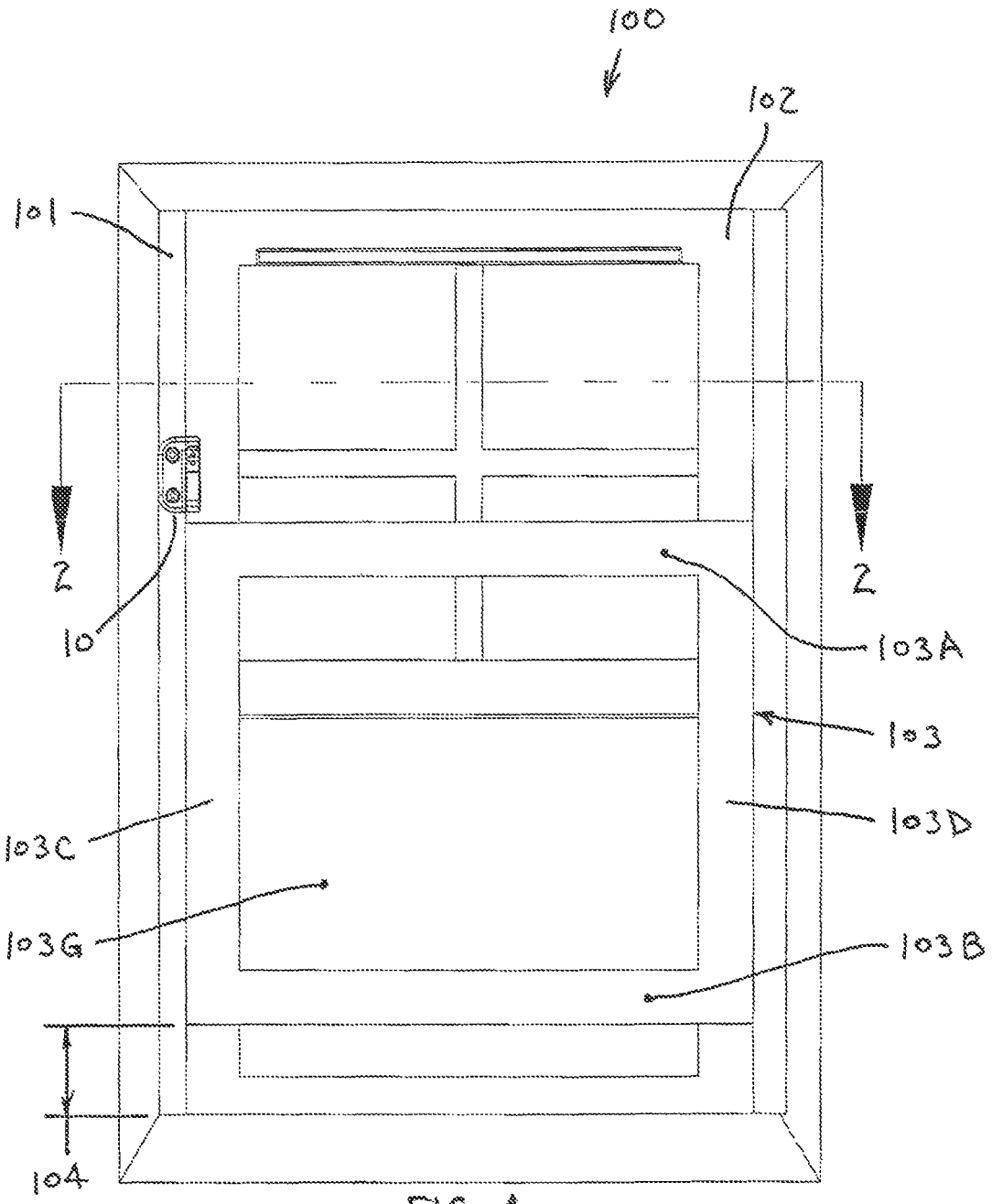
FIG. 1 is a front view of a vertical sliding sash window assembly installed in a building, with the adjustable after-market stop of the current invention installed thereon to limit upward travel of the lower sash window.
Figure 2:
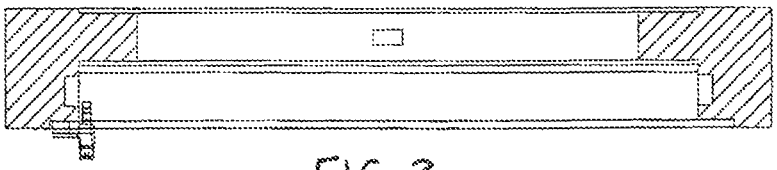
FIG. 2 is a section cut through the sliding sash window and adjustable stop of FIG. 1.
Figure 5:
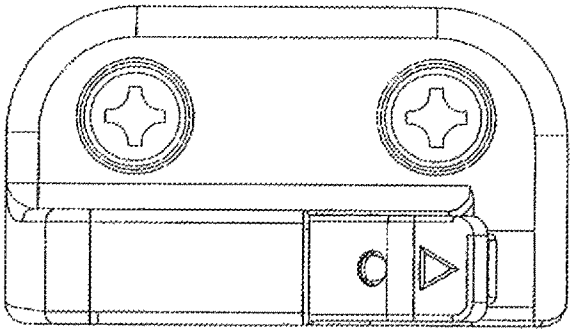
FIG. 5 is a top view of the adjustable window stop of the current invention.
Figure 45A:
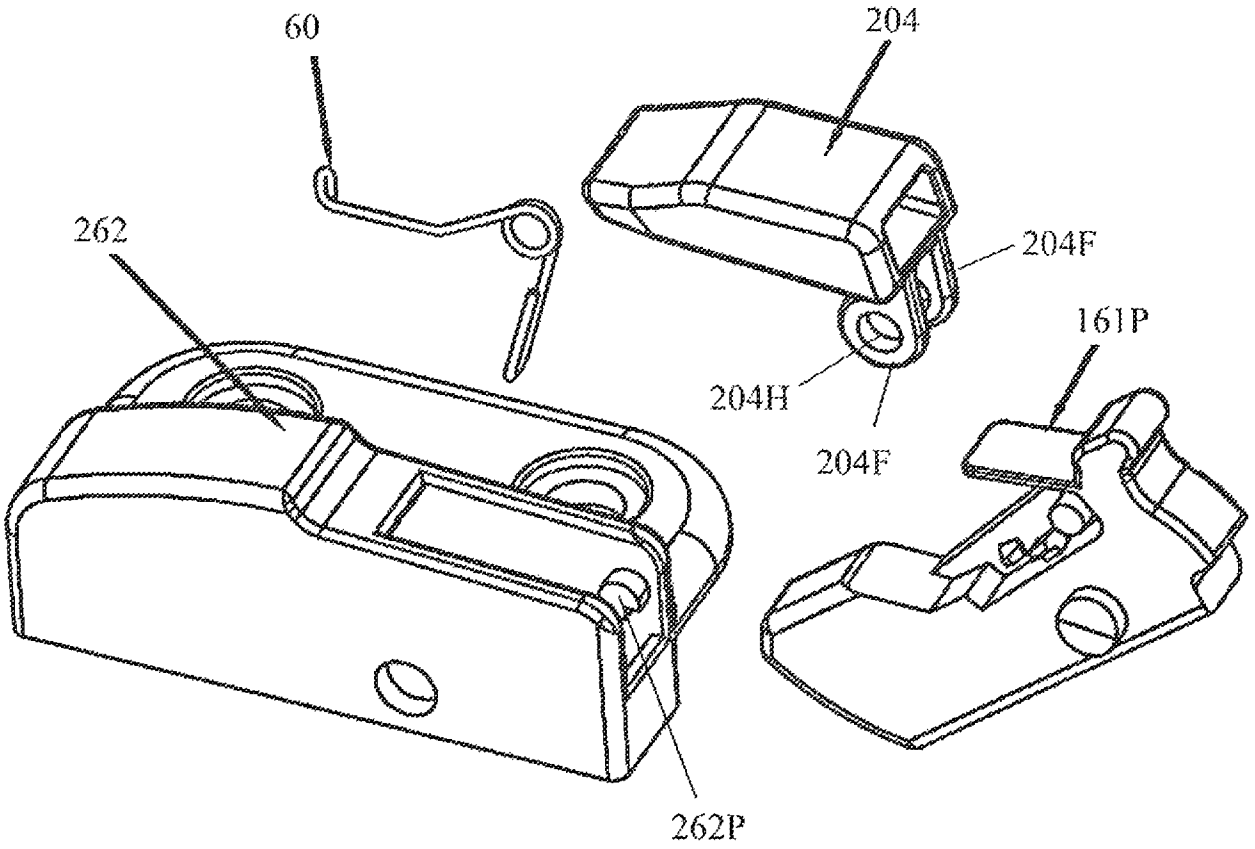
FIG. 45A is an exploded view of the parts comprising a variation of the third embodiment of a double action sash window stop, which has a pivotable, non-biased hood to prevent access to the tumbler first end.
Figure 45B:
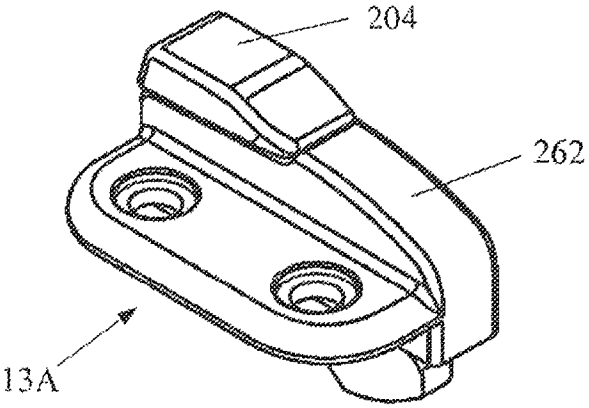
FIG. 45B is a perspective view of the variation of the third embodiment of the double action sash window stop, with the stop being comprised of the parts shown in the exploded view of FIG. 45A.
Figure 45F:
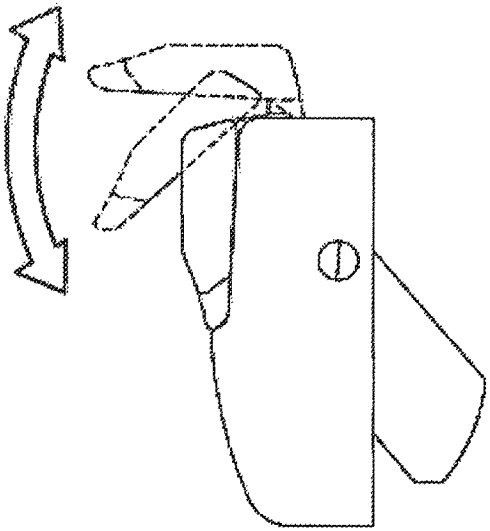
FIG. 45F is a side view of the stop of FIG. 4B, and being shown in the as-installed orientation to illustrate gravity induced tree-fall closure of the cover.
Figure 45E:
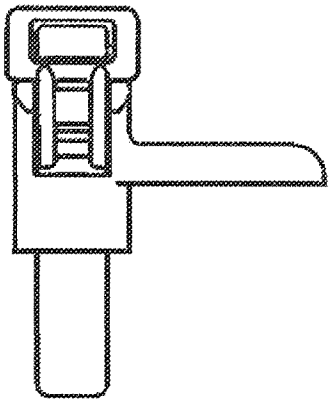
FIG. 45E is a side view of the stop of FIG. 4B.
Figure 45D:
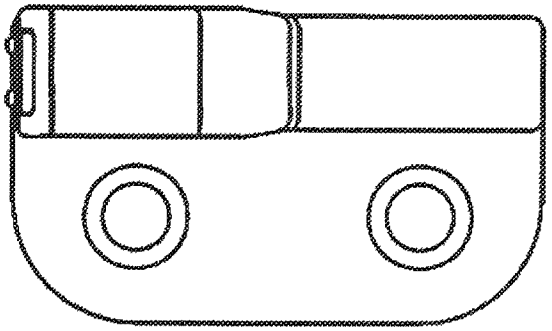
FIG. 45D is a top view of the stop of FIG. 45B.
Figure 45C:
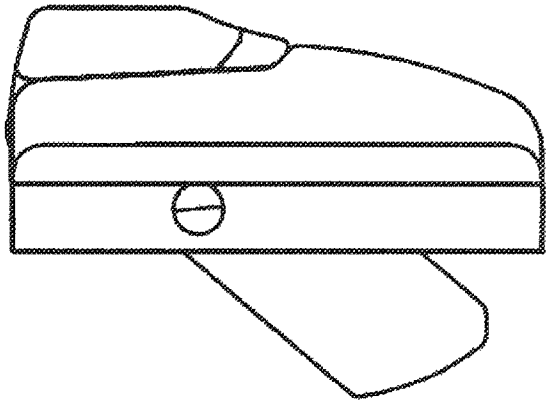
FIG. 45C is a front view of the stop of FIG. 45B.
Figure 45I:
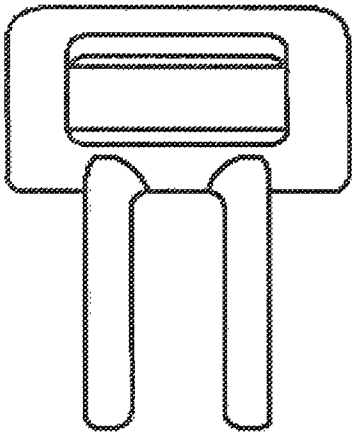
FIG. 45I is a side view of the cover of FIG. 4G.
Figure 45G:
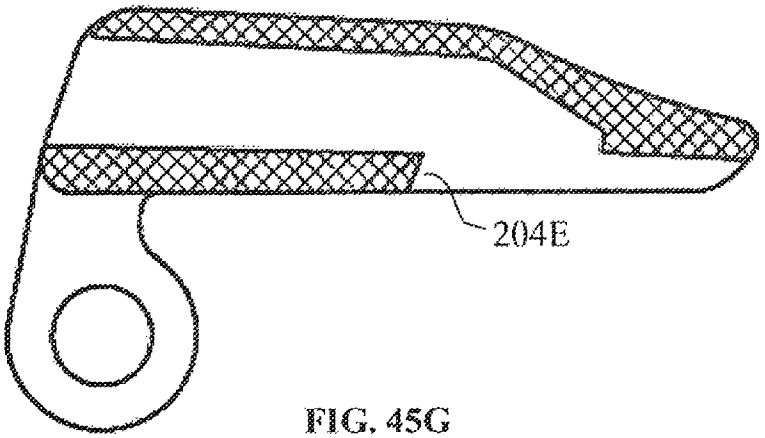
FIG. 45G is a side cross-sectional view of the cover of the stop of FIG. 4B.
Figure 45H:
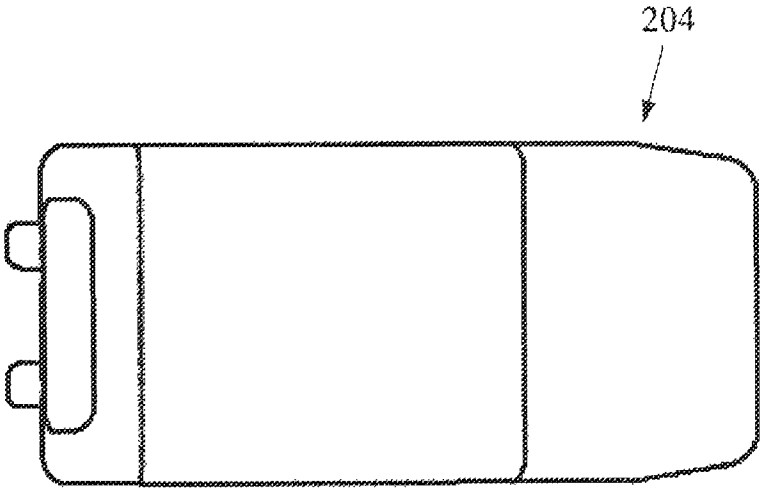
FIG. 45H is a top view of the cover of FIG. 4G.

A variation of this third embodiment is shown by the double-action safety stop 13A, as seen in FIGS. 45A-45M. In this variation, a cover 204 may comprise a pair of flanges 204F extending away from the cover and having holes 204H thereinto form a clevis. The holes 204F of cover 204 may be received by the cylindrical posts 262P in the housing 262, so that the cover 204 may pivot with respect to the housing 262. The stop 13A is shown assembled in FIGS. 45B-45D. FIG. 45F illustrates that the non-biased cover 204 of stop 13A is capable of gravity free-falling to return to the blocking position, when the stop is oriented as it would be installed on a window frame (see FIG. 1).

Figure 45K:
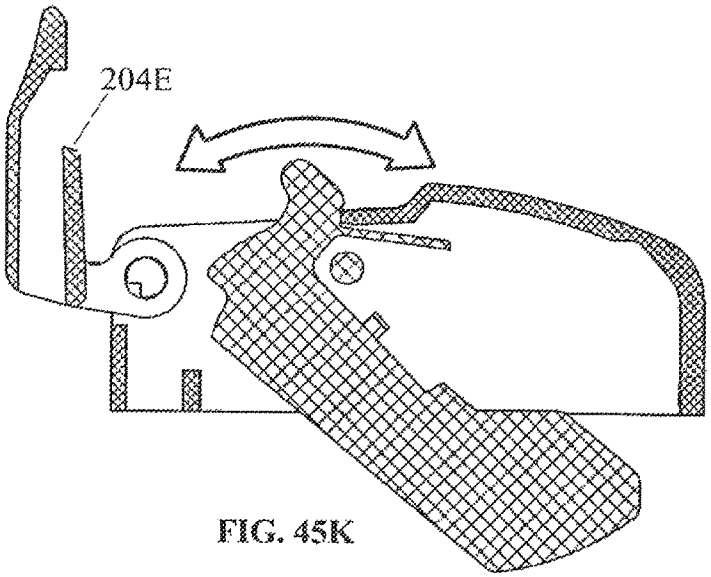
FIG. 45K is the side cross-sectional view of FIG. 45J, but with the cover now occupying the non-blocking position.
Figure 45M:
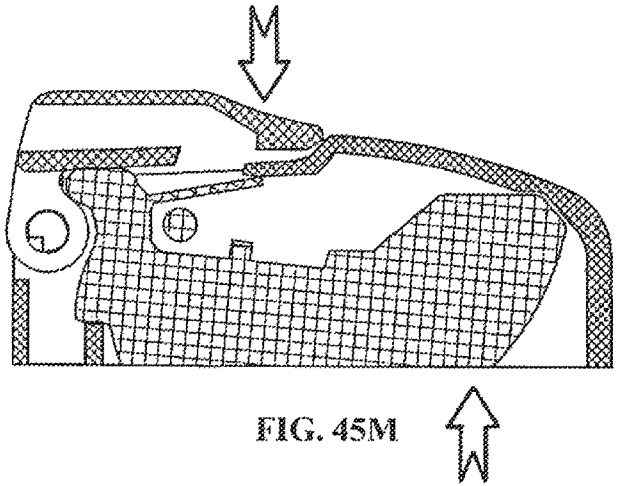
FIG. 45M is the side cross-sectional view of FIG. 45L, but with the tumbler rotated to be in the retracted position, and with the cover shown to be capable of returning to the blocking position, with the tumbler first end being completely contained within the housing.
Figure 45J:
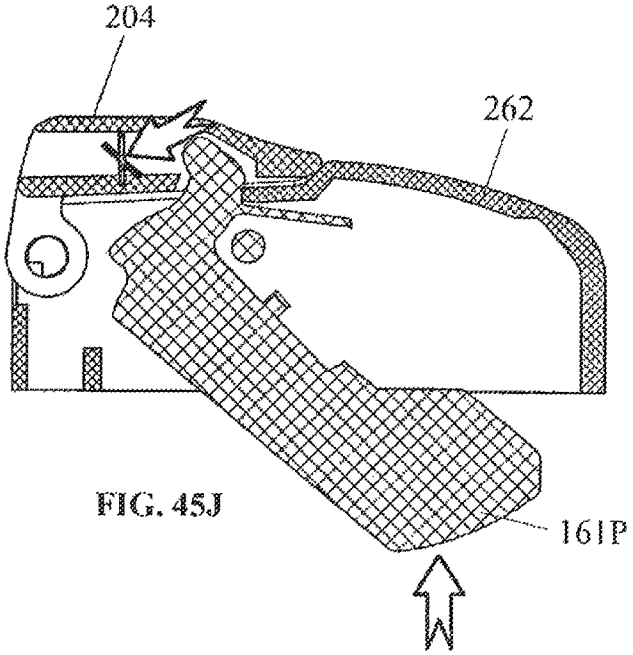
FIG. 45J is a side cross-sectional view through the stop of FIG. 45B, with the tumbler shown in the safe position, and the cover occupying the blocking position.
Figure 45L:
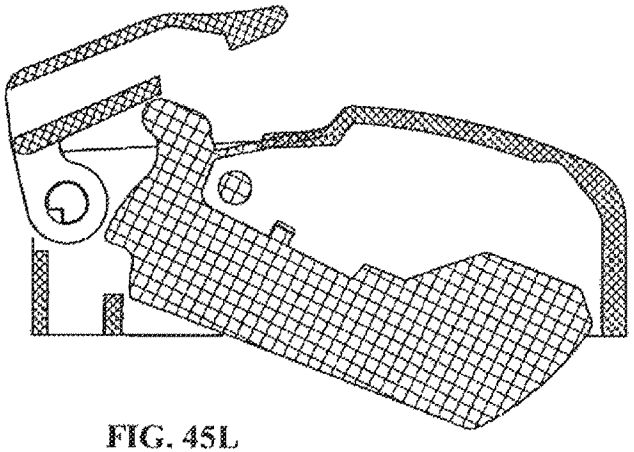
FIG. 45L is the side cross-sectional view of FIG. 45K, but with the tumbler having been moved into the non-safe position, and the cover having been left to auto-rotate back and contact the first end of the tumbler.

The cross-sectional views in FIGS. 45J-45M illustrate the operation of the stop 13A, which is similar to that of stop 13. In FIG. 45J, the tumbler 161P is occupying the safe position, and the cover 204 is in the blocking position. With the cover 204 in the blocking position, not only can a user not immediately toggle the tumblers first end. but any attempt to apply a force to the tumbler second end will not result in movement of the tumbler, as the tumbler 161P first end contacts the edge 204E of the cover 204 to thereby inhibit its movement Once the cover 204 has been moved by the user to the non-blocking position, as seen in FIG. 45K, the user may then toggle the first end of tumbler 161P to move it to the non-safe position, which is shown in FIG. 45L. FIG. 45L also shows the cover 204 having been released by the user-to freefall back (note the stop in the figure is oriented 90 degrees from its installed position) and contact the first end of tumbler 161P. FIG. 45M shows the stop of FIG. 45L after toggling, of the tumbler 161P first end to place the tumbler into the retracted position. With stop 13A, the cover 204 maybe rotated back to the blocking position while the tumbler 161P is in the retracted position, to positively retain the tumbler therein. This arrangement serves to prevent automatic resetting of the tumbler into the safe position, through the previously described sliding movement of a sash member contacting the curved surface of the tumbler.

Figure 48:
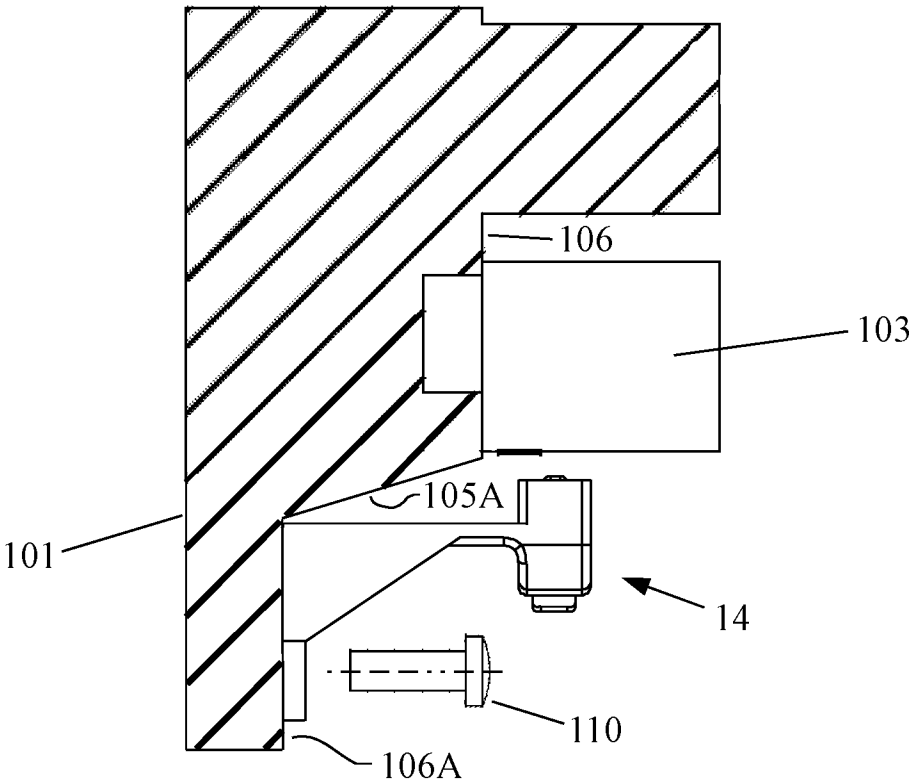
FIG. 48 is a section view showing mounting on a master frame of a sash window, of the stop of FIG. 46A with the alternate mounting flange for 90 degree mounting.

In addition to the means of mounting any of the stops disclosed herein (stops 10, 11, 12, 13, and 13A), through use of the orifices 34 in mounting flange 31, an adaptor 250 (FIGS. 47A-47E) may be combined with the stop to accomplish 90 degree mounting, where the side of a master window frame may need to be used for attachment of the stop (FIG. 48). The adaptor 250 may comprise a mounting flange 251 having orifices 252 therein, and from which laterally extends a peripheral wall 253 that forms an opening 254. On an interior side of peripheral wall 253 may be one or more cylindrical posts 255 protruding at least part of the way into the opening 254. The mounting flange 31 of the stop (10, 11, 12, or 13) may be inserted into the opening 254 with at least one of the orifices 34 being securable to a cylindrical post 255. The peripheral wall need not completely enclose the perimeter of the mounting flange 31, however, a portion 253A of the peripheral wall 253 may preferably be on a side opposite to the location of the bearing surface 45 of the tumbler, to provide support for the stop—support that may provide an opposing force for when the sash member may be slidably forced into contact with the bearing surface 45.

In an alternate embodiment of this 90 degree mounting arrangement, seen in FIGS. 46A-46D, a stop 14 may have a housing 261 formed by a flange 31S extending from a side wall, to terminate in a flange 31M that extends at a 90 degree angle to flange 31S. Flange 31M may have orifices located therein for mounting of the stop 14. To provide for torsional, rigidity of this stop 14 mounting arrangement, flanges 31S and 31M may be connected by flanges 31X and 31Y to form part of a 'bath-tub' fitting. Use of the stop 14 is illustrated in FIG. 48, where it may be advantageously utilized because the master frame 101 of the window may have a canted inward facing side 105A, that does not readily lend itself to mounting of the stop, except where the stop had a mounting flange 31 being at a non-orthogonal angle 39, as previously discussed. However, to simplify the installation, rather than seeking to accommodate all the possible angled master window frames with various corresponding non-orthogonal mounting flanged stops, the flange 31M of stop 14 may be mounted to the second side-facing surface 106A of the master frame 101. Another version of this 90 degree mounting arrangement is shown by stop 14A, and is seen in FIGS. 46E-46H. The stop 14A does not have flanges to create a bath-tub fitting, and instead includes a flange 31M that is integrally stiffened with a waffle grid of stiffeners 31W on one side of the flange. The stop 14A may also include a slidable, spring-biased safety button being slidably disposed upon the tumbler, as with stop 11.

Figure 32:
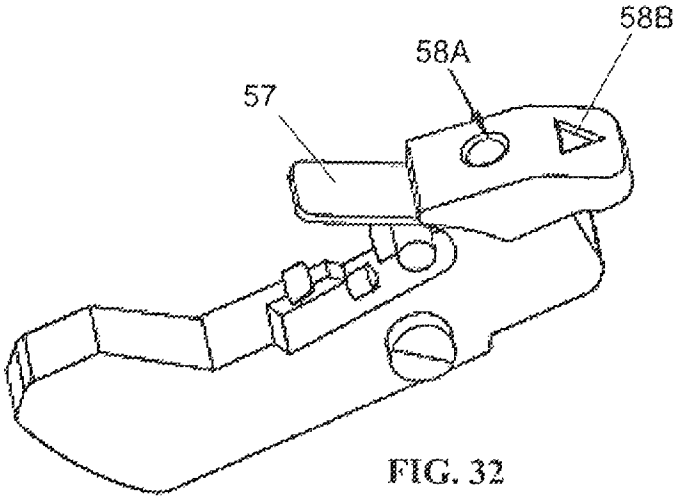
FIG. 32 illustrates a first method of incorporating warning indicators on the tumbler of the present invention, in the form of a red triangular/circular recess.
Figure 33:
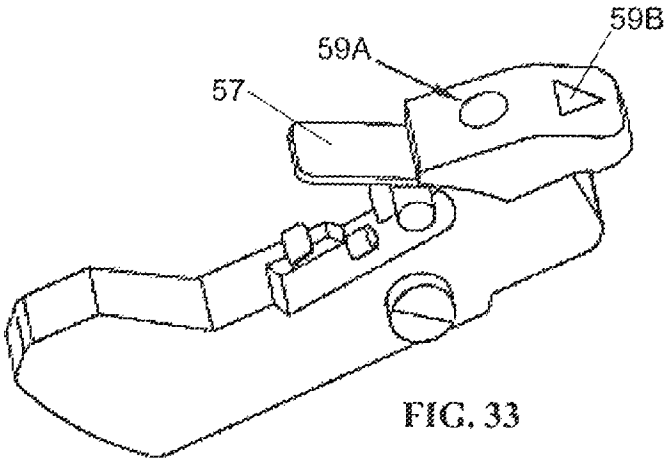
FIG. 33 illustrates a second method of incorporating warning indicators on the tumbler of the present invention, in the form of a red triangular/circular pad.
Figure 34B:
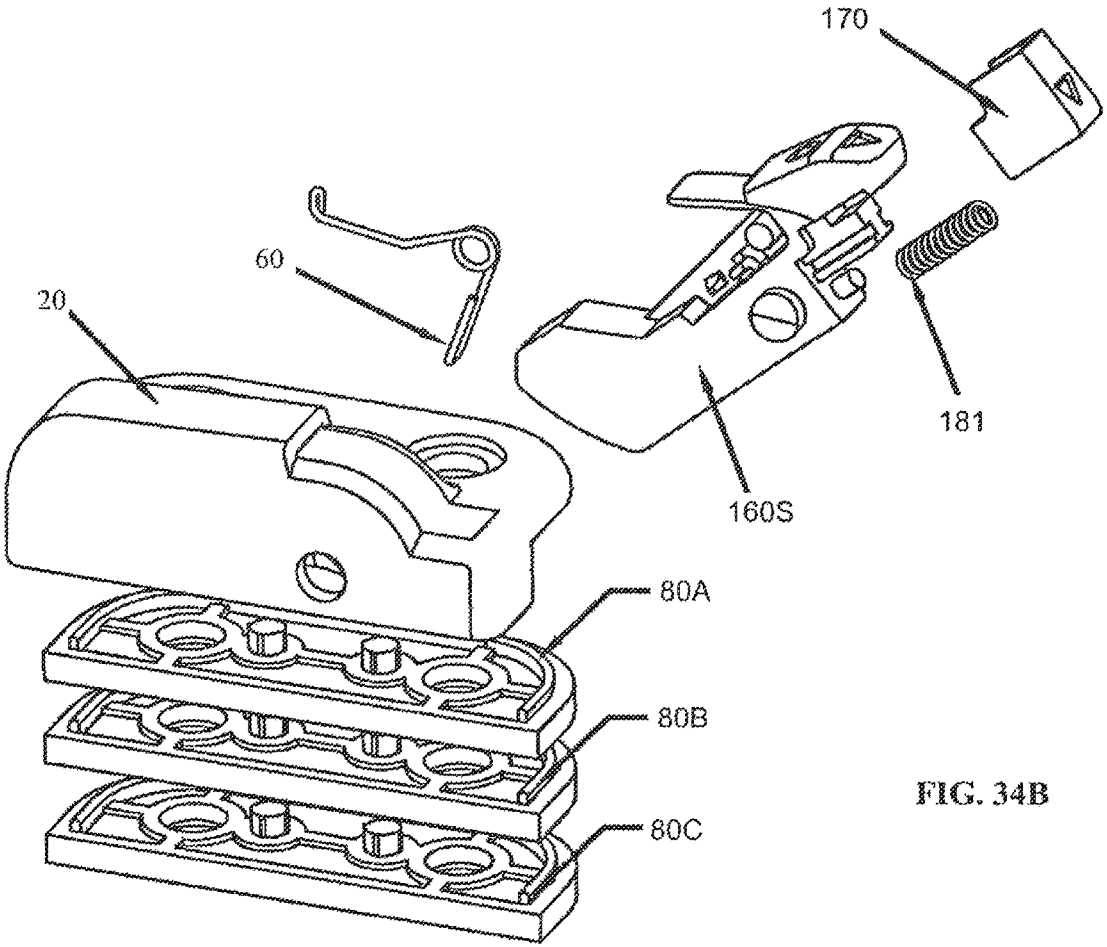
FIG. 34B is an exploded view of the double-action stop of FIG. 34A.
Figure 34A:
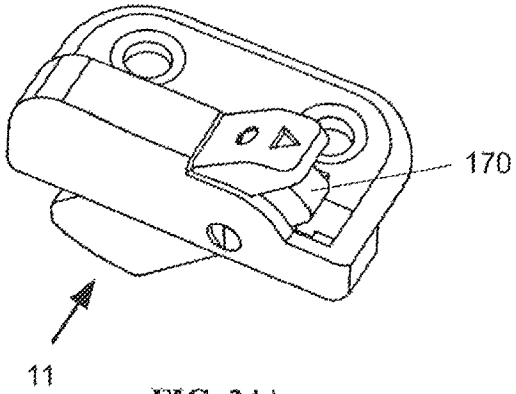
FIG. 34A is a perspective view of an alternate embodiment of the adjustable after-market sash window stop, having a slidable, spring-biased safety button to create a double-action stop.
Figure 46D:
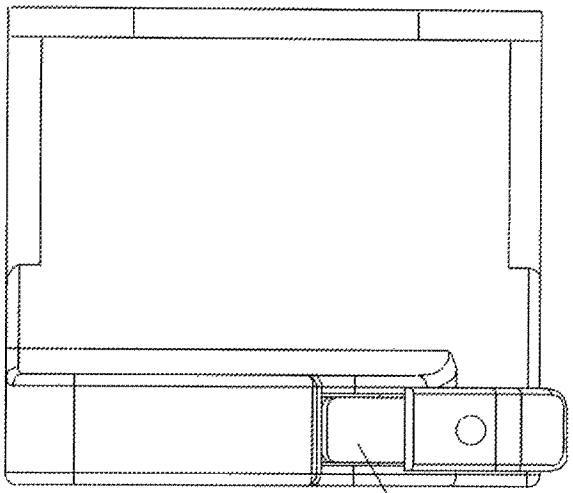
FIG. 46D is a top view of the safety stop with the alternate embodiment of the mounting flange of FIG. 46B.
Figure 46B:
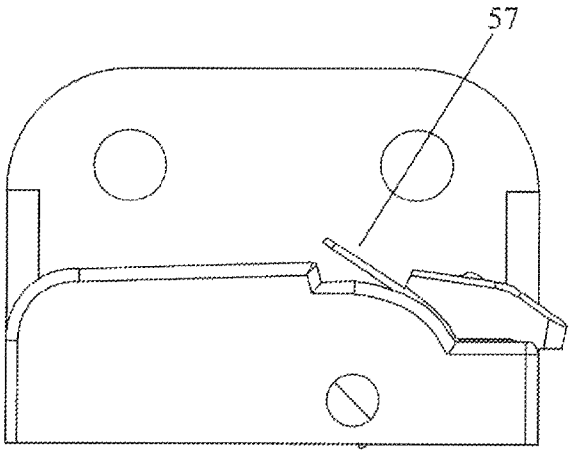
FIG. 46B is a front view of the safety stop with the alternate embodiment of the mounting flange of FIG. 46A.
Figure 46A:
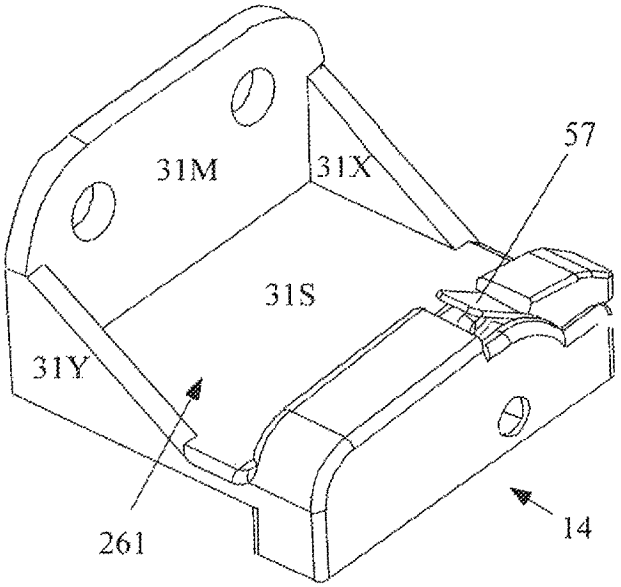
FIG. 46A is a perspective view of an alternate embodiment for the mounting flange, with it being usable for any of the safety stops of the current invention to provide for 90 degree mounting.
Figure 46C:
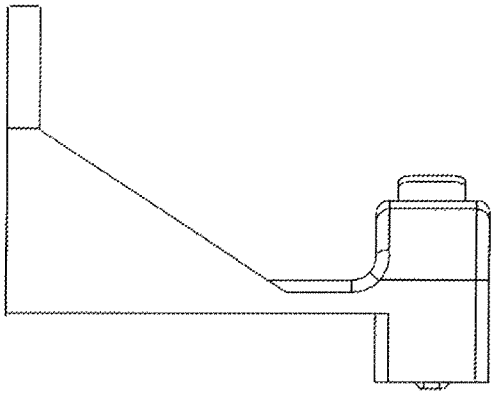
FIG. 46C is a side view of the safety stop with the alternate embodiment of the mounting flange of FIG. 46B.
Figure 46H:
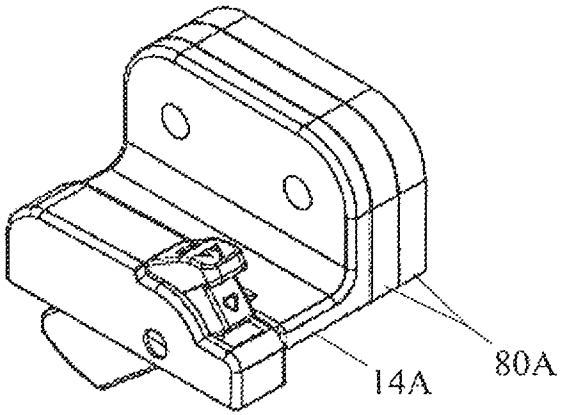
FIG. 46H is a perspective view of the stop of FIG. 46E, shown with the two spacers being used on the mounting flange.
Figure 46F:
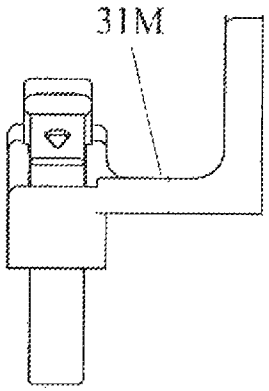
FIG. 46F is a side view of the stop of FIG. 46E.
Figure 46E:
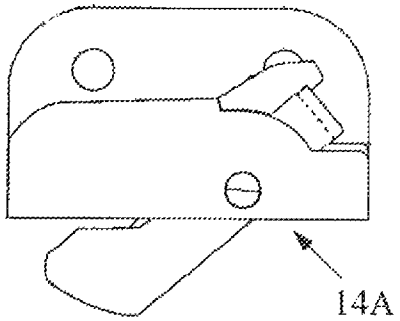
FIG. 46E is a front view of another embodiment of the stop of FIG. 46A, and includes a slidable, spring-biased safety button.
Figure 46G:
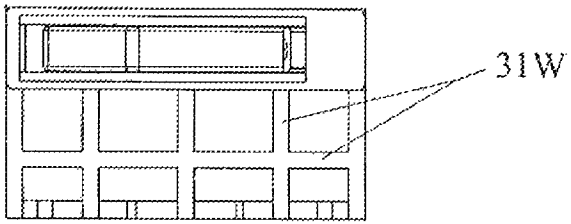
FIG. 46G is a bottom view of the stop of FIG. 46G.
Figure 47A:
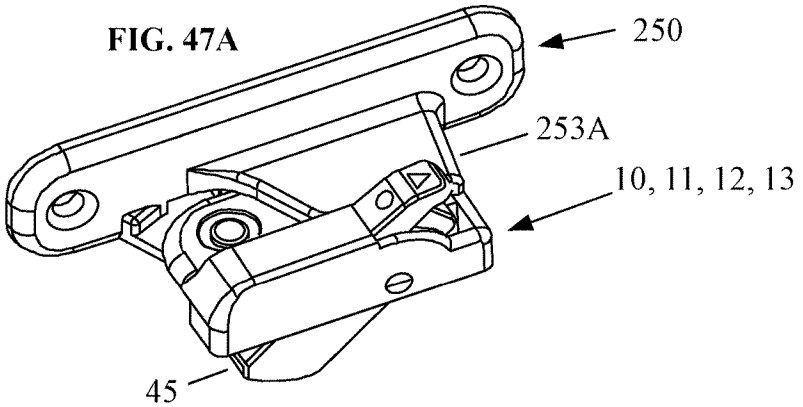
FIG. 47A is a perspective view of a combination of a stop of the present invention and an adapter for 90 degree mounting.
Figure 47B:
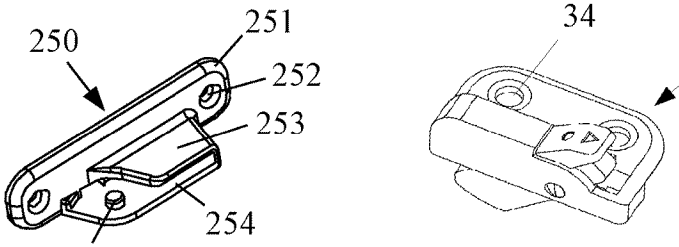
FIG. 47B is a perspective view of the adapter of FIG. 47A shown by itself.
Figure 47C:
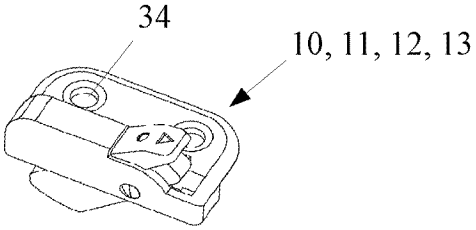
FIG. 47C is a perspective view of the stop of FIG. 47A shown by itself.
Figure 47D:
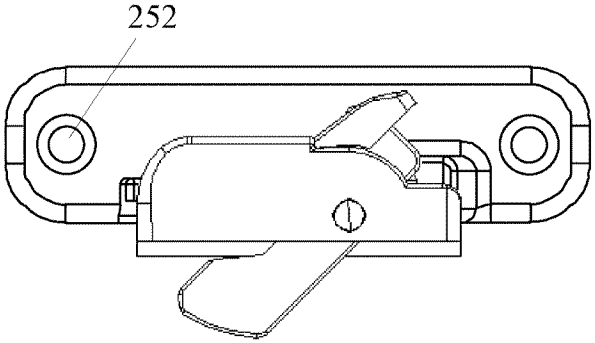
FIG. 47D is a front view of the combination of FIG. 47A.
Figure 47E:
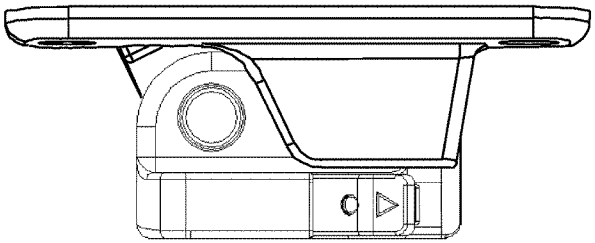
FIG. 47E is a top view of the combination of FIG. 47A.
Figure 47F:
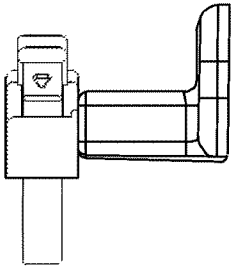
FIG. 47F is a side view of the combination of FIG. 47A.

It should-also be noted that any of the stops disclosed herein may advantageously be designed to integrally include, upon the tumbler, a flexible flange 57. In one mode of operation, as seen in FIGS. 46A-46C, the flexible flange 57 may protrude so as to remain outside of the housing, and may operate as a finger guard. The finger guard 57 may serve to protect a digit that is being placed by the user on the first end of the tumbler to toggle the tumbler, and prevent the digit from being pinched between the tumbler and the housing. In addition, each of the stops may comprise one or more recessed warning signals 58A and 58B to alert the user when the tumbler is in either the safe or unsafe positions (FIG. 32). The stop may alternatively utilize, rather than a recessed signal, a padded or sticker warning signal (59A, 59B) being applied to the tumbler (FIG. 33).

Figure 49:
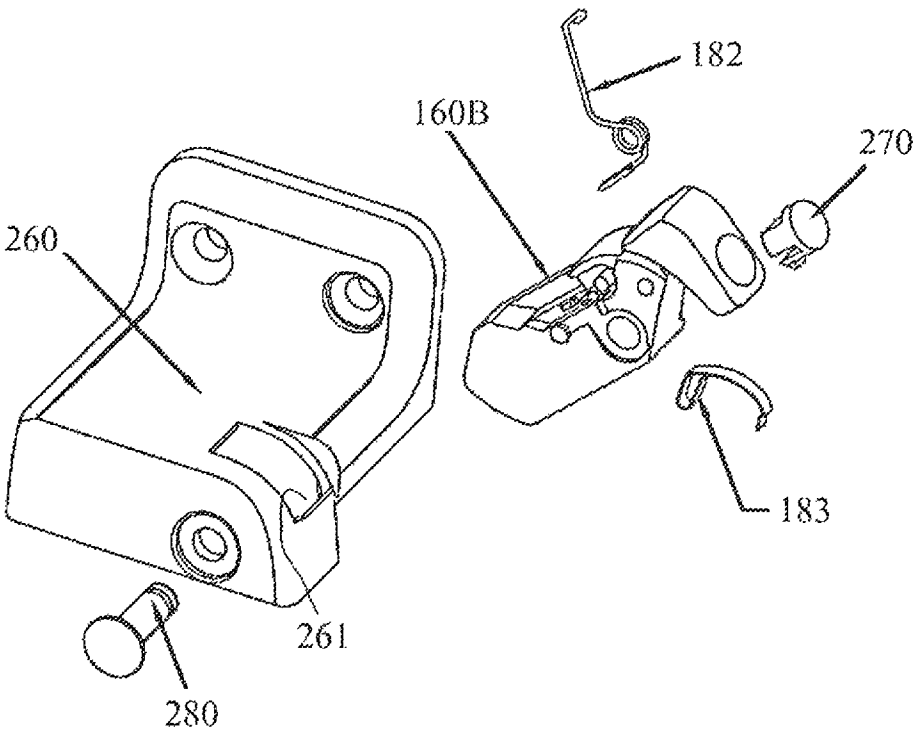
FIG. 49 is an exploded view of the parts comprising a fourth embodiment of a double action sash window stop, having a button-actuated leaf spring that may inhibit tumbler movement.
Figure 53:
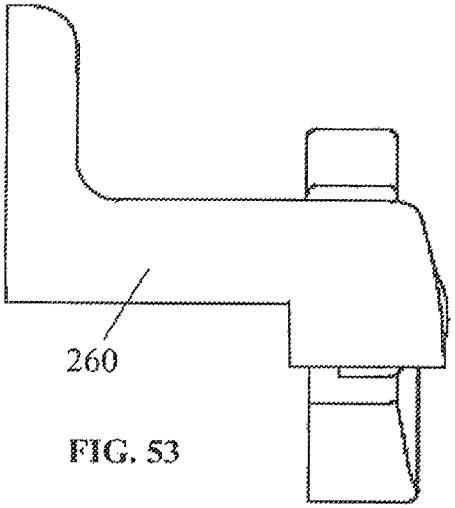
FIG. 53 is a side view of the double action sash window stop of FIG. 50.
Figure 50:
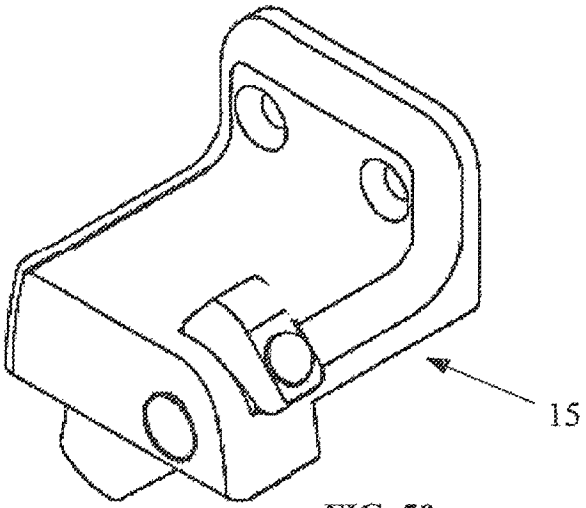
FIG. 50 is a perspective view of the fourth embodiment of the double action sash window stop.
Figure 51:
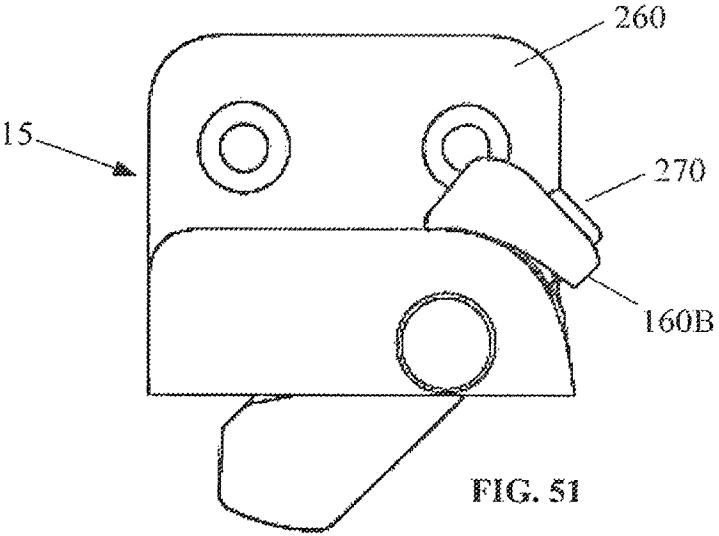
FIG. 51 is a front view of the double action sash window stop of FIG. 50.
Figure 52:
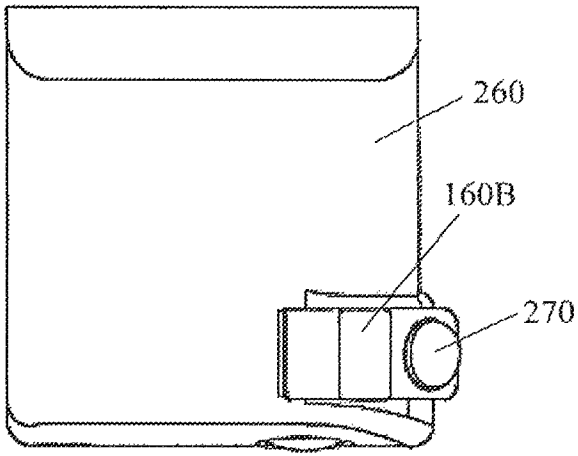
FIG. 52 is a top view of the double action sash window stop of FIG. 50.

In a fourth alternate embodiment of the adjustable after market safety stop 10, the stop may be modified to produce a double-action safety stop 15, as seen in FIG. 50-52. The double-action safety stop 15 may be similar to safety stop 10, but instead of tumbler 40, stop 15 may include a tumbler 160B (FIG. 49), which provides support for a safety button member 270 and a safety member biasing spring 183, which may be a leaf spring.

Figure 63:
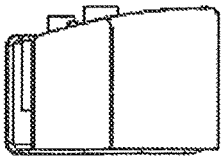
Figure 61:
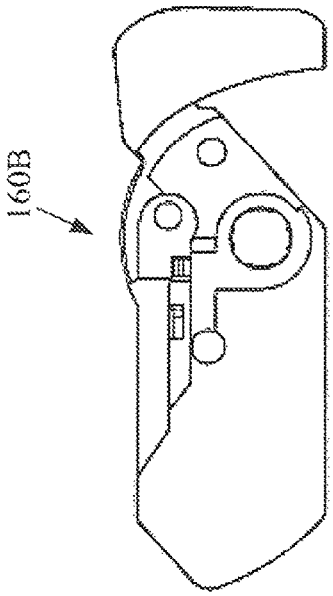
Figure 62:
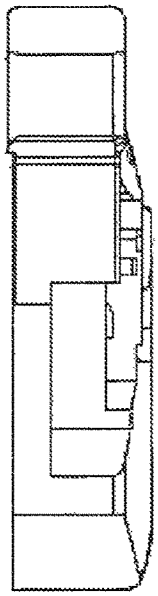
Figure 66:
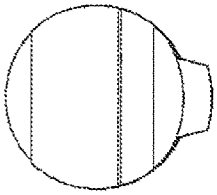
Figure 64:
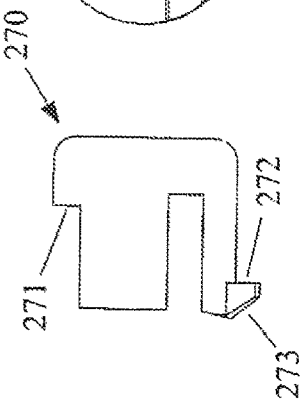
Figure 65:
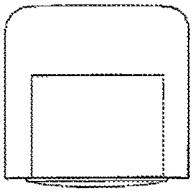

The tumbler 160B may be biased relative to the housing 260 by a spring 182, and may generally comprise movements, as previously described, while being pivotally mounted to the housing 260 using axle 280. However, an orifice in tumbler 160B may slidably receive the safety button member 270, which is seen in detail in FIGS. 64-66. The button 270 may be biased outward by the leaf spring 183, which is mounted to the tumbler. The tumbler 160B is shown in detail in FIGS. 61-63.

Figure 54:
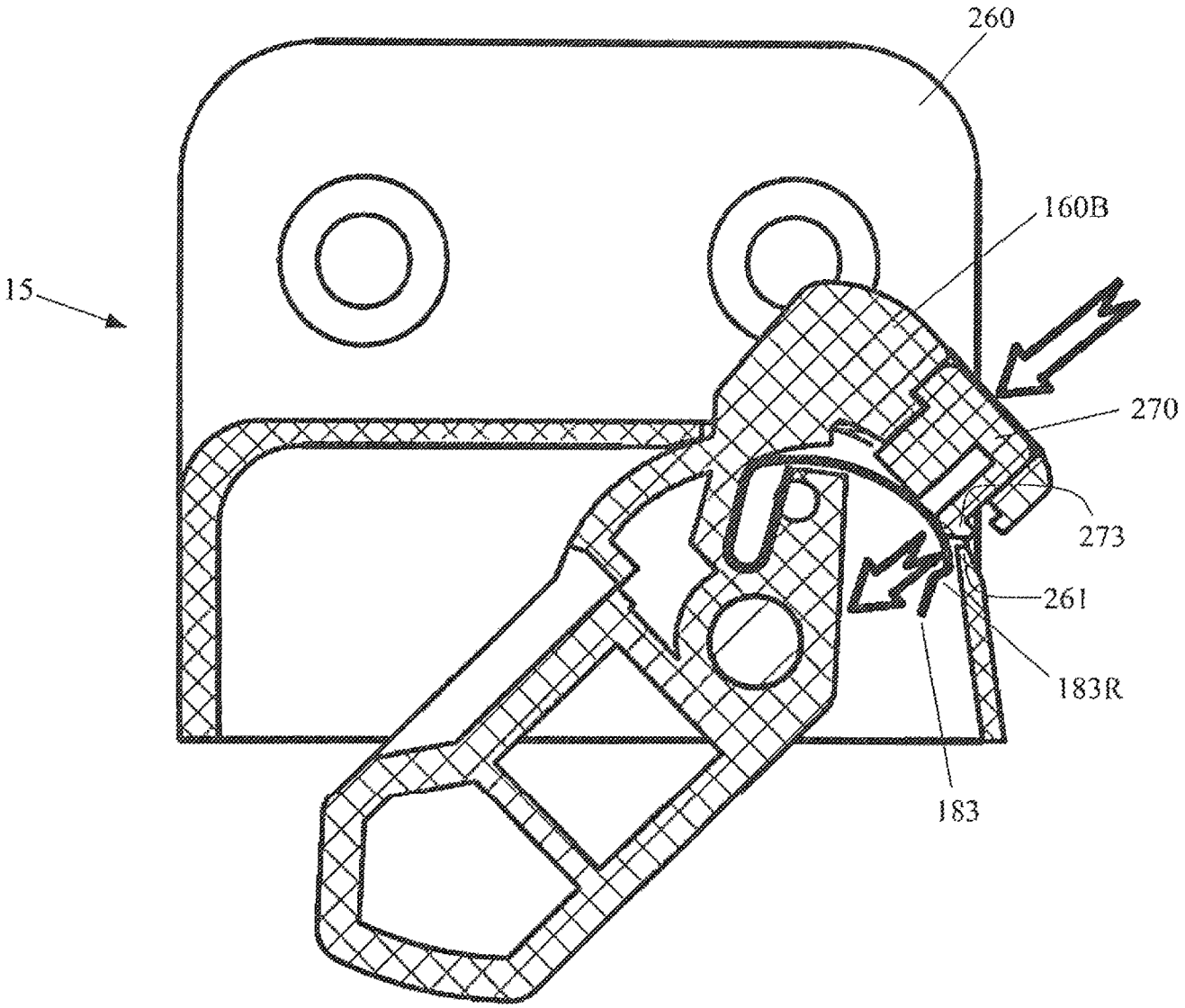
FIG. 54 is an enlarged cross-sectional view through the double action sash window stop of FIG. 50, with the button depressed to disengage the leaf spring from the housing.
Figure 55:
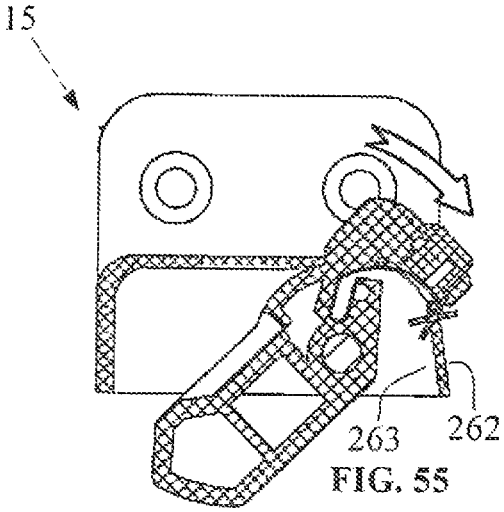
FIG. 55 is a cross-sectional view of the double-action stop of FIG. 50, with the tumbler shown in the safe position, and with the leaf spring biasing the button and engaging the housing to prevent movement of the tumbler from the safe to the unsafe position.

The safety aspect of the stop may be best understood through examination of the enlarged view in FIG. 54, in which the safety button member 270 has already been depressed to engage the leaf spring 183. It may be seen in the figure that the safety button member 270, once installed within the orifice of the tumbler 160B, is slidable between a first position and a second position. The button may be travel limited at those two positions by contact between the shoulders 271 and 272 (FIG. 64) of the button with a corresponding shoulder within the tumbler orifice. When the leaf spring 183 biases the button outward, outward sliding travel is limited by the shoulder 271 contacting the corresponding tumbler shoulder. While the button 270 is outwardly biased by the leaf spring 183, the leaf spring occupies a blocking position, in which case simply depressing the tumbler 160B will fail to cause it to pivot, because a recess 183R in the leaf spring will engage an edge 261 (FIGS. 49 and 54) of the housing 260, and thereby serves as the safety by inhibiting tumbler movement.

Figure 56:
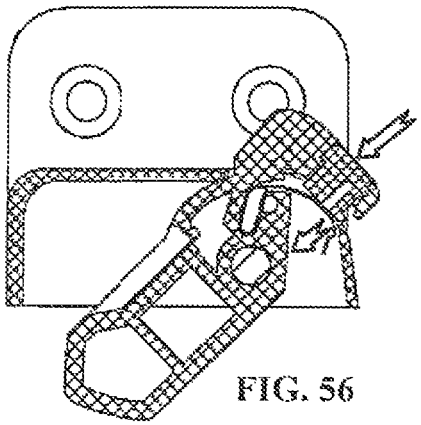
FIG. 56 is the cross-sectional view of FIG. 55, but with the button having been depressed to disengage the leaf spring from the housing to be in the unblocked position.
Figure 57:
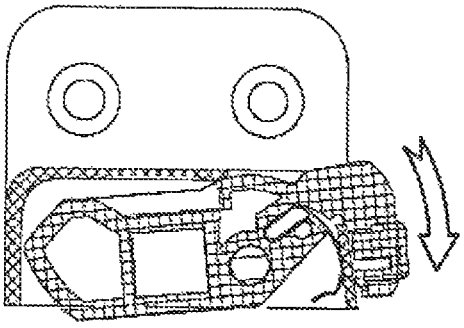
FIG. 57 is the cross-sectional view of FIG. 56, but with the tumbler pivoted into the retracted position, by application of a force to the tumbler's first end.
Figure 58:
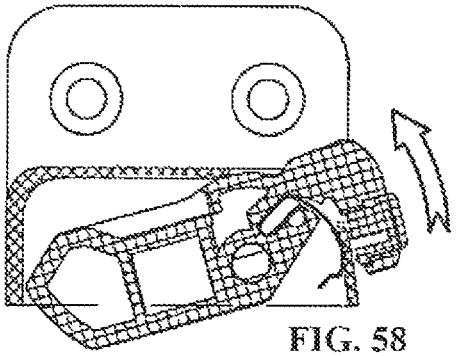
FIG. 58 is the cross-sectional view of FIG. 57, but with the force removed from the tumbler first end to permit the tumbler to be biased into the unsafe position.
Figure 59:
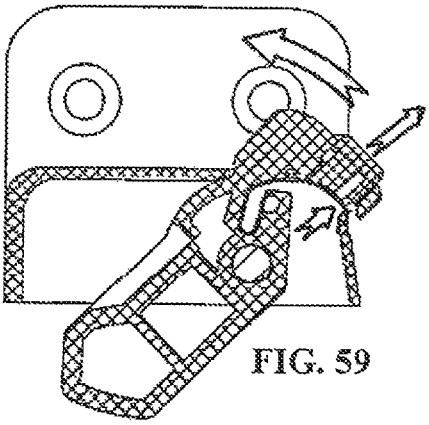
Figure 60:
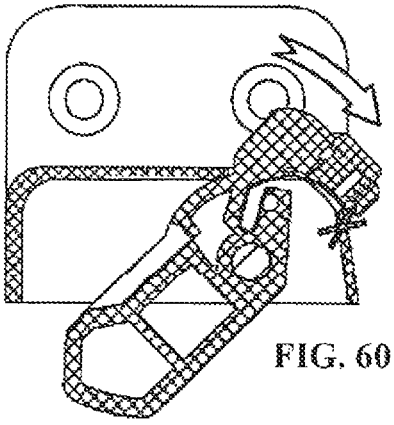

Once the button 270 is depressed, as seen in FIGS. 54 and 56, the recess 183R in the leaf spring will no longer be able to engage the housing edge 261, so that a force then being applied to the tumbler 160B will cause rotation of the tumbler and the leaf spring 183 to slide past the housing inside surface 263, while the angled edge 273 (FIGS. 64 and 54) of the button 270 permits the button to slide relative to the housing outside surface 262. The remaining sequence of movements of the tumbler is seen in FIGS. 57-60, which generally proceeds as previously disclosed. Once the tumbler is returned from the sale to the unsafe position, the leaf spring 183 will once again be clear of the housing inside surface 263 (FIG. 59), and the recess 183R in the leaf spring will once again engage the housing edge 261 if a user attempts to actuate the tumbler 163B prior to the safety button being depressed (FIG. 60).

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A stop, for use on a window to limit sliding of a sash member with respect to a master frame of the window, between a closed position and a partially opened position, the partially opened position being between the closed position and a fully opened position of the sash member, said stop comprising;

a housing configured to mount said stop to the window, said housing comprising an interior surface defining a housing cavity, said interior surface comprising a contoured feature;

a tumbler, said tumbler comprising a first end and a second end; said tumbler being pivotally mounted to said housing; said second end of said tumbler comprising a bearing surface;

a biasing member, said biasing member configured to bias said second end of said tumbler to pivot outward from said housing cavity; a portion of said biasing member configured to contact and move with respect to said contoured feature to selectively limit outward pivotal travel of said tumbler, said tumbler thereby configured for toggling between a first tumbler position and a second tumbler position by a force applied proximate to said first end of said tumbler; when in said first tumbler position, said bearing surface of said tumbler is positioned to limit opening of the sash member to the partially opened position; when in said second tumbler position, at least a portion of said second end of said tumbler protrudes out from said housing cavity, such that said bearing surface is positioned to permit the sash member to open beyond the partially opened position;

wherein the force applied proximate to said first end of said tumbler causes said tumbler to toggle from said first tumbler position to a retracted tumbler position, in which said at least a portion of said second end of said tumbler is positioned within said housing cavity; and wherein upon removal of the force, said tumbler is biased to pivot away from said retracted tumbler position, with said biased pivoting away from said retracted tumbler position limited by contact of said portion of said biasing member with said contoured feature, such that said tumbler is biased to pivot to said second tumbler position.

2. The stop according to claim 1, wherein said tumbler comprises a curved surface; and wherein said tumbler, when in said second tumbler position, permits the sash member to be opened beyond the partially opened position by contact of the sash member with said curved surface, thereby causing said tumbler to pivot into an intermediate tumbler position, said intermediate tumbler position being a position between said second tumbler position and said retracted tumbler position, said tumbler configured to occupy said intermediate tumbler position until the sash member moves to a position between the partially opened position and the closed position.

3. The stop according to claim 2, wherein when the sash member contacts said curved surface of said tumbler to pivot said tumbler into said intermediate tumbler position, said portion of said biasing member selectively contacts said contoured feature of said housing and moves relative to said contoured feature so as to no longer limit said outward pivotal travel of said tumbler to said second tumbler position; and wherein when the sash member is moved to a position between the partially opened position and the closed position, said tumbler is biased back into said first tumbler position by said biasing member.

4. The stop according to claim 3, wherein when said tumbler is in said second tumbler position and another force is applied at said tumbler first end, the another force causes said tumbler to toggle from said second tumbler position to said retracted tumbler position; and wherein upon removal of the another force from said first end of said tumbler, said tumbler is biased by said biasing member from said retracted tumbler position to said first tumbler position.

5. The stop according to claim 4, wherein said biasing member comprises a helical torsion spring, said helical torsion spring comprising a helical coil with first and second arms extending therefrom.

6. The stop according to claim 5, wherein said helical coil and said first arm of said torsion spring are affixed to said tumbler, and wherein said second arm terminates in a post, said post being said portion of said biasing member configured to contact and move with respect to said contoured feature.

7. A stop, for use on a window to limit sliding of a sash member with respect to a master frame of the window, between a closed position and a partially opened position, said stop comprising:

a housing, said housing comprising an interior surface defining a housing cavity, said interior surface comprising a contoured feature;

a tumbler, said tumbler comprising: a first end; and a second end comprising a bearing surface; said tumbler being pivotally mounted to said housing;

a biasing member, said biasing member configured to bias said second end of said tumbler to pivot outward from said housing cavity; a portion of said biasing member configured to contact and move with respect to said contoured feature to selectively limit outward pivoting of said tumbler, said tumbler thereby configured for toggling between a first tumbler position and a second tumbler position by a force applied to said tumbler; when in said first tumbler position, said bearing surface of said tumbler is positioned to limit opening of the sash member to the partially opened position; when in said second tumbler position, at least a portion of said second end of said tumbler protrudes out from said housing cavity, such that said bearing surface is positioned to permit the sash member to be opened beyond the partially opened position;

wherein the force applied to said tumbler causes said tumbler to toggle from said first tumbler position to a retracted tumbler position, in which said at least a portion of said second end of said tumbler is positioned within said housing cavity; and wherein upon removal of the force, said tumbler is biased to pivot away from said retracted tumbler position, with said biased pivoting away from said retracted tumbler position being limited by contact of said portion of said biasing member with said contoured feature, such that said tumbler is biased to pivot to said second tumbler position.

8. The stop according to claim 7, wherein said tumbler comprises a curved surface; and wherein said tumbler in said second tumbler position permits the sash member to be opened beyond the partially opened position by contact of the sash member with said curved surface, thereby causing said tumbler to pivot into an intermediate tumbler position, said intermediate tumbler position being a position between said second tumbler position and said retracted tumbler position, said tumbler configured to occupy said intermediate tumbler position until the sash member moves to a position between the partially opened position and the closed position.

9. The stop according to claim 8, wherein when the sash member contacts said curved surface of said tumbler to pivot said tumbler into said intermediate tumbler position, said portion of said biasing member selectively said contoured feature of said housing and moves relative to said contoured feature so as to no longer limit said outward pivoting of said tumbler to said second tumbler position; and wherein when the sash member is moved to a position between the partially opened position and the closed position, said tumbler is biased back into said first tumbler position by said biasing member.

10. The stop according to claim 7, wherein when said tumbler is in said second tumbler position and another force is applied to said tumbler, the another force causes said tumbler to toggle from said second tumbler position to said retracted tumbler position; and wherein upon removal of the another force, said tumbler is biased by said biasing member from said retracted tumbler position to said first tumbler position.

11. The stop according to claim 7, wherein said biasing member comprises a helical torsion spring, said helical torsion spring comprising a helical coil with first and second arms extending therefrom.

12. The stop according to claim 11, wherein said helical coil and said first arm of said torsion spring are affixed to said tumbler, and wherein said second arm terminates in a post, said post being said portion of said biasing member configured to contact and move with respect to said contoured feature.

* * * * *